United States Patent [19]

Yoneda et al.

[11] Patent Number: 4,958,707

[45] Date of Patent: Sep. 25, 1990

[54] ELEVATOR CONTROL SYSTEM

[75] Inventors: Kenzi Yoneda; Toshiki Kajiyama; Kazuhiro Sakata; Mitsuo Munakata, all of Katsuta; Masato Suzuki, Ibaraki, all of Japan

[73] Assignee: Hitachi, Ltd., Tokyo, Japan

[21] Appl. No.: 330,376

[22] Filed: Mar. 29, 1989

[30] Foreign Application Priority Data

Mar. 30, 1988 [JP] Japan ..... 63-74360

[51] Int. Cl.[5] ..... B66B 1/14

[52] U.S. Cl. ..... 187/101; 187/130

[58] Field of Search ..... 187/101, 121, 124, 130, 187/134

[56] References Cited

U.S. PATENT DOCUMENTS

| | | | |
|---|---|---|---|
| 3,782,504 | 1/1974 | Billmaier et al. | 187/121 |
| 4,671,391 | 6/1987 | Sasao | 187/134 |
| 4,683,989 | 8/1987 | Pillage et al. | 187/130 X |
| 4,742,893 | 5/1988 | Otala et al. | 187/130 X |
| 4,762,204 | 8/1988 | Blain et al. | 187/101 |
| 4,766,978 | 8/1988 | Blain et al. | 187/101 |

FOREIGN PATENT DOCUMENTS

| | | |
|---|---|---|
| 0062141 | 10/1982 | European Pat. Off. . |
| 0239662 | 10/1987 | European Pat. Off. . |

*Primary Examiner*—A. D. Pellinen
*Assistant Examiner*—W. E. Duncanson, Jr.
*Attorney, Agent, or Firm*—Antonelli, Terry, Stout & Kraus

[57] ABSTRACT

An elevator control system comprises an elevator controller for controlling the running of a cage and a plurality of input/output terminal equipments for controlling devices provided at a landing place on each floor and/or in the cage, each of the elevator controller and the plurality of input/output terminal equipments including a transmission controller provided with a transmission circuit and a reception circuit so that the elevator controller and the plurality of input/output terminal equipments are connected to each other through transmission lines, wherein each of the elevator controller and the plurality of input/output terminal equipments is provided with an abnormality detector for detecting an abnormality and a transmission stopping device for inhibiting transmission through the transmission circuit of its own transmission controller upon detection of occurrence of an abnormality by the abnormality detector.

15 Claims, 54 Drawing Sheets

OUTPUT CKT
INPUT CKT
INPUT CKT
RES CPU
RAM
ROM
EEPROM WEN
TM-CSP
MEMORY
TRANS-MISSION CKT
RECEP-TION CKT
OUTPUT CKT
WDTP
TXEN
TX
CLK
RX
P22
GD
Tr400
ZD400
T416
T410
T409
T402
T401
T424
T418
T417

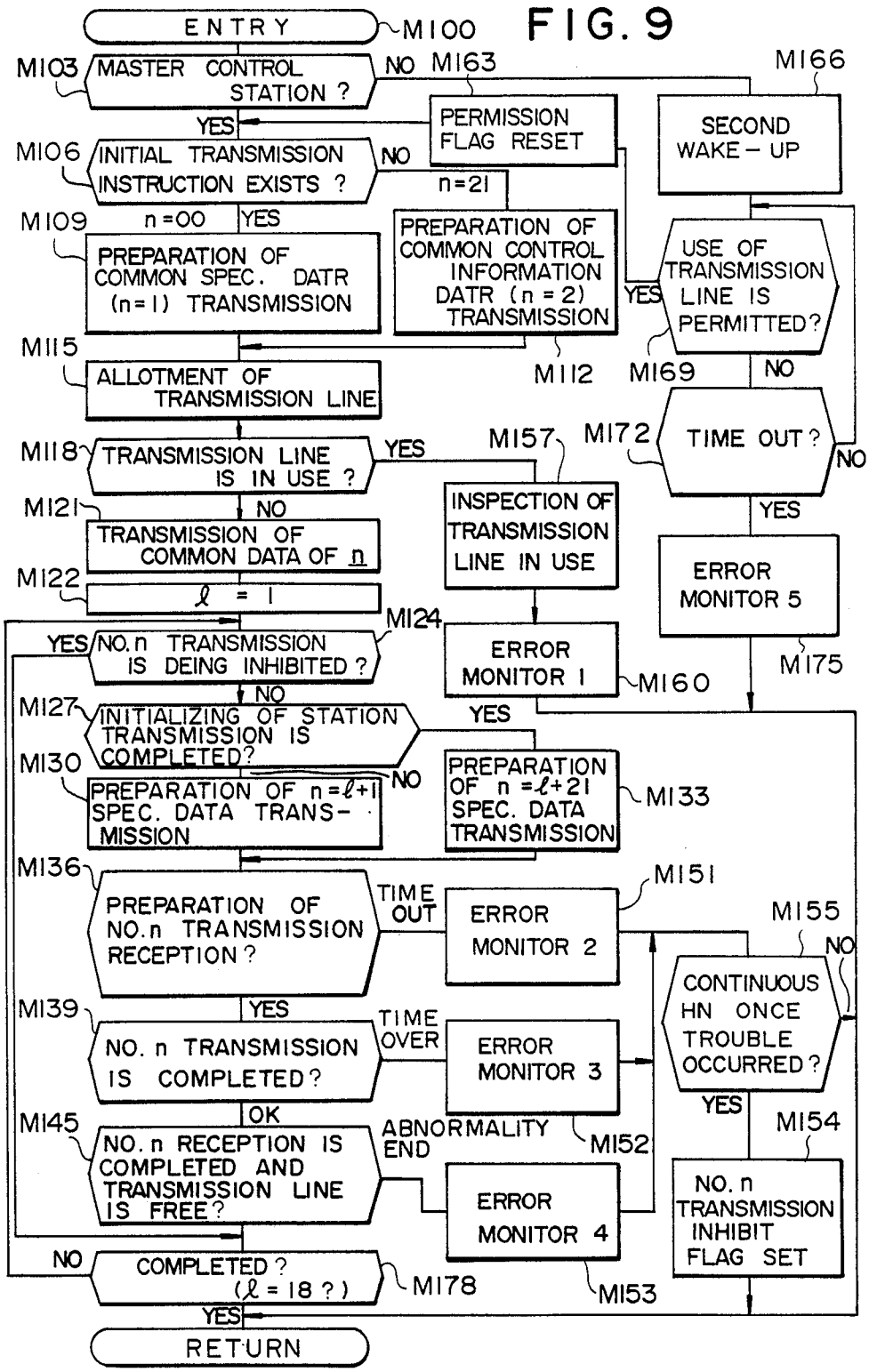
FIG. 9
ENTRY
M100
M103
MASTER CONTROL STATION ?
NO
M163
M166
YES
PERMISSION FLAG RESET
SECOND WAKE – UP
M106
INITIAL TRANSMISSION INSTRUCTION EXISTS ?
NO
n=21
M109
n=00
YES
PREPARATION OF COMMON SPEC. DATR (n=1) TRANSMISSION
PREPARATION OF COMMON CONTROL INFORMATION DATR (n=2) TRANSMISSION
YES
USE OF TRANSMISSION LINE IS PERMITTED?
M115
ALLOTMENT OF TRANSMISSION LINE
M112
M169
NO
M118
TRANSMISSION LINE IS IN USE ?
YES
M157
M172
TIME OUT ?
NO
M121
NO
TRANSMISSION OF COMMON DATA OF n
INSPECTION OF TRANSMISSION LINE IN USE
YES
M122
ℓ = 1
ERROR MONITOR 5
M124
YES
NO. n TRANSMISSION IS DEING INHIBITED ?
ERROR MONITOR 1
M160
M175
NO
M127
INITIALIZING OF STATION TRANSMISSION IS COMPLETED?
YES
M130
NO
PREPARATION OF n=ℓ+1 SPEC. DATA TRANS-MISSION
PREPARATION OF n=ℓ+21 SPEC. DATA TRANSMISSION
M133
M136
PREPARATION OF NO.n TRANSMISSION RECEPTION ?
TIME OUT
ERROR MONITOR 2
M151
M155
NO
CONTINUOUS HN ONCE TROUBLE OCCURRED ?
M139
YES
NO. n TRANSMISSION IS COMPLETED ?
TIME OVER
ERROR MONITOR 3
YES
M154
M145
OK
NO. n RECEPTION IS COMPLETED AND TRANSMISSION LINE IS FREE ?
ABNORMALITY END
M152
ERROR MONITOR 4
NO. n TRANSMISSION INHIBIT FLAG SET
NO
COMPLETED ? (ℓ = 18 ?)
M178
M153
YES
RETURN

FIG. 17A

| | |
|---|---|
| NUMBER OF SPECIFICATIONS | 511 |
| NUMBER OF TERMINAL STATIONS | NUMBER OF TERMINAL STATIONS ON PROCESSING (18) |
| IOISP(0) | 103a |
| IOISP(1) | |
| ⋮ | |
| IOISP(511) | |

FIG. 17B

| | |
|---|---|
| KIND OF INPUT DATA | |
| DATA INVERSION BIT SPECIFICATION | |
| ADDRESS OF TERMINAL INPUT DATA (RELATIVE) | |
| INPUT BIT SPECIFICATION | |
| ADDRESS OF DEVELOP-END CONTROL INPUT TABLE (RELATIVE) | |
| SET BIT SPECIFICATION | |
| VARIATION SPECIFICATION | NUMBER OF FILTER TIMES AND COPY OR COPY |

FIG. 17C

| | |
|---|---|
| KIND OF INPUT DATA | |
| DATA INVERSION BIT SPECIFICATION ADDRESS OF TERMINAL INPUT DATA (RELATIVE) | |
| HEAD ADDRESS OF DEVELOP-END CONTROL INPUT TABLE (RELATIVE) | |
| VARIATION | NUMBER OF FILTER TIMES |

(RECEPTION COMPLETION)
a
b
(I/O PROCESSING COMPLETION)
c
Reset
TXEN
PWON
IC31
IC32
IC33
IC34
IC35
IC36
IC40
IC41
IC50
IC21
IC22
IC23
IC20
IC11
IC10
IC1
IC2
IC3
IC4
IC5
a3B
a1
a2
a3
a4
a5
a6
a7
b1
b2
R1
R2
R3
R4
R5
R11
R12
R13
R14
C1
C2
C3
C4
C5
C11
C12
C13
C14
P5
GD

FIG. 40A

NWST-BN

| | TRANSMISSION BLOCK (Bn) | RECEPTION STATION SECTION (Kn) | ACK TRANSMISSION STATION (AK) | TRANSMISSION MODE (PRC) | TRANSMISSION LINE | MAXIMUM NUMBER OF STATIONS (MAXK) | PER STATION | | | PER TRANSMISSION BLOCK | | | ABNORMALITY JUDGEMENT TIME (ERTM) |
|---|---|---|---|---|---|---|---|---|---|---|---|---|---|
| | | | | | | | NUMBER OF TRANSMISSION (MAXT) | NUMBER OF RECEPTION (MAXR) | TIME MARGINE (MTIM) | PERIOD (TXNTM) | PRIORITY (TXPR) | MINIMUM PERIOD (TXMTM) | |
| H-I/O COMMON I | 1 | 1 | 0 | 6 | 3 | 1 | 32 | 0 | 20ms | SFE(8S) | 11 | SFE(∞) | 20ms |
| H-I/O EACH STATION I | 2 | 2 | 0 | 6 | 1 | 10 | 32 | 0 | 20ms | SFE(8S) | 11 | SFE(∞) | 100ms |
| H-I/O COMMON | 3 | 1 | 0 | 1 | 3 | 1 | 32 | 0 | 10ms | S01(33 | 2 | S01 (3.3 | 10ms |
| H-I/O EACH FACE | 4 | 2 | 0 | 1 | 1 | 10 | 8 | 4 | 8ms | S01 | 2 | S01 | 40ms |
| H-I/O INFORMATION COMMON FACE | 5 | 3 | 2 | 5 | 1 | 1 | 64 | 0 | 30ms | S09(0.3S) | 9 | S3C(2S) | 30ms |
| M.I → | 11 | 4 | 0 | 3 | 1 | 1 | 128 | 0 | 100ms | SFE(8S) | 12 | SFE(∞) | 100ms |
| M → | 12 | 4 | 0 | 2 | 1 | 5 | 32 | 0 | 10ms | S06(0.2S) | | S0C(0.4S) | 50ms |
| Z → | 13 | 5 | 1 | 2 | 1 | 1 | 24 | 0 | 9 ms | S03(0.1S) | 5 | S06(0.2S) | 9ms |
| UCB → | 14 | 6 | 0 | 4 | 2 | 2 | 32 | 32 | 22ms | S1E(1S) | 6 | S78(5S) | 44ms |
| MAS → | 15 | 7 | 0 | 4 | 2 | 2 | 32 | 32 | 22ms | S3C(2S) | 8 | S78(5S) | 44ms |

$00 EVEN FOR EVERY STATION

1: TRANSMISSION LINE a, 2: TRANSMISSION LINE b, 3: TRANSMISSION LINES a,b

FIG. 40B

NWST-AK

| TRANSMISSION MODE (PRC) | ACK (WITH RECEPTION) | CHANGE TRANSMISSION 1 | CHANGE TRANSMISSION 2 | NUMBER OF RE-SEND | |
|---|---|---|---|---|---|
| 1 | 1 | 0 | 0 | 0 | I/O |
| 2 | 1 | 1 | 0 | 0 | GROUP ↔ EACH |
| 3 | 1 | 0 | 1 | 3 | INITIALIZING GROUP ↔ EACH |
| 4 | 1 | 0 | 0 | 1 | UCB MAS |
| 5 | 0 | 0 | 1 | 1 | INFORMATION TRANSMISSION |
| 6 | 1 | 0 | 0 | 3 | INITIALIZING TRANSMISSION |

FIG. 40C

NWST-KN

| RECEPTION STATION SECTION | I/O CAGE 1 | I/O CAGE 2 | I/O HALL 1-20 | | | I/O | INFORMATION |
|---|---|---|---|---|---|---|---|
| | 1 | 2 | 1 | 2 | 3 | 20 | 2 |
| 0 | 0 | 0 | 0 | 0 | 0 | 0 | 0 |
| 1 | 0 | 0 | 1 | 1 | 1 | 0 | 1 |
| 2 | 0 | 0 | 1 | 1 | 1 | 0 | 1 |
| 3 | 0 | 0 | 0 | 0 | 0 | 0 | 1 |
| 4 | 0 | 0 | 0 | 0 | 0 | 0 | 0 |
| 5 | 0 | 0 | 0 | 0 | 0 | 0 | 0 |
| 6 | 0 | 0 | 0 | 0 | | 0 | 0 |
| 7 | 0 | 0 | 0 | 0 | | 0 | 0 |

FIG. 40D

NWCT

| TRANSMISSION STATION IN ACTUAL TRANSMISSION RNK | EACH STATION DATA | | | EACH TRANSMISSION BLOCK DATA | | | ABNORMALITY JUDGEMENT TIME WK | |
|---|---|---|---|---|---|---|---|---|
| | EXECUTION COMPLETION RFI(K) | INTERVAL TMI(K) | ERROR ERCI(K) | EACH STATION MAX TIME TMI | TIME MAX TM2 | ERROR ERC2 | | |
| 2 | 1, 10···0 | ? | 0,0,···0 | 1, 7ms | 7 ms | 0 | ? | NWCT 1 |
| 10 | 1, 1 ···1 | ? | 0,0,···0 | 6, 8ms | 65 | 0 | ? | NWCT 2 |
| 3 | 1, 1 ···1 | ? | 0.0.1···0 | 6, 8 | 8 | 1 | ? | NWCT 3 |
| 10 | 1, 1 ···1 | ? | 2.1,0···0 | 6, 4 s | 30 ms | 3 | ? | NWCT 4 |
| 2 | 1 | ? | 0 | 2, 14 | 14 ms | 0 | ? | NWCT 5 |
| 0 | | | | | | | ? | |
| 0 | | | | | | | | NWCT 15 |

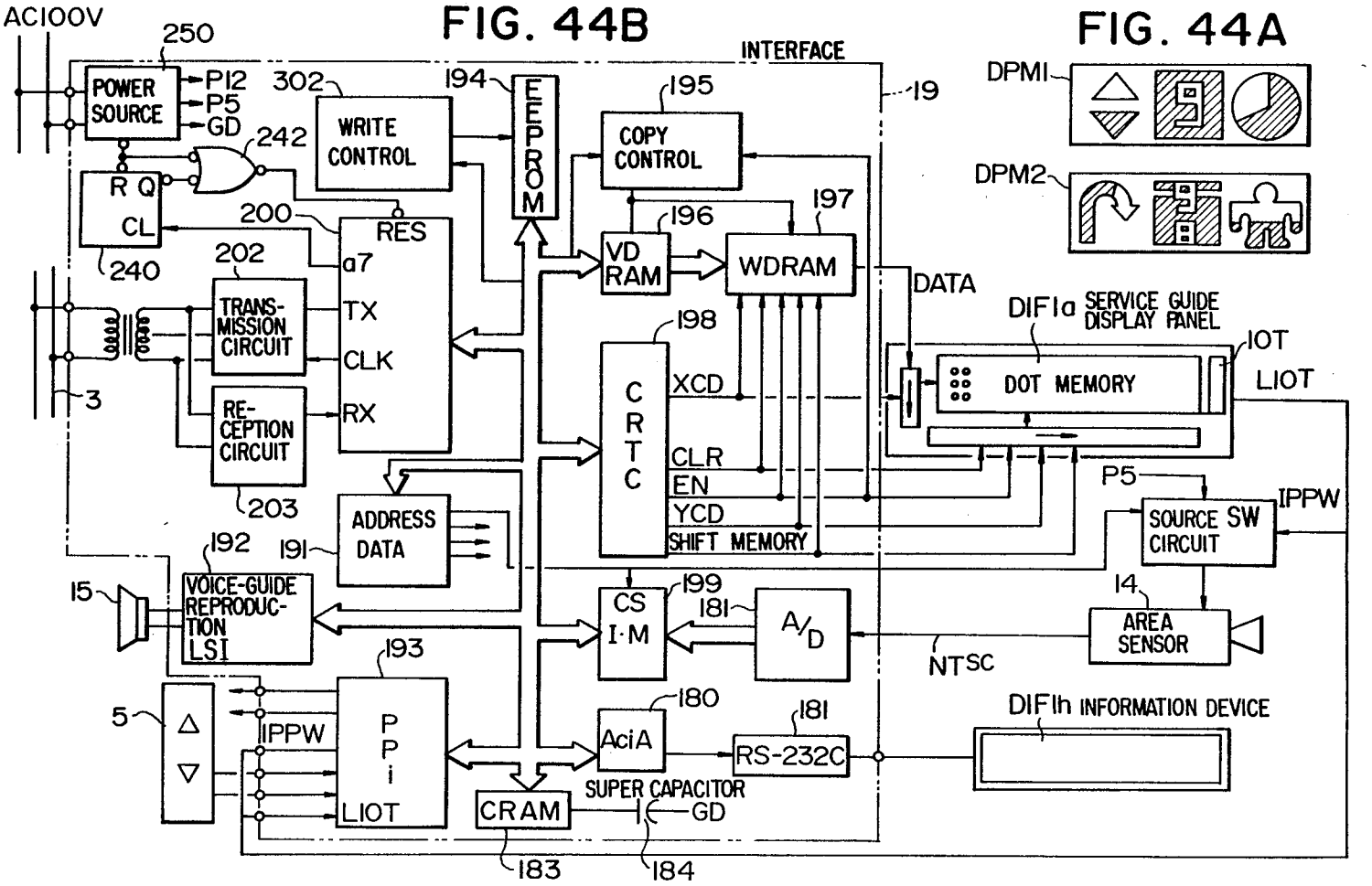
FIG. 44A
DPM1
DPM2
FIG. 44B
INTERFACE
19
DATA
DIF1a SERVICE GUIDE DISPLAY PANEL
DOT MEMORY
10T
LIOT
IPPW
SOURCE SW CIRCUIT
P5
AREA SENSOR
14
NTSC
DIF1h INFORMATION DEVICE
WDRAM
197
COPY CONTROL
195
VD RAM
196
198
XCD
CLR
EN
YCD
SHIFT MEMORY
C R T C
A/D
181
199
CS I·M
RS-232C
180
AciA
SUPER CAPACITOR
GD
184
CRAM
183
EEPROM
194
WRITE CONTROL
302
RES
a7
TX
CLK
RX
200
ADDRESS DATA
191
193
P P I
LIOT
IPPW
TRANS-MISSION CIRCUIT
202
RE-CEPTION CIRCUIT
203
VOICE-GUIDE REPRODUC-TION LSI
192
242
P12
P5
GD
250
POWER SOURCE
R Q
CL
240
AC100V
3
15
5

ELEVATOR CONTROL SYSTEM

BACKGROUND OF THE INVENTION

The present invention relates to an elevator control system for controlling an elevator by use of an electronic computer, and particularly relates to localization of functional down in case of occurrence of a fault.

In a conventional elevator control system, a power source is made off upon detection of occurrence of a fault in a computer and then made on automatically after a predetermined period of time has elapsed, or a hardware circuit is provided for causing the system to restart, as disclosed in Japanese Patent Unexamined Publication No. 52-115048.

Further, there has been proposed an elevator control system comprising a task closing time controller provided with a timer for detecting passing of processing time as disclosed in Japanese Utility Model Unexamined Publication No. 48-27732, or there has been proposed another elevator control system the functions of which are assigned to two microcomputers as disclosed in Japanese Unexamined Patent Publication No. 56-75356.

As the contents of service of an elevator become richer, the number of wirings is increased more and more between an elevator control system and controlled devices such as a cage position indicator and a hall-call device which are provided at each landing-place, a designation-floor-call registration device which is provided in each cage or at each landing-place, and so on.

In order to reduce the number of such wirings, therefore, there have been made various proposals, for example, as disclosed in Japanese Patent Unexamined Publications No. 47-41499, No. 52-152050, and No. 52-53354.

Besides, there have been made proposals in which a micro-computer is provided on each floor to perform serial data transmission to thereby reduce the number of wirings, as disclosed in Japanese Patent Unexamined Publications No. 61-69677 and No. 61-194943.

Moreover, as disclosed in Japanese Unexamined Patent Publication No. 62-99791, there has been proposed a cage-side controller which gives a running-stop command to a computer built in a cage when the cage built-in computer does not change a signal for a predetermined period of time and generates an abnormality signal for the cage built-in computer, and then which makes the cage built-in computer restart.

Further, as disclosed in Japanese Unexamined Patent Publication No. 60-157478, there has been proposed a control system in which a registration-propriety signal for each call-button is stored in advance in an input/output terminal equipment so as to perform registration-propriety processing immediately when a call-button is pushed to thereby solve a problem which will be caused by delay in lighting of an answer lamp for the call of the call-button due to delay in transmission of a lighting signal to the answer lamp.

SUMMARY OF THE INVENTION

Since the general purpose property of a controller is not taken in consideration in the foregoing prior art control systems, there have been problems as follows.

(1) As input/output signals increase because of an increase in number of floors or because of provision of a panel indicator or a designation-floor-call registration device for performing the indication of service floors or waiting time at a landing-place, etc. (in a port system elevator), it becomes necessary to make the signal transmission rate high (thereby producing the necessity of the use of co-axial cables or twisted pair lines to results in cost-up) or it is necessary to prolong the I/0 processing period.

(2) As has described above, with respect to elevators, the number of floors, the kind of guide indicators, and so on, will vary for every user to which the elevators are delivered.

For example, various kinds of hall-call registration devices are required, the examples of them including widely from the simplest hall-call registration device having only one button input for up-call to a complicated hall-call registration device having eight sets of button inputs and answer lamps for use for a person in a wheel-chair (for up and down calls), for use for a call for an underground floor, for use for a call for a roof floor. If an individual serial transmission procedure and an individual input/output terminal equipment having specific input/output circuits are designed and produced in accordance with a specification every time elevators are to be delivered, not only it is difficult to realize mass production but also it is impossible to use a one-chip microcomputer or a masked ROM which has been remarkably reduced in cost recently and it is therefore extremely difficult to reduce the cost of the elevator control system per se.

Further, recently, new requirements have been additionally raised so as to shorten the period of reduction of function and to narrow the region of stoppage of function while insuring safety as the whole of a control system in case of occurrence of abnormality due to noises or voltage-down in a computer or in an input-/output terminal equipment.

It is therefore an object of the present invention to provide an elevator control system which has a general-purpose property and which can be easily applied to any elevators having any specifications.

It is another object of the present invention to provide an elevator control system in which wirings between an elevator controller and each input/output terminal equipment constituting the elevator control system are made simple.

It is a further object of the present invention to provide an elevator control system in which it is possible to shorten the period of reduction of function and to narrow the region of stoppage of function in case of occurrence of abnormality.

In order to attain the above objects of the present invention, in an elevator control system constituted by an elevator controller for controlling the running of a cage and a plurality of input/output terminal equipments for controlling devices provided in doorway portions of respective floors or in the cage, each of the elevator controller and the input/output terminal equipments including a transmission controller having transmission and reception circuits so that the elevator controller is connected to each of the input/ output terminal equipments through a transmission line, each of the elevator controller and the input/output terminal equipments is provided with an abnormality detection means for detecting abnormality and a transmission stopping means for inhibiting the transmission through the transmission circuit of its own transmission controller upon detection of abnormality by its own abnormality detection means, each of the transmission controllers being arranged to restart the transmission if predetermined conditions are satisfied after the occurrence of the abnormality.

A transmission controller which has detected abnormality stops signal transmission so as to inhibit sending-out, onto the transmission line, of data causing noises which may prevent the other elevator controllers or the input/output terminal equipments from operating normally. Therefore, even if the transmission controllers become down partly, only normal data necessary for the running of the cage are existing on the transmission lines so that the cage can continue its running. If the transmission controller in which abnromality has occurred comes back into a normal state, the transmission controller restarts the signal transmission in response to the confirmation effected by the elevator control system and the input/output terminal equipment performs its proper operation.

BRIEF DESCRIPTION OF THE DRAWINGS

Other features and advantages of the present invention will be apparent from the following description taken in connection with the accompanying drawings, wherein:

FIGS. 6A, 6B, 6C to 11 are flow charts for explaining the operation of the individual elevator system shown in FIG. 2.

FIGS. 17A to 17D, and 18A to 18C are diagrams for explaining a method for forming a control input table;

FIGS. 40A to 40D are diagrams illustrating in detail a transmission-control specification table in the network-transmission controller shown in FIG. 19;

FIGS. 44A and 44B are diagrams illustrating examples of the hardware construction of an indicator;

DESCRIPTION OF THE PREFERRED EMBODIMENTS

Figure 1:
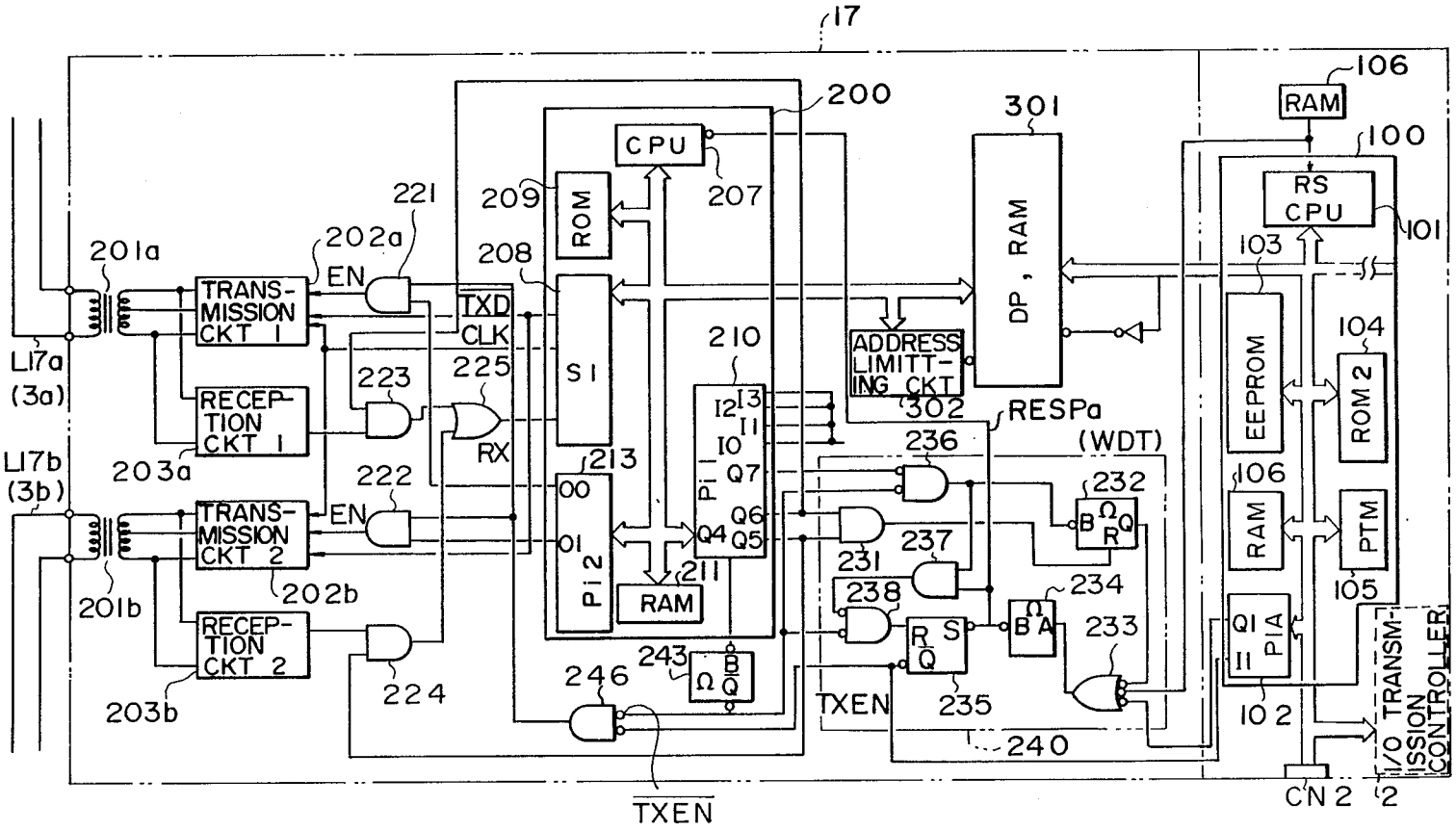
FIG. 1 is a diagram illustrating an embodiment of the elevator control system and an I/O transmission controller according to the present invention.

The elevator control system according to the present invention will be described in detail in reference to embodiments illustrated in the accompanying drawings.

The features of the present invention may be briefly described as follows with respect to the embodiments.

(1) A one chip microcomputer or gate array LSI having a communication circuit is built in each input/output terminal equipment (hereinafter abbreviated to "terminal"), and terminal specification data defining the specification of an input/output pin of each terminal, the relationship between the input and output thereof, and so on, are received from an elevator controller, an elevator group-control controller or the like (hereinafter abbreviated to "host").

(2) The period of a round of whole terminal stations is made to be a comparatively long (33.3 ms) (low speed) so as to make each bus writing line inexpensive. The term of the "terminal station" is defined as "a serial transmission circuit for interfacing a common serial transmission line (hereinafter simply referred to as "bus") connected to each input/output terminal equipment".

(3) At least one data transmission controller is provided in each host. The data transmission controller is connected through a dual-port RAM (hereinafter abbreviated to "DPRAM") to a computer constituted by a microcomputer or the like for performing control processing in the host side, (i) so as to give transmission specification data and the terminal specification data described in the above item (1) to the computer from the host, and (ii) so as to perform data transmission processing between input/output terminal equipment and hosts.

(4) The host produces terminal specification data corresponding to each input/output signal from each terminal according to a running mode, for example, in maintenance, in presence of a non-stop command, in rapid running, or the like, and transmits the terminal specification data to each terminal if necessary. Then each terminal performs corresponding control and so on in call-button operation in accordance with the terminal specification data received for the terminal proper from the host, thereby preventing the delay in coping control from occurring due to the above-mentioned transmission period.

(5) Each of the host and terminals connected to the bus watches the operation of a main processing circuit (a one-chip microcomputer or the like) provided therein and having a transmission processing function so that it stores abnormality if detected. Each of the host and terminals has an individual hardware for preventing data from being transmitted to the bus until the reception of the above-mentioned specification data from the DPRAM or from the bus has been completed, thereby preventing abnormality data from being transmitted to the bus in the case of the turning-on of a power source, in the case of occurrence of abnormality in a main circuit, in the case of retrial upon detection of abnormality, or the like.

By the above-mentioned configuration, various effects can be obtained as follows.

a. At the time of turning on a power source, or the like, the terminal specification data has not been transmitted from the host yet, so that each terminal does not operate even if the terminal receives a false hall-call signal due to a transient phenomenon or the like, and there is no possibility that an answer lamp is erroneously lighted or call-registration is erroneously performed.

b. When the elevator is being put in a service state, the terminal specification data necessary for performing proper control in response to an input signal has been transmitted to the proper terminal, so that as soon as an operation button is pushed (for example, within 50 msec), it is possible to perform response control such as answer-lamp flicker lighting control or touch-sound generating control for a predetermined period (by the way, general persons being sensible of delay in response if the delay is over 0.1 second, thereby causing a sense of abnormality which may be a cause of an objection).

c. On the other hand, input signals from various operation buttons and detectors are transmitted to the host, and the host performs necessary processing such as call-registration processing control and so on, so that the host not only performs running control of the elevator but transmits running control data such as a registered call signal and so on together with a guide signal and so on sequentially to each terminal station in the proper terminal.

As the result, upon reception of those control data, the terminal performs a service in accordance with the call registration signal, in place of, for example, the above-mentioned temporary response control having been performed in accordance with an input signal from an operation button and the terminal specification data, so that it is possible, for example, to make each terminal continue lighting an answer lamp till the coincidence of cage-position data with a set floor or till the trailing (cancel) of the call-registration signal.

d. It is possible to perform proper handling to cope with an emergency of abnormality and to realize self-recovery or localization of system-down.

According to the present invention, various terms are defined as follows.

HOST CONTROLLER

The host controller is defined as means for controlling running of a cage, for example, such as an elevator controller, an elevator group-control controller, a maintenance information controller for watching abnormality in an elevator or performing information transmission control, a user command board for performing control specification setting or information guide entry, and so on.

INPUT/OUTPUT TERMINAL EQUIPMENT

The input/output terminal equipment is defined as means for controlling apparatus or devices provided in a doorway portion at each floor or inside a cage.

MASTER STATION

The master station is defined as a transmission controller provided in the host controller.

TERMINAL STATION

The terminal station is defined as a transmission controller provided in the input/output terminal equipment side.

MAIN CONTROL STATION

The main control station is defined as an elevator controller for a cage set in the first rank in the case of group-control.

SUBSIDIARY CONTROL STATION

The subsidiary control station is defined as an elevator controller for a cage set in the second rank or lower in the case of group-control.

FIG. 1 shows the hardware configuration of a microcomputer 100 for determining the control logic of an elevator controller (host) 1, and an I/O transmission controller 200.

In this embodiment, by use of a dual-port RAM (hereinafter abbreviated to "DPRAM") 301, CPUs 101 and 207 respectively arranged in the microcomputer 100 and the I/O transmission controller 200 are kept in comparatively close coupling with each other through buses 107 and 212.

Figure 6A:
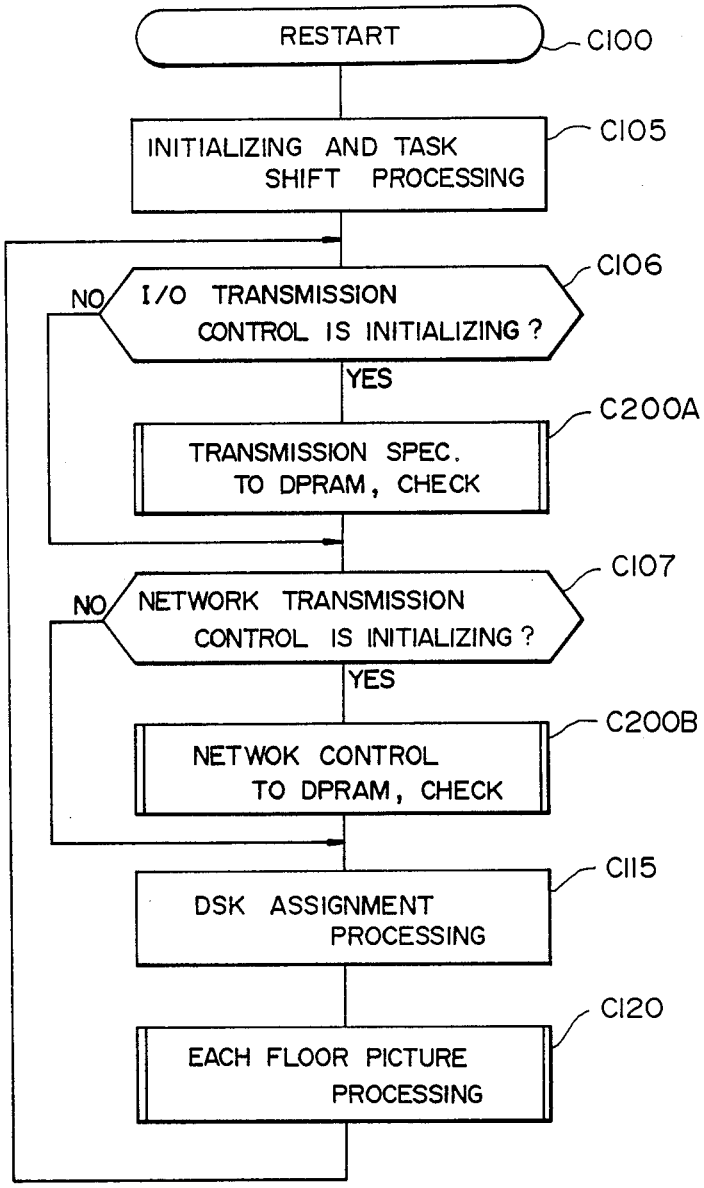
Figure 6B:
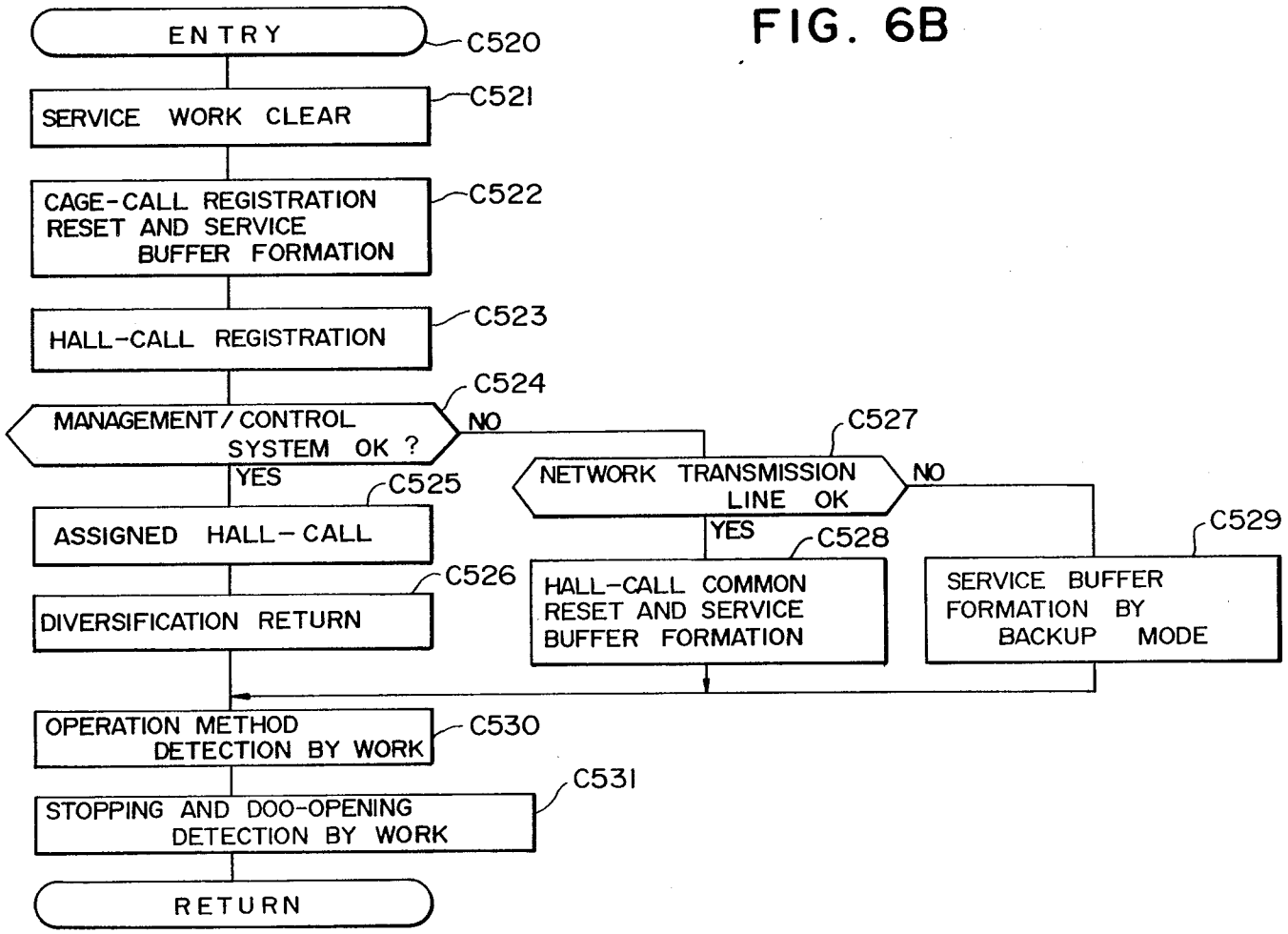
Figure 6C:
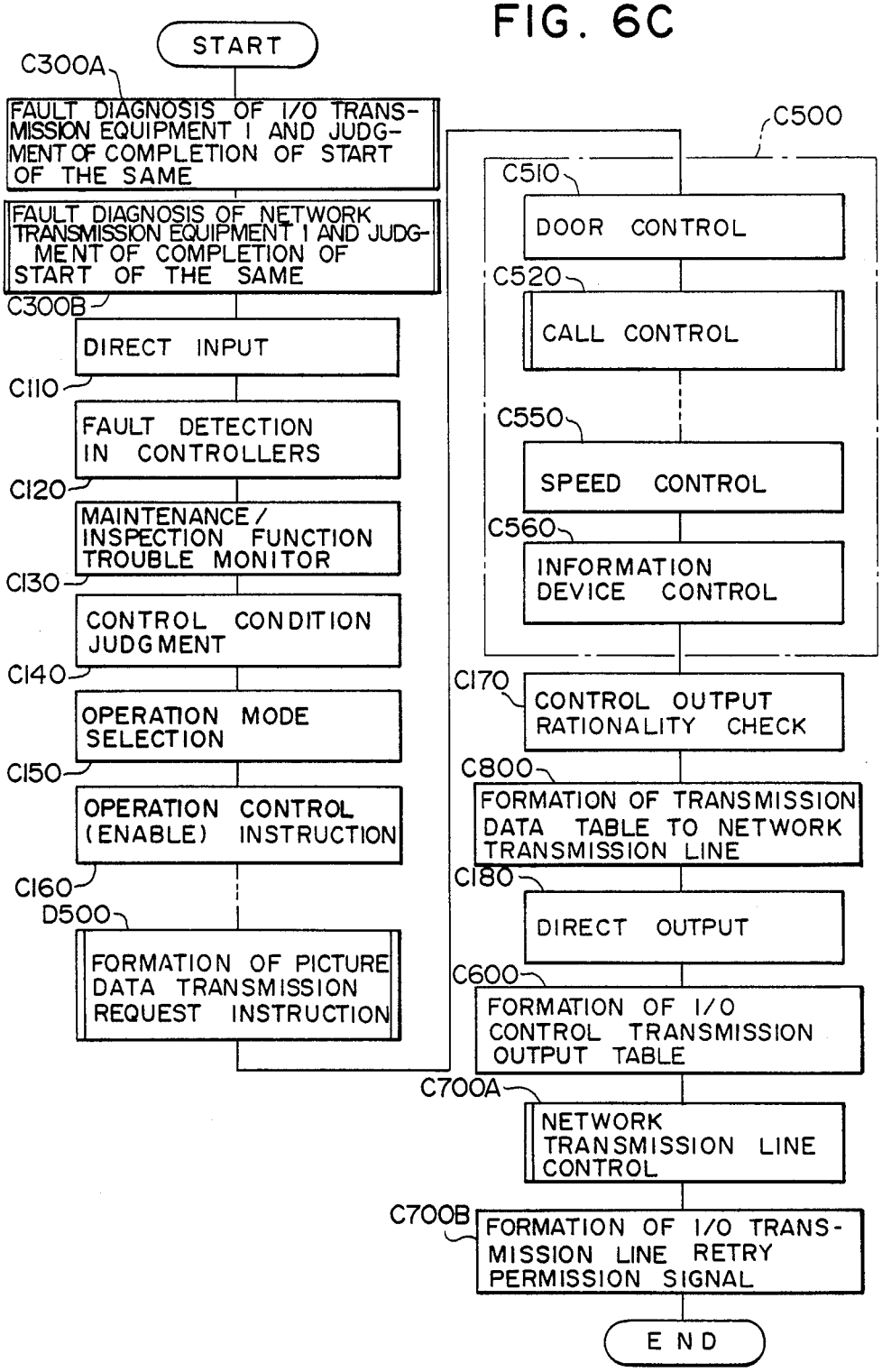
Figure 7:
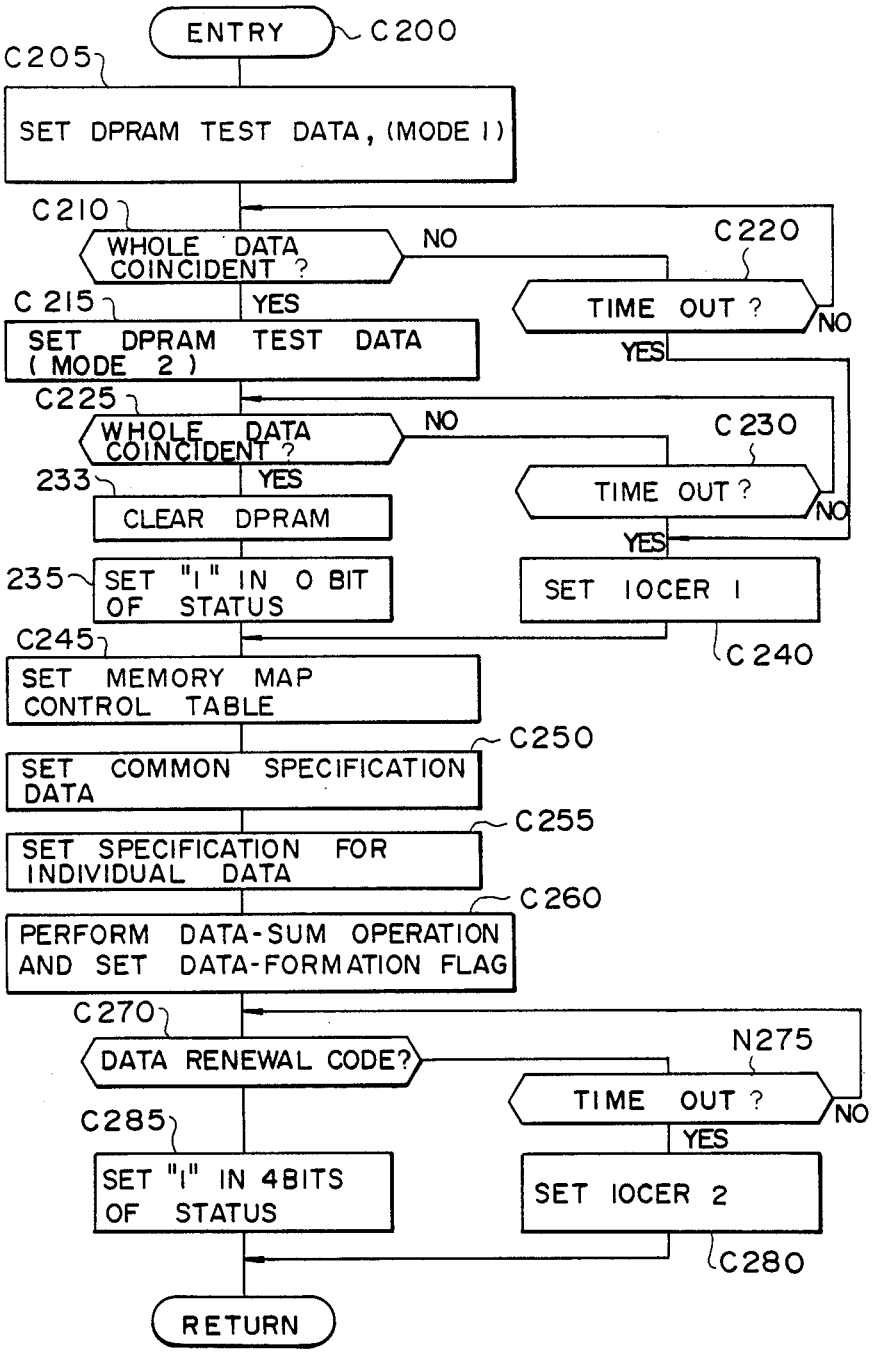
Figure 14:
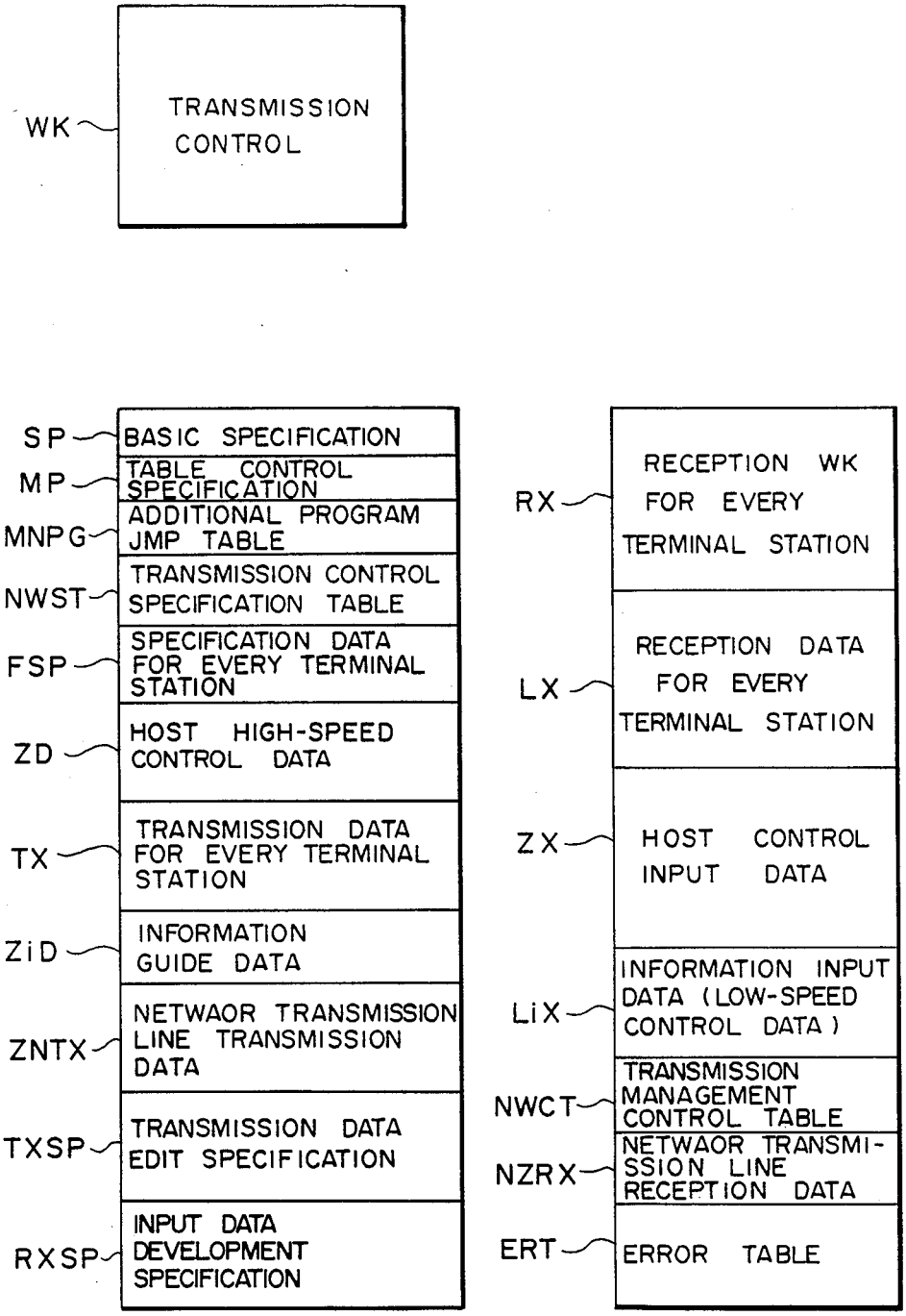
FIG. 14 is a diagram illustrating an example using a memory in a DPRAM.
Figure 15:
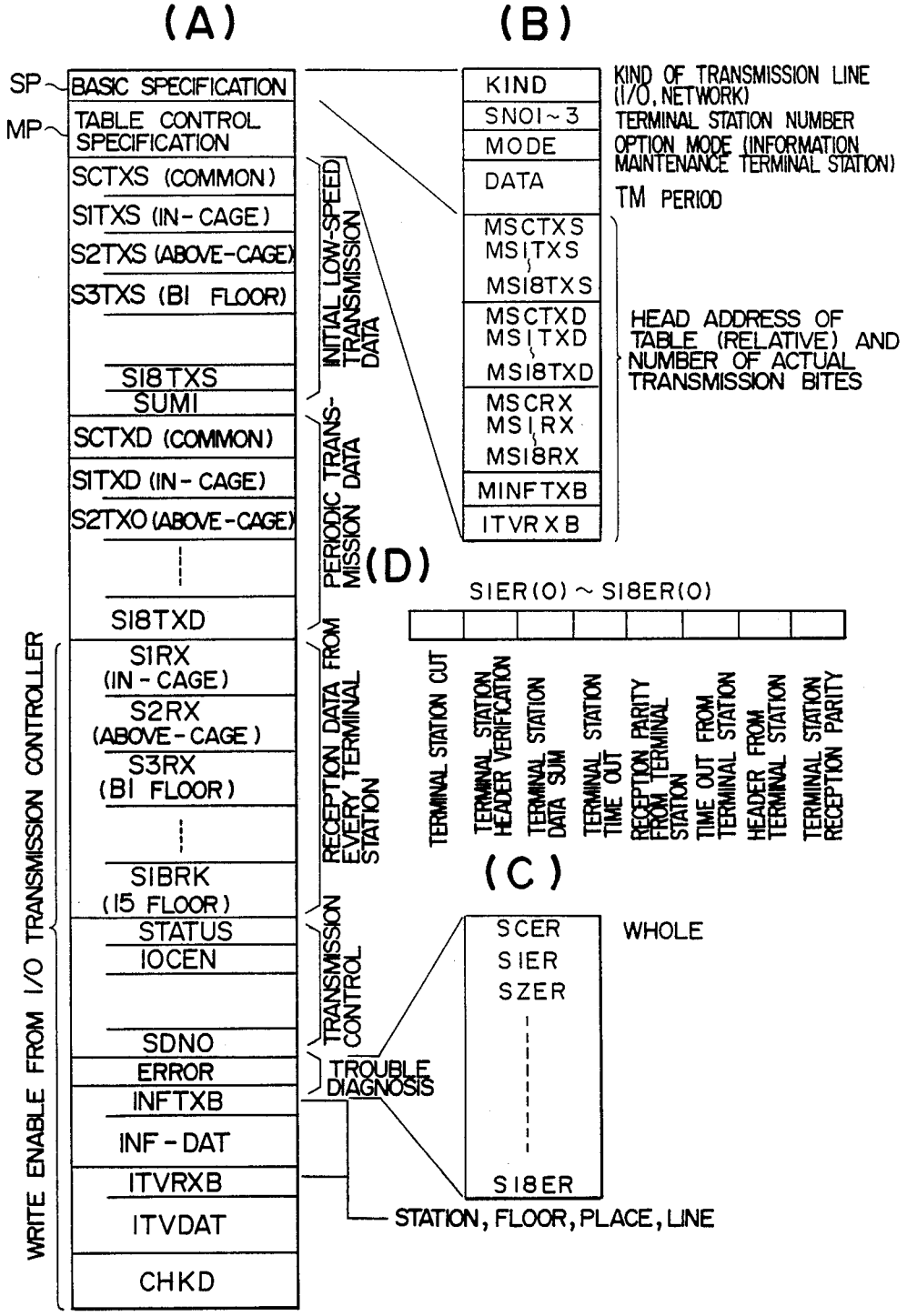
FIG. 15 is a diagram illustrating in detail the example using the memory in the DPRAM shown in FIG. 14.

The CPU 101 in the elevator controller 1 stores the following two kinds of data in the DPRAM 301 in accordance with an operation flow shown in FIGS. 6 and 7. The whole of the two kinds of data is shown in FIG. 14 and main portions of the same are shown in FIG. 15 (for and I/O transmission line) and FIG. 40 (for a network transmission line).

(1) Stored are transmission specifications SP to FSP such as a basic specification for transmission control used by an I/O transmission controller 2 or the CPU 207 in a network transmission controller 17, and so on.

By those stored data, various execution programs standardized and made in the form of masked ROM by modules in a ROM 209 make up various forms of transmission control on the basis of those specification data SP to FSP. For example, as has been briefly described above, it is made possible to make the network transmission controller 17 completely agree in hardware as well as software (program/data in ROM) with another network transmission controller 17 of another elevator controller for coupling with the other elevator controller, for example, for the purpose of parallel operation of two elevator systems. That is, it is possible to command various forms of transmission from a host on the basis of values of a code stored in a kind KiND and shown in Table 1, the number MAXSNO of terminal stations on processing, an option command register MODE belonging to the kind KiND such as a command to permit to temporarily move a right of bus control to a presently available terminal station designating register and an information/maintenance station, a master station transmitting period TM, master station specification data DATA determining the processing in the case of occurrence of an error, etc.

TABLE 1

| KiND | |
|---|---|
| 0 | not-designated (in initializing) |
| 1 | main control station for I/O transmission line |
| 2 | subsidiary control station for I/O transmission line |
| 3 | General station for high-functional terminal equipment (UCB and so on) connected to I/O transmission line |
| 4 | control station (subsidiary control station) for leased transmission line for group control |
| 5 | general control transmitting station for leased transmission line for group control |
| 6 | general information transmission station for network transmission line |
| 7 | general control transmission station for network transmission line |
| 8 | control station (subsidiary control station) for network transmission line |

In a network transmission line, used is a transmission control table NWST defining the above-mentioned transmission specification for every transmission block number, as shown in FIG. 40 by way of specific example. Therefore, on the basis of the judgment on the elevator controller 1 side as to whether maintenance is being carried out or not, as to whether the system is starting up or not, and so on, it is possible to prolong the transmission period TM shown in FIG. 15 or the period TXNTM shown in FIGS. 40A to 40D, or to newly give a command at a desired timing even if the elevator is being in a service, such as a command to permit to move a bus control plate of an information control terminal station 17U1 or a maintenance terminal station 17H1 shown in FIG. 20 sequentially for a predetermined period.

(2) Terminal specification data SCTXS to S18TXS to be transmitted from a master station to each terminal station and control data SCTXD to S18TXD necessary for each terminal station are produced. The terminal specification data SCTXS to S18TXS define the manner of use of hardware of an input/output terminal of the terminal station and define the control specification of the hardware.

Here, the terminal specification data SCTXS are common to all the terminal stations, and the terminal specification data S1TXS to S18TXS are those for the first terminal station (here, an intra-cage input/output terminal equipment 6) to the eighteenth terminal station, respectively and correspondingly. The CPU 207 in a master station transmits data of the DPRAM 301 through a serial interface (hereinafter abbreviated to "SI") to all the terminal stations through transmission line 3*a* and 3*b* by means of transmission circuits 202*a* and 202*b* and pulse transformers 201*a* and 201*b* in accordance with the operation flow shown in FIG. 9 and described later in detail, the data having various quantities corresponding to the orders shown in FIG. 12(*a*).

Here, the control data SCTXD are common to all the terminal stations, and all the basic data are transmitted so as to be able to cope with various specifications.

Figure 13:
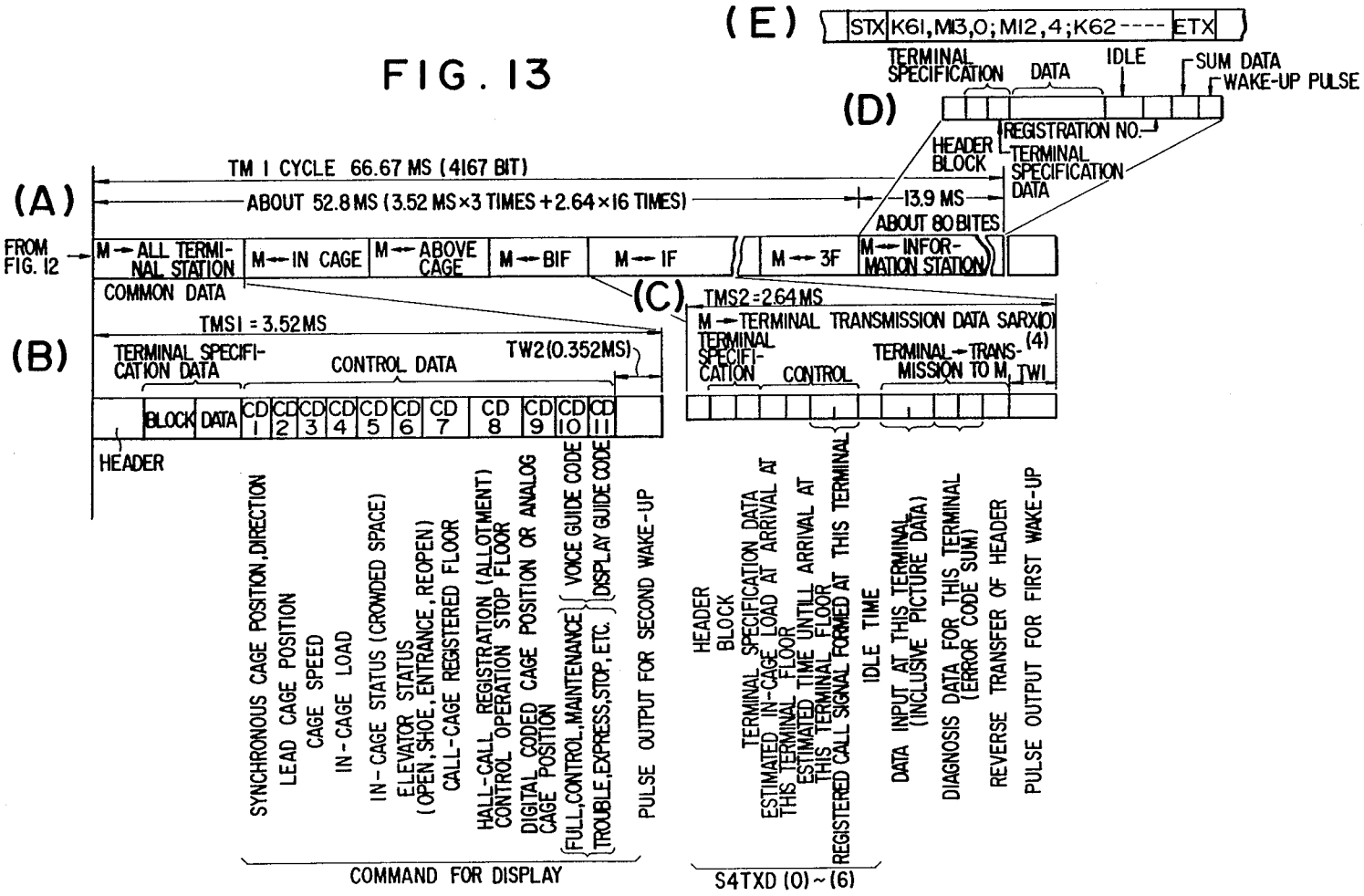

The control data S1TXD to S18TXD are those for the first to the eighteenth terminal stations, respectively and correspondingly, and are transmitted sequentially as shown in FIG. 13(*a*).

Figure 2:
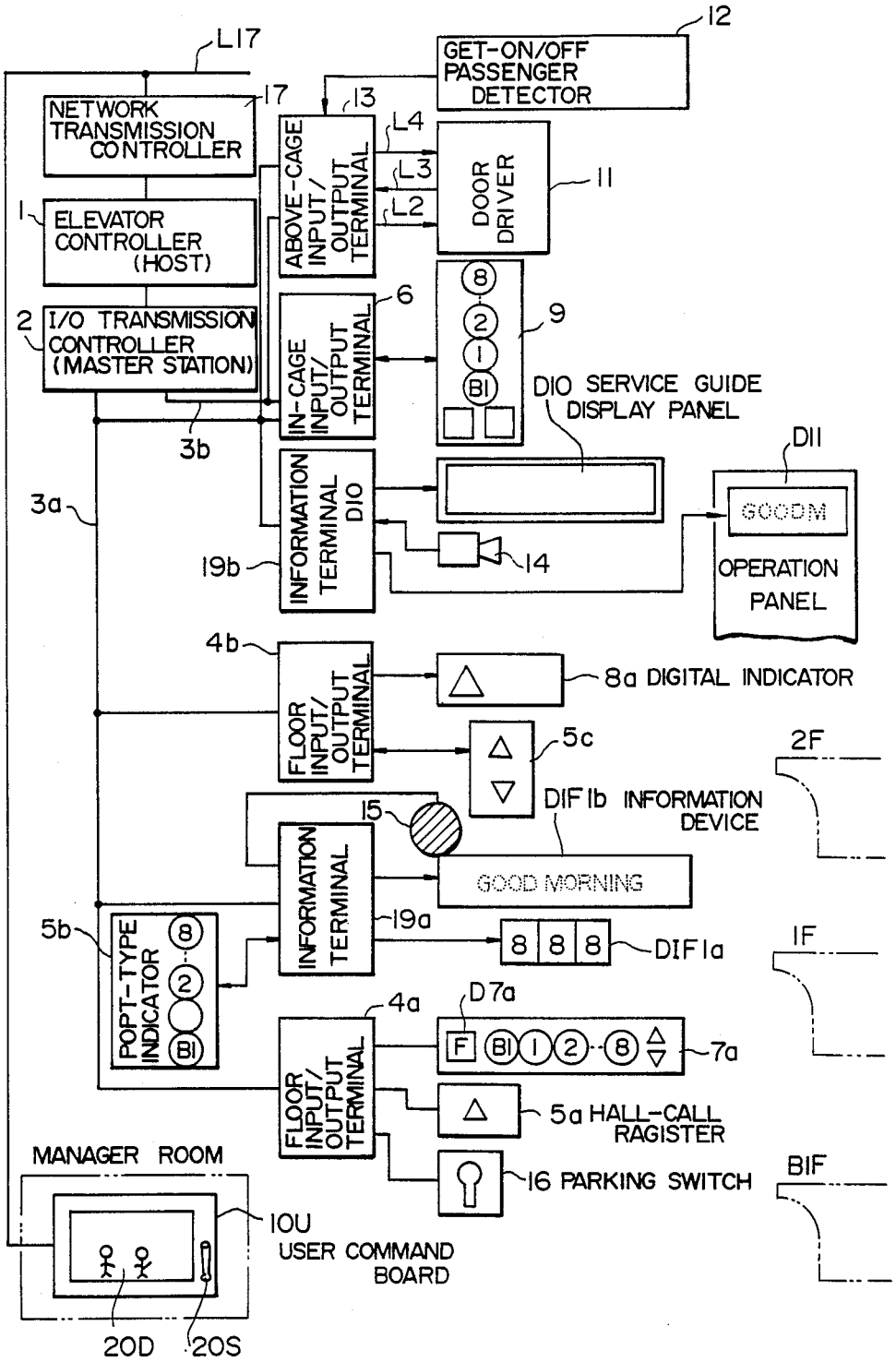
FIG. 2 is a diagram illustrating the construction of an individual elevator system to which the present invention is applied.

In an example shown in FIG. 2 illustrating the whole configuration thereof, in the case where a port-type indicator 5*b* is provided in a terminal equipment 19*a* on the first floor 1F, both of the transmission data (S1TXS, S1TXD) and reception data (S1RX) are larger in quantity than those in any other hall-terminal station. Then, as shown in FIG. 15(*b*), it is a transmission table control specification table MP (Ms1TXS, MS1TXD, MS1RX, etc.) which controls these transmission/ reception data tables.

Various devices are adopted in FIG. 1, and parts of them will be described supplementarily.

First, an address limiting circuit 302 is provided for limiting a region written by the CPU 207 into the area of the DPRAM 301 illustrated in FIG. 14, so as to improve the probabilities of the inquiry of cause of produced abnormality and the automatic recovery therefrom.

Figure 41:
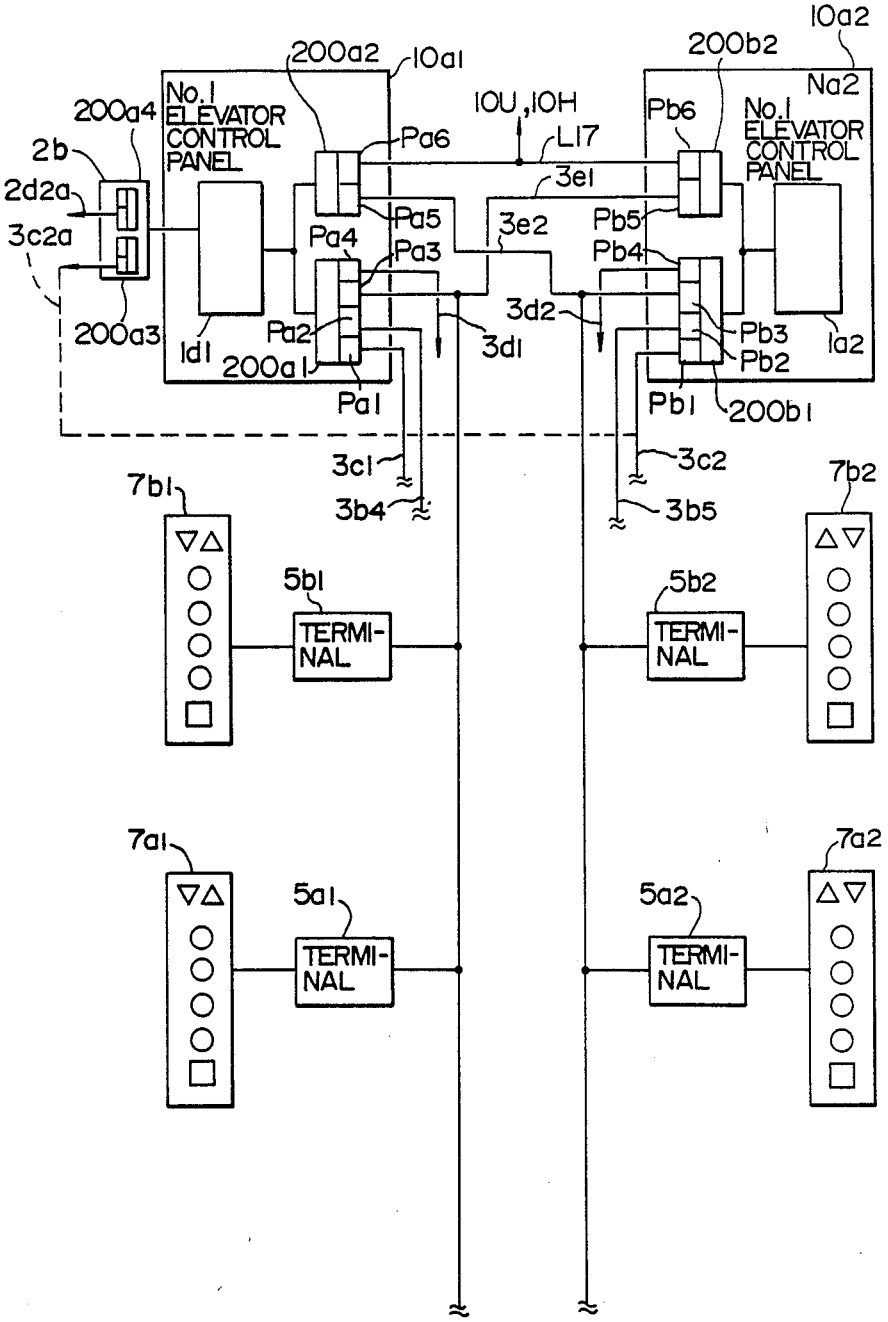
FIGS. 41 and 42 are a diagram illustrating an example of the construction of a duplex elevator systems and a time chart illustrating the operation thereof respectively.

Next, a connector CN2 is provided in the bus of the host microcomputer 100, so that a maintenance/ debug tool of an analyzer or a second I/O transmission controller 2*b* in the case where the number of the floors are over 16 as shown in FIG. 41 can be connected thereto by outside attachment.

Therefore, in the case where the kind of an indicator in a specific floor is changed, or the number of the floors is increased by one, it is possible to easily correct, by means of a maintenance/debug tool, the contents of an EEPROM 103 in which the host side specification data or programs for making up terminal specification data have been stored.

Figure 3:
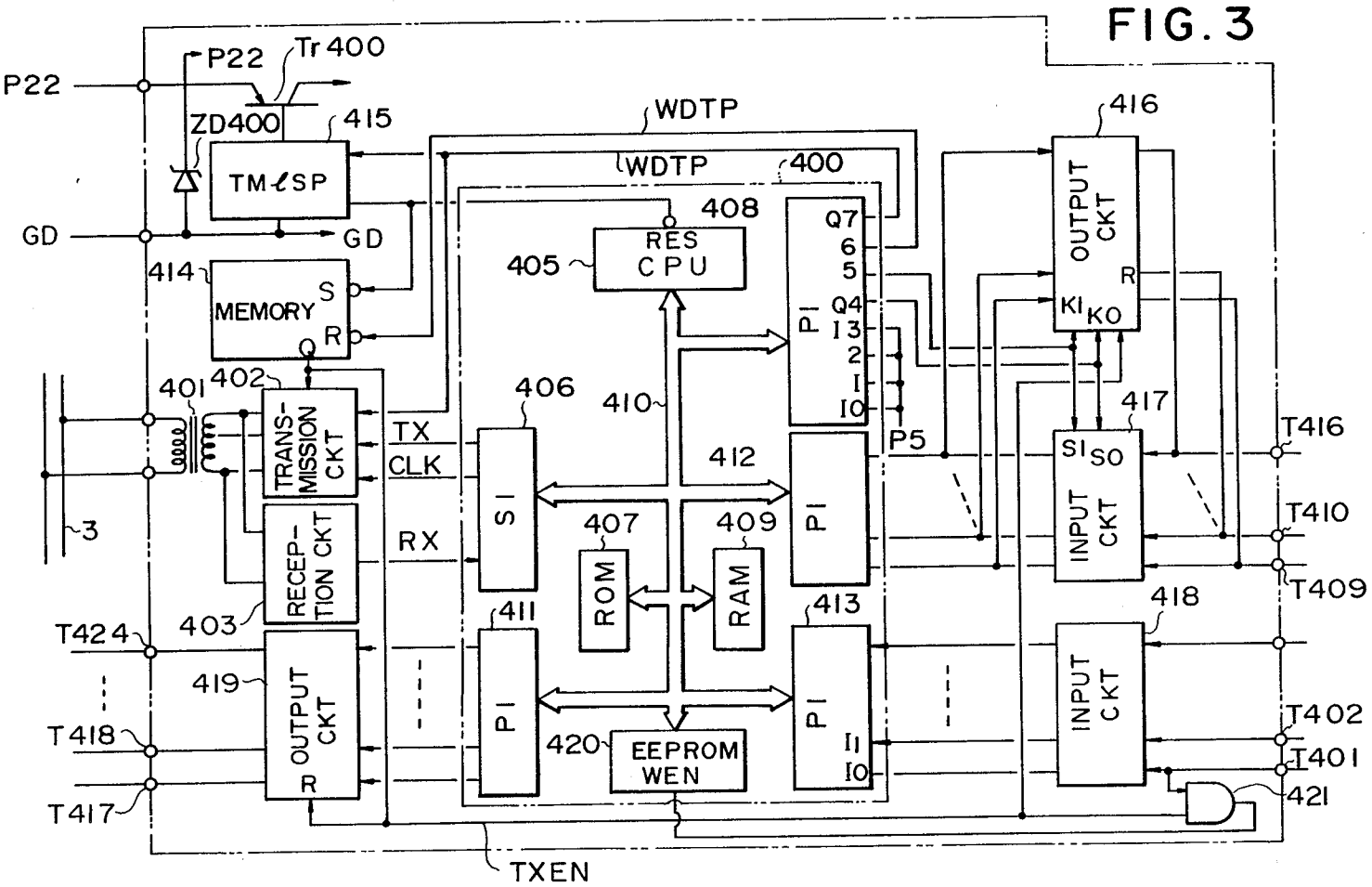
FIGS. 3 and 4 are diagrams illustrating different examples of the constructions of the input/ output terminal equipment.

In a prior art case, however, it has been necessary to design additional programs to a ROM 407 for a terminal station in the specific floor as shown in FIG. 3 so as to reproduce the ROM 407. This has been an extremely severe problem since it takes about a month and fair cost to make a masked ROM thereof.

Further, a watch dock timer (hereinafter abbreviated to "WDT") circuit 240 is provided for taking retry to a transmission control microcomputer in case of occurrence of abnormality in the I/O transmission controller 17, or for improving the safety of the whole system without affecting the transmission lines 3*a* and 3*b*.

The operation of the circuits will be now described. The CPU 207 normally supplies either Q5 or Q6 of a parallel interface (hereinafter abbreviated to "PI") 1 with a signal for selecting either the reception circuit 203*a* or 203*b* in accordance with a reception period of an externally applied signal. An AND gate IC 231 therefore outputs "0" normally, so that the reset through a reset input terminal R of a multi-vibrator IC 232 is not caused. On the other hand, a transmission permitting signal TXEN which is a signal from Q4 of the PI1 made into a pulse signal by a multi-vibrator IC 243 because of establishment of the output permitting conditions and a reset pulse signal supplied from the output Q7 of the output Pi for refreshing the WDT circuit 240 are being produced. Accordingly, the multi-vibrator IC 232 outputs "1" continuously in response to a pulse applied from a NOR gate IC 236 and supplies the output signal "1" continuously through a NAND gate IC 233 and a multi-vibrator IC 234 to the CPU 207 as an operation permitting signal RESPQ. Thus, the transmission control microcomputer 207 can continue its normal operation.

The output signal "1" of the NOR gate IC 236 and the multi-vibrator IC 234 is passed through a NAND gate IC 237, and applied through a NOR gate IC 238 to a reset terminal of a memory storage circuit IC 235 together with the transmission permitting signal pulse produced from A4 of the PI1.

Consequently, a signal "1" is supplied from an output terminal $\overline{Q}$ of the memory memorizing circuit IC 235 through a NOR gate IC 246 to AND gate ICs 221 and 222. In transmitting, a signal "1" is supplied from Q0 or Q1 of the PI2 to the AND gate ICs 221 and 222, so that it is possible to select the transmission circuit 202*a* or 202*b* so as to transmit the transmission data $\overline{TXD}$.

As has been described above, the WDT circuit 240 is constituted by the outputs Q5 and Q6 for selecting the reception circuit 203*a* or 203*b*, the output Q7 of the PI1 for resetting the WDT circuit 240, and the output Q4 of the PI1 for outputting the transmission permitting signal pulse. Now, in the case where the CPU 207 does not perform its normal operation because of abnormality in processing due to a noise, a voltage drop or specific data so that the signal of the Q4 or the Q7 of the PI1 does not change or the PI1 outputs signals from its Q5 and Q6 in the same timing erroneously, the multi-vibrator IC 234 outputs "0" to thereby reset the CPU 207, and at the same time the $\overline{Q}$ output of the memory storage circuit IC 235 also becomes "0" to thereby reset transmission so as not to affect any other terminal equipment.

Further, even if the CPU 207 repeats abnormal transmission because of a noise or the like, the pulse supplied from the multi-vibrator IC 243 is cut off so that a backup circuit for cutting off output automatically by means of the AND gate IC 246 and so on is made valid.

When the transmission has thus been cut off, the reception circuits 203*a* and 203*b* are being actuated, and data from the host are applied to those reception circuits 203*a* and 203*b*. Judging from the address of the data, the reception circuits 203*a* and 203*b* ignore the data if the data have no concern therewith. Having no signal transmitted any terminal or the like, the host considers that the terminal or the like is in a down state, and at a predetermined timing (at the time of stopping of a cage) or every interval after completion of communication with other terminals, the host asks the terminal whether recovery has been made or not. Then, having transmission from the terminal, the host judges that the recovery has been made in the terminal and transmits necessary data to the terminal thereafter.

In short, when a trouble is caused, the network transmission controller 17 performs such a processing action as follows. That is, although understanding all the conditions other than the produced trouble, the controller 17 does not act together other means and joins the network when the trouble could be eliminated. At this time , although the network transmission controller 17 is still connected to the transmission lines 3*a* and 3*b*, the network transmission controller 17 does not communicate with the other means.

That is, the network transmission controller 17 is not provided with any means for cutting off the connection with the transmission lines 3*a* and 3*b* or any means for switching the circuit line. The configuration of the network transmission controller 17 is therefore simple correspondingly.

Moreover, in this embodiment, the elevator control microcomputer 100, the I/O transmission controller 2 and the network transmission controller 17 are integrally packaged in a sheet of a printed plate PI, so as to improve the noise resistance thereof.

Figure 29:
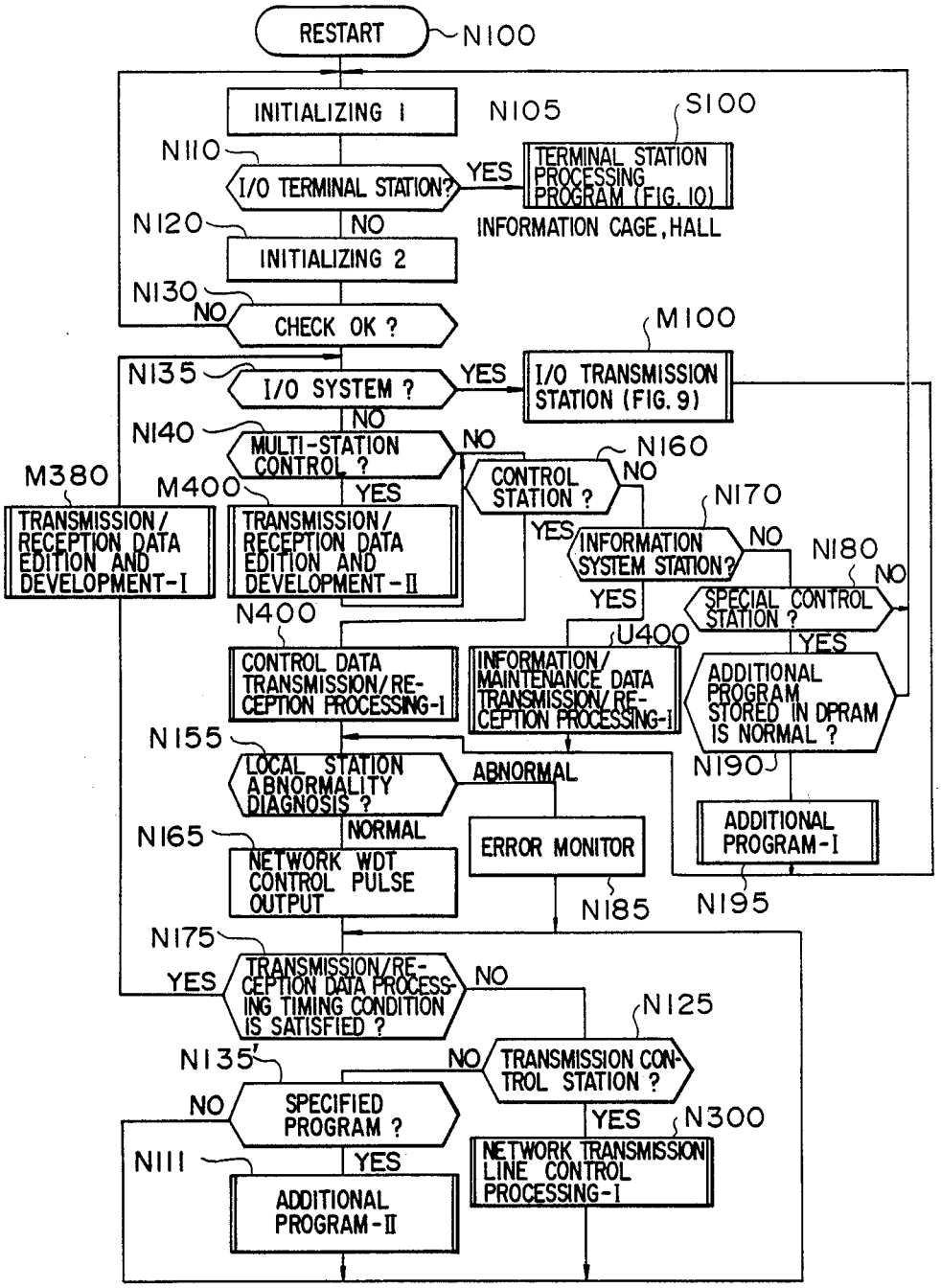
FIGS. 29 to 39 are flow charts illustrating the operation of a network-transmission controller.
Figure 31:
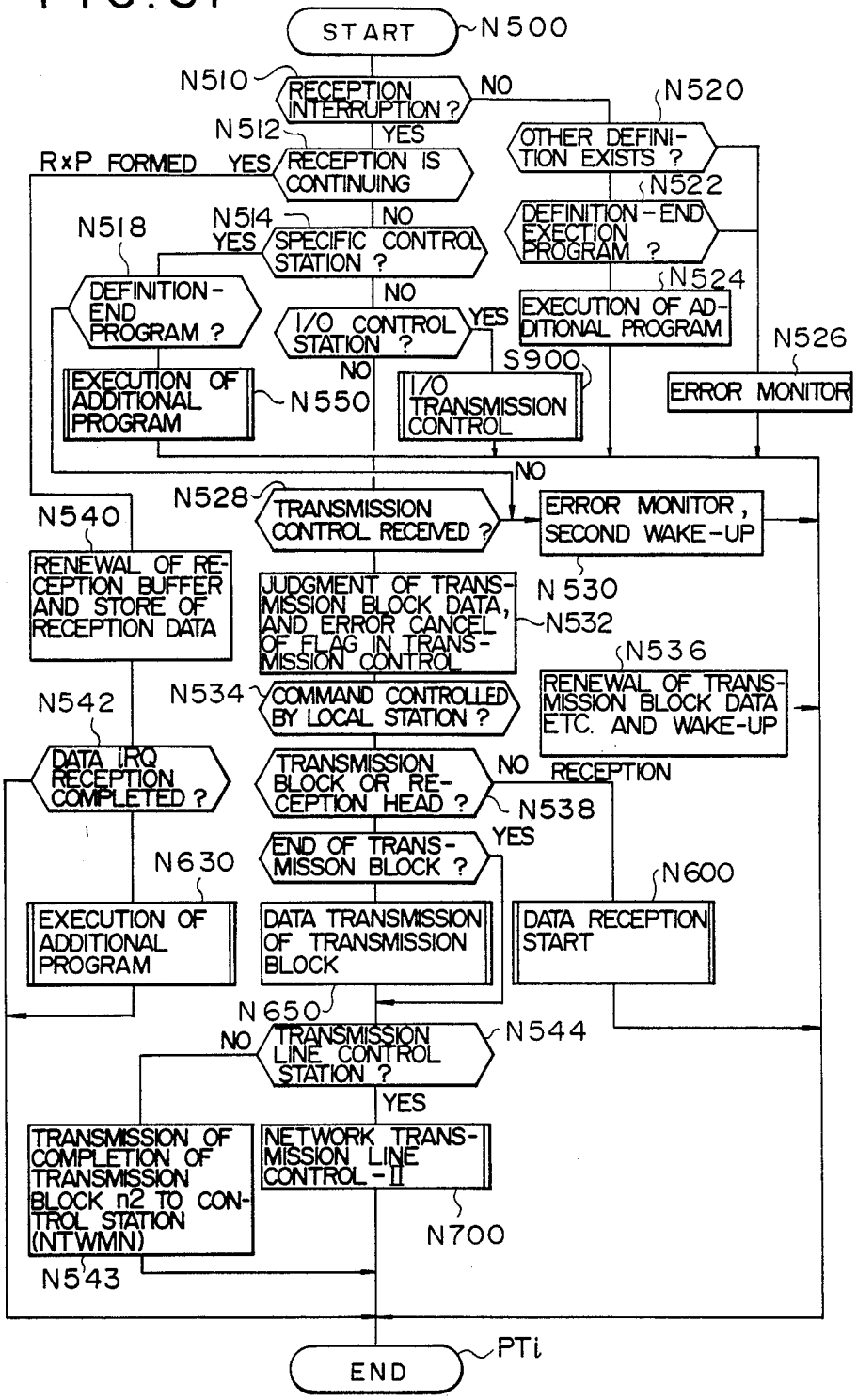

Further, the transmission control microcomputer 200 receives $0 as a terminal hardware index number (HKNO) through inputs I0 to I3 of the Pi1, judges a transmission station as shown in Table 2, and selects and uses various programs stored in the built-in masked ROM 209, such as a restart program shown in FIG. 29, an interruption or information data transmission program shown in FIG. 31, and so on. Particularly, the initializing processing and initial transmission specification depend very much on the index number (HKNO) shown in Table 2.

Detailed examples of the WDT circuit will be described with reference to FIGS. 24A, 24B and 25.

TABLE 2

| Terminal Hardware Index No. (HKNO) | Terminal Hardware Specification |
|---|---|
| $0 | Transmission station connected to the host controller. One DPRAM (FIG. 1). I/O for every elevator controller. |
| $1 | Transmission station connected to the host controller. Three DPRAMs. Network of a group-control controller |
| $2 | Transmission station connected to the information controller. Two DPRAMs. UCB, MAS |
| . | |
| . | |
| . | |
| $D | Large-size I/O terminal equipment. |
| $E | Middle-size I/O terminal equipment used generally. |
| $F | Small-size I/O terminal equipment used generally. |

FIG. 2 is a schematic diagram showing the whole configuration of an embodiment of the elevator control system according to the present invention, the system being of the type having a service area of eight floors aboveground plus one floor underground, that is, from the 1st basement B1F to the 8th floor 8F, (though the floors 3F to 8F are not shown in the drawing). In FIG. 2, an elevator controller (host controller) 1 is connected to an I/O transmission controller 2 and further connected, through the I/O transmission controller 2, to input/output terminal equipments 4*a*, 4*b*, 19*a*, 19*b*, 6, 13 (hereinafter simply referred to as "terminals") by buses 3*a* and 3*b* (common serial data transmission lines). For example, the terminals are installed in operation panels provided in respective floors or stories and in a cage.

The I/O transmission controller 2 performs polling of the terminals 4*a*, 4*b*, 19*a*, 19*b*, 6, 13 to exchange information peculiar to every floor, such as response control and the like, with every call button.

Figure 19:
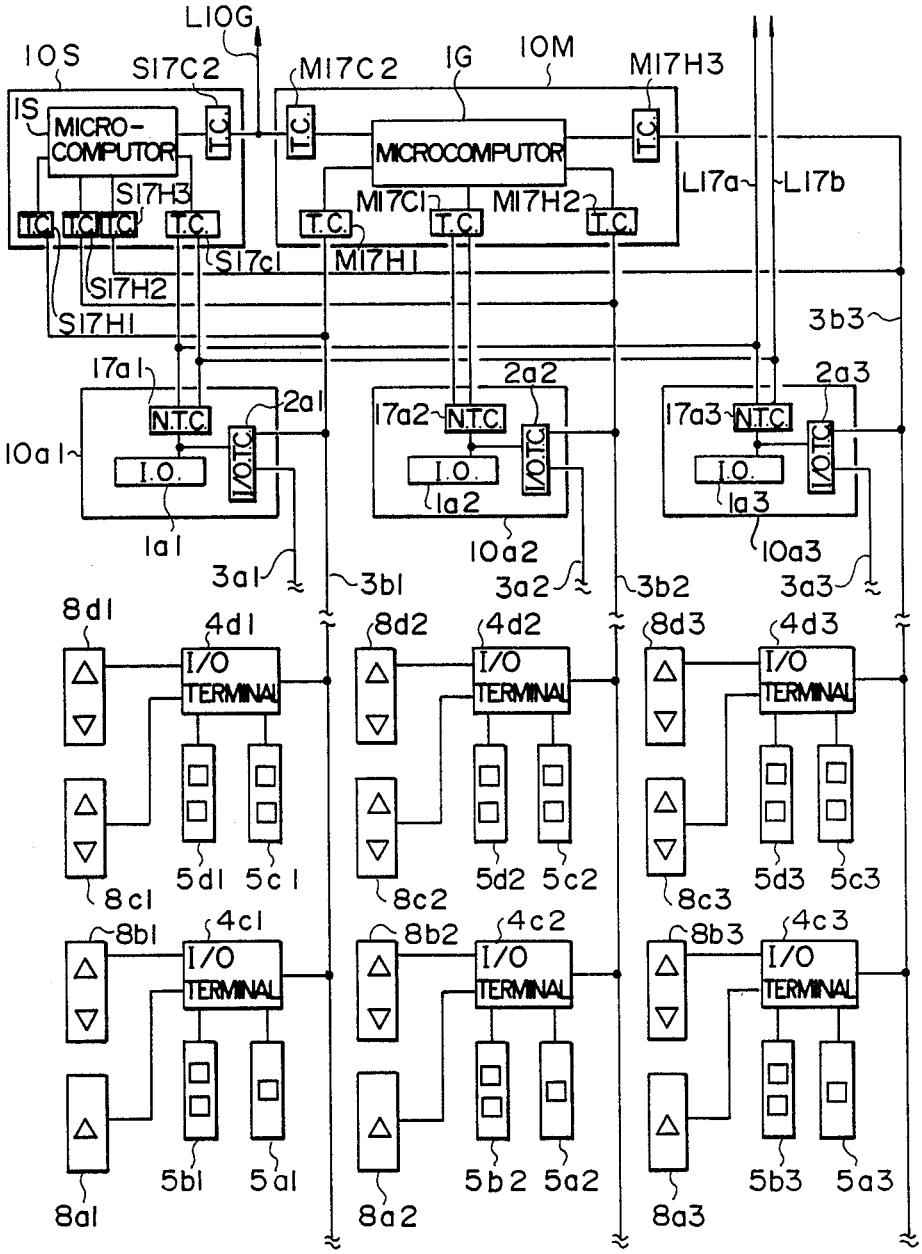
FIG. 19 is a diagram illustrating the construction of a group-control elevator system to which the present invention is applied.

The terminals 4*a*, 4*b* and 19*a* serving as floor stations are connected to hall operation panels 5*a*, 5*b* and 5*c*, respectively. When the operation conditions of buttons, such as call buttons and the like, and switching input signals are detected and then the results of detection are polled, the terminals 4*a*, 4*b* and 19*a* serially transmit data to the I/O transmission controller 2 through the buses 3*a* and 3*b* and further transmit information to a host controller, such as the elevator controller 1 or an elevator group-control controller 1G as shown in FIG. 19, by a dual port RAM as shown in detail in FIG. 1.

The host controller 1 performs registration processing for cage-call and hall-call, information transmission controlling, service state guidance and the like, so that the host controller 1 transmits information to the terminals 4*a*, 4*b* and 19*a* in a course reverse to the aforementioned course to thereby issue a transmit request for answer lamp lighting control of the hall operation panels 5a, 5b and 5c, a cryptographic specification, a button response specification, and the like.

However, if the answer lamp lighting control method by the host controller 1 is used merely, the lighting of answer lamps lags by about 0.1 second as will be described later with reference to FIGS. 6A and 6B, so that a malaise is given to the user. In addition, call-cancellation and specific call-generation by means of Morse code or by means of specific button operation (of pushing two buttons at once or of pushing one button over 1 second) can not go on smoothly.

Therefore, in this embodiment, terminal specification data are transmitted from the host controller to every input/output terminal equipment in response to a corresponding call button having the aforementioned service form, so that local control for operating response control (for example, flicker lighting output of a corresponding answer lamp) for a predetermined period in response to the call button input in the terminal side is carried out to solve the problem, such as response lag, malfunction and the like, caused by diversification of interfaces.

Further, in this embodiment, a parking switch (PAK) 16 and an indicator 7a having LEDs as a light source and including an information indicator D7a for indicating "Full" are set up at a portion above the elevator landing place of the first basement B1F. These are connected to the B1F input/output terminal equipment 4a so that the input/output control thereof is carried out by the terminal 4a.

The first floor serves as a lobby to be used by a lot of people. Therefore, an operation panel 5b (hereinafter referred to as "port type indicator") for directly registering designation floors and for indicating the cage position of the elevator, a speaker 15 for voice information, and information devices DIF1a and DIF1b for service information are provided in the landing place of the first floor. The service information includes, for example, "GOOD MORNING" and "BARGAIN SAIL OF SKI GOODS IN 6F". In the service information, stationary display, flicker display and moving display can be suitably used in synchronism with the voice information. A voice reproduction circuit for the voice information is installed in the information terminal equipment 19a shown in detail in FIGS. 44A and 44B.

Figure 22:
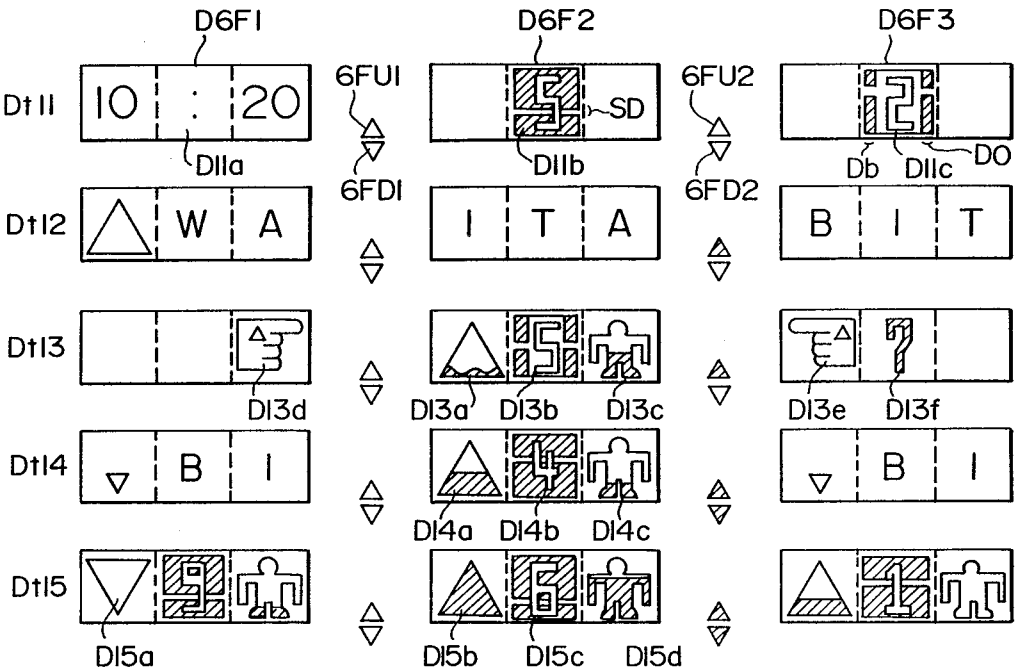
FIGS. 22 and 23 are diagrams illustrating examples of indication services of an indicator provided above a landing-place of an elevator.
Figure 23:
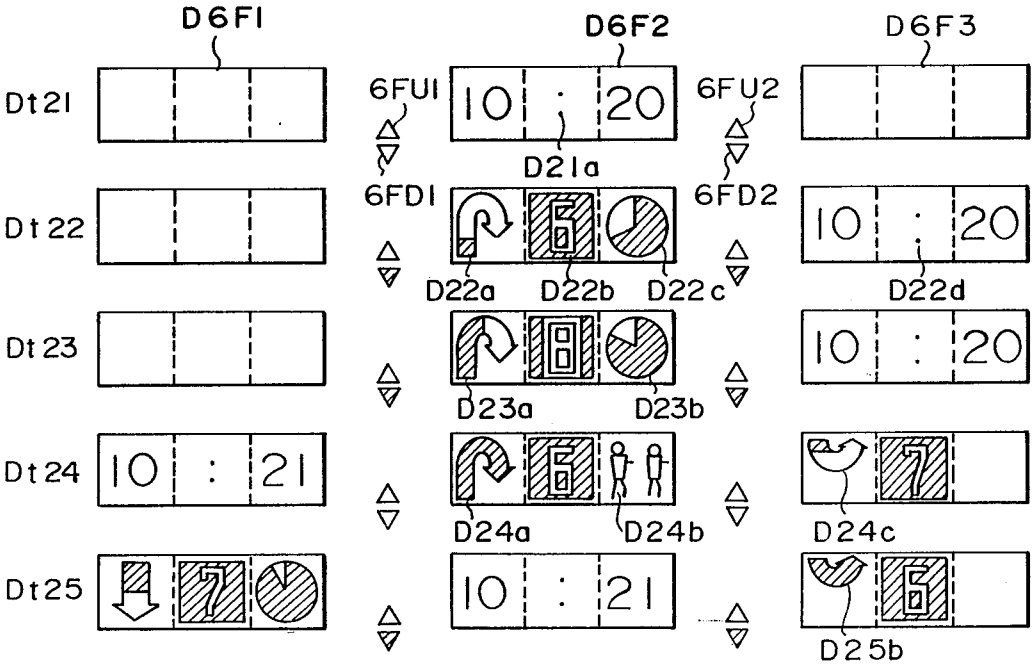

Further, the information terminal equipment 19a serves as an interface between each display panel (formed of a three-color LED panel or a color liquid-crystal panel) DIF1a for displaying service information for every elevator as shown in FIGS. 22 and 23 and a corresponding camera for detecting people waiting for every elevator.

Figure 5B:
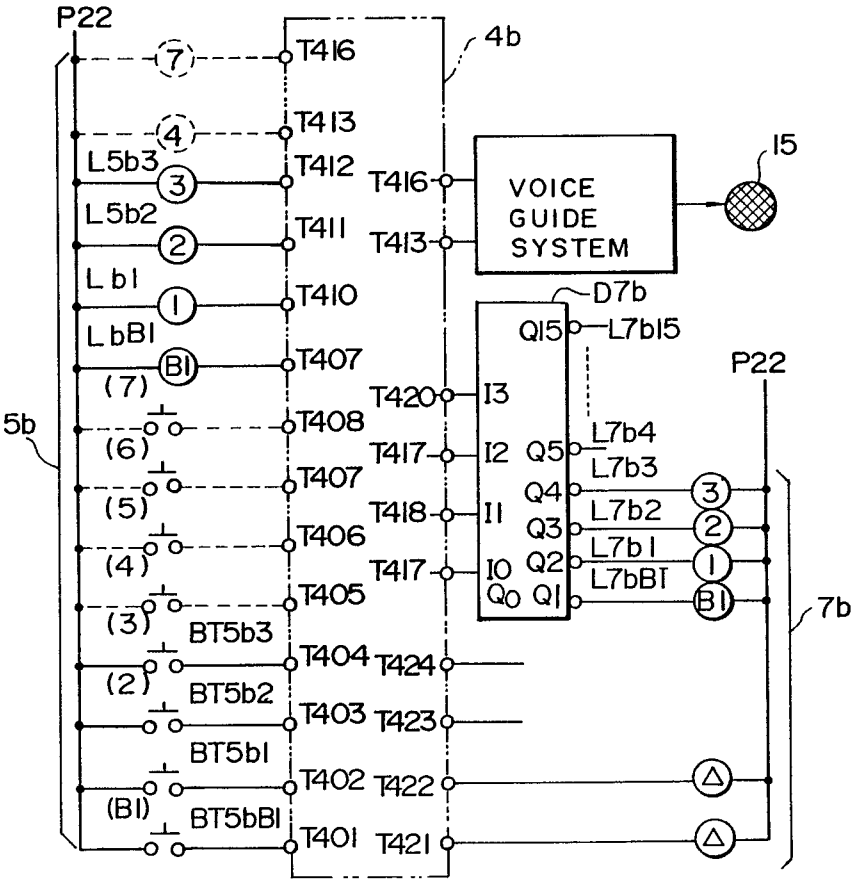
FIGS. 5A and 5B are connection diagrams illustrating examples of use of the input/output terminal equipment at a hall side.
Figure 5A:
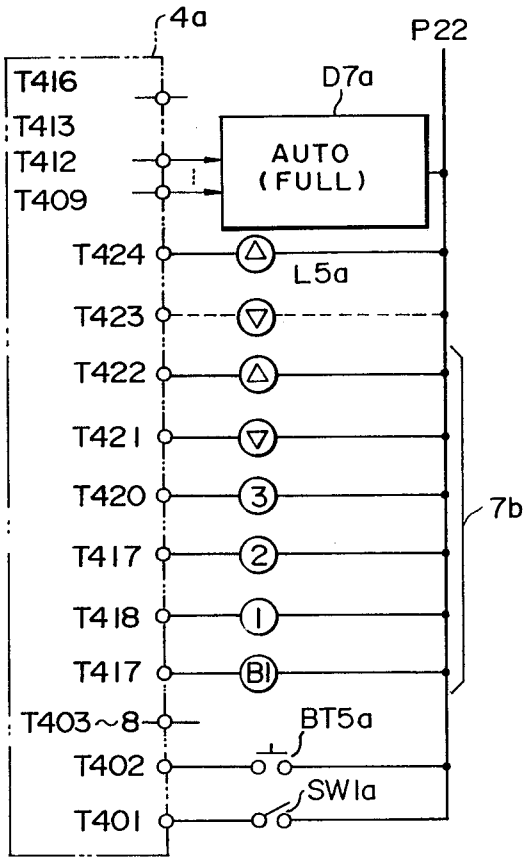

On the other hand, the second floor serves as a general floor in which a cage position indicator 8a is used to indicate merely the position and service direction of the cage. Therefore, though a pair of input/output terminals are used for every floor (for example, B1F as shown in FIG. 5A or 1F as shown in FIG. 5B), a pair of input/output terminals may be used for every two floors as shown in FIG. 19. In particular, in the case of a general hall-call registration device connected to the elevator group-control controller, a pair of input/output terminals may be generally used for every several (two to six) floors because the number of signal lines is small.

For example, the transmission lines between the master station 2 and the intra-cage terminals 6, 13 and 19b are connected through buses 3b1 and 3b2 with tail code to be used as a full duplex type signal transmission to thereby attain an improvement in safety.

For the purpose of preventing erroneous operation caused by reflection or the like, the buses 3b1 and 3b2 are separated from the bus 3a reaching the landing place. To attain an improvement in reliability, a pulse transformer 201, a transmission circuit 202 and a reception circuit 203 are provided separately as shown in FIG. 1.

Figure 4:
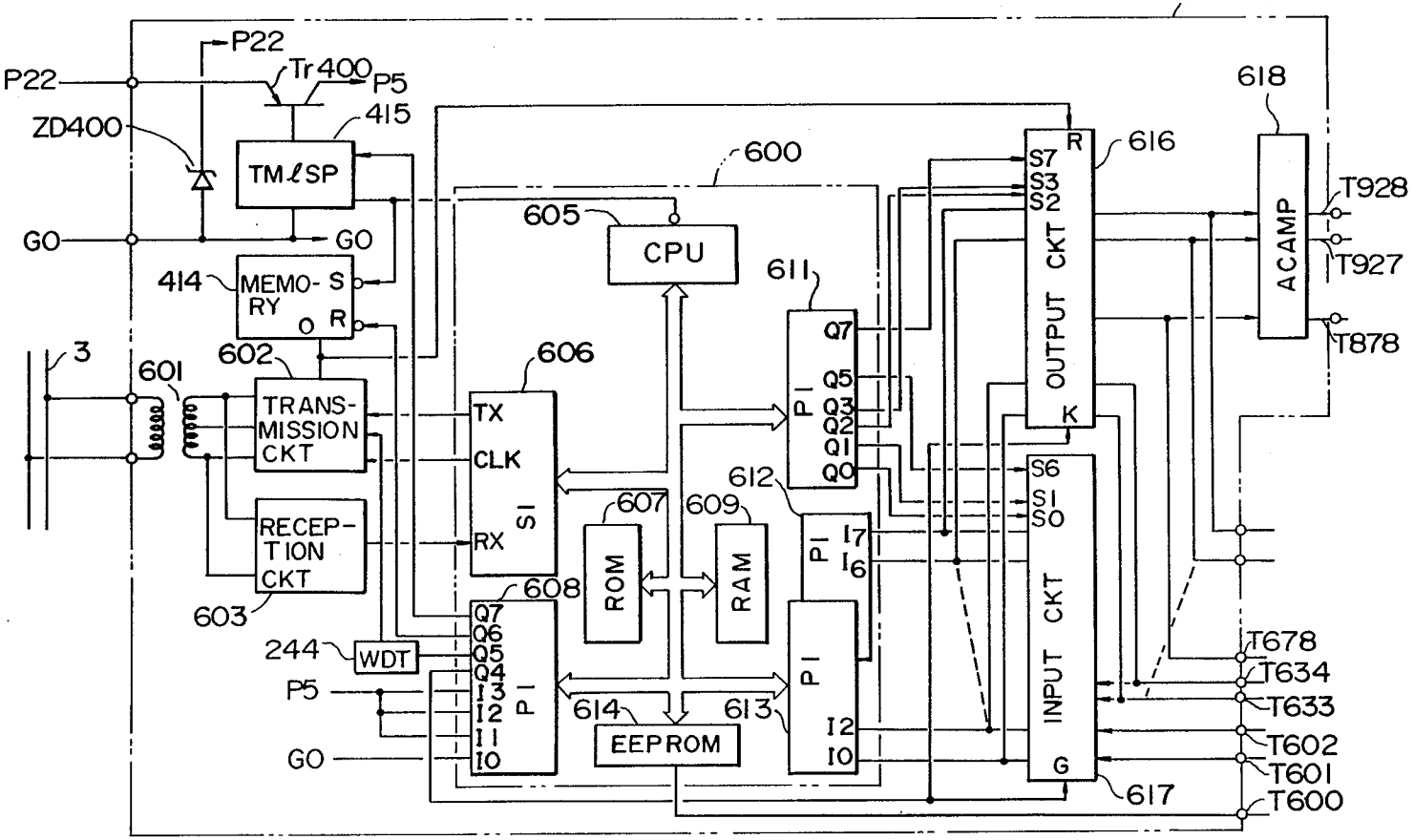

The intra-cage terminal 6 is formed of a middle-size and multi-input/output terminal equipment 6 as shown in FIG. 4. Signals, such as a "Cage-Call" signal, a "Close" signal, an "Auto" signal, a "Manual" signal, a "Normal" signal, a cage weight detection signal, an arrival signal, and the like, are fetched by the intra-cage terminal 6. Further, the information terminal equipment 19b operates a service information display panel D10 capable of displaying service information in an inner upper portion of the cage and operates an area sensor 14 for detecting the number of passengers being carried. Further, the information terminal equipment 19b operates an information device D11 using EL, LEDs and the like as a light source.

On the other hand, the on-cage terminal 13 is so constructed that a large number of control parameters for transmitting an opening/closing control instruction L4 and a brake signal L2 to the door actuator 11 can be received from the host controller 1, through the on-cage terminal 13 has less interfaces for external equipments than those of the middle-size terminal 6.

The terminal 13 fetches an open instruction, an output signal of the passenger number detector 12 formed of a photoelectric device or an ultrasonic sensor, and a door opening/closing speed and position signal through lines L1, L5, and L3, respectively. In short, the terminal 13 serves as a multifunctional terminal for performing both the input/output circuit control and door opening/closing control. As this result, cost required for data transmission can be reduced, so that factors such as speed, a current and the like can be determined by use of terminal specification data with no use of dip switches or trimmers. Accordingly, there arise the following advantages, compared with the case where a door opening/closing controller is provided separately:

(1) Data adjusted on the actual location can be unidimensionally controlled by the host controller 1 (so that re-adjustment is not required even in the case of exchange of terminals);

(2) A door opening/closing control instruction can be given to the door actuator 12 according to circumstances on the basis of a high degree of judgment by the host controller; and the like.

As shown in FIG. 19, every host controller (elevator controller) 1 is connected to operation-system and intelligence-system group-control controllers 10M and 10S (provided with a plurality of host controllers 1a1 to 1a3 or a group-control controller 1G and having data specification corresponding to the place where the elevator system is supplied), a maintenance device 10H, a supervisory panel, a remote supervision system terminal equipment and a multifunctional interface terminal 10U (hereinafter abbreviated to "U.C.B.") used for information input/registration control system and the like, by the bus-type transmission line L7 through a network transmission controller 17. Thus, a group control system can be installed easily.

By use of the input/output terminal equipments 4, 6, 13 and 19 with the bus-type transmission line as described above, newly developed hardware is not required though the construction of the elevator control system, that is, in particular, the construction thereof in operation and information devices, may be changed. Accordingly, a system can be constructed in combination with standardized, reliable and low-cost hardware.

Furthermore, picture data obtained by an area sensor 14 or an ITV camera can be transmitted through the input/output terminal equipment 19. At the same time, the picture data can be transmitted efficiently while importance thereof is judged. In addition, the same transmission line as the I/O data transmission line *3a* can be used for transmission of the picture data.

The picture data can be used for monitoring the conditions in use of the elevators to detect the intra-cage crowdedness of the respective elevators and the number of waiting persons in the hall to thereby attain the double purpose of optimum call-assignment control and crime prevention in the building. Accordingly, both the safety of users and service for users can be improved.

Figure 10:
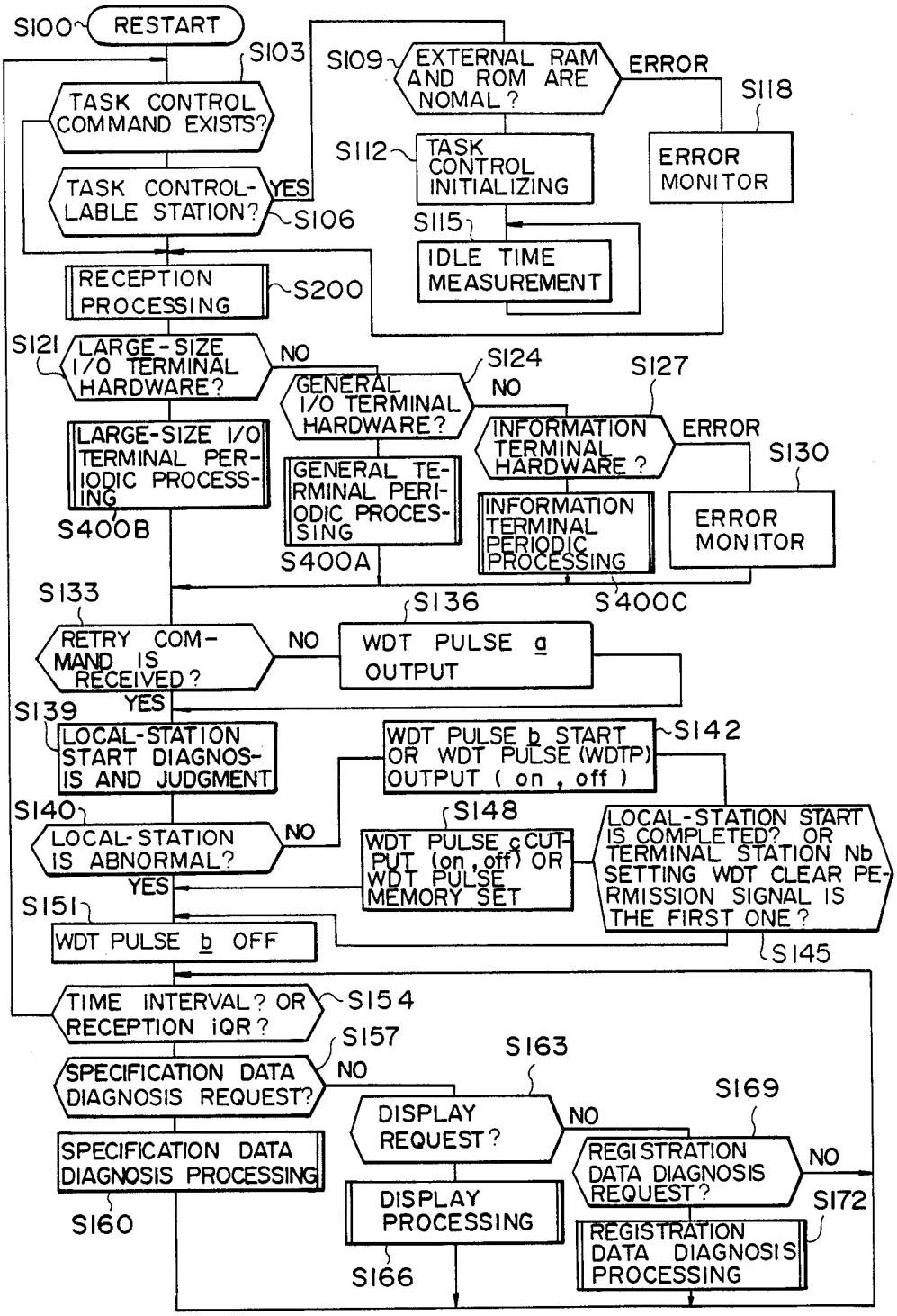
Figure 11:
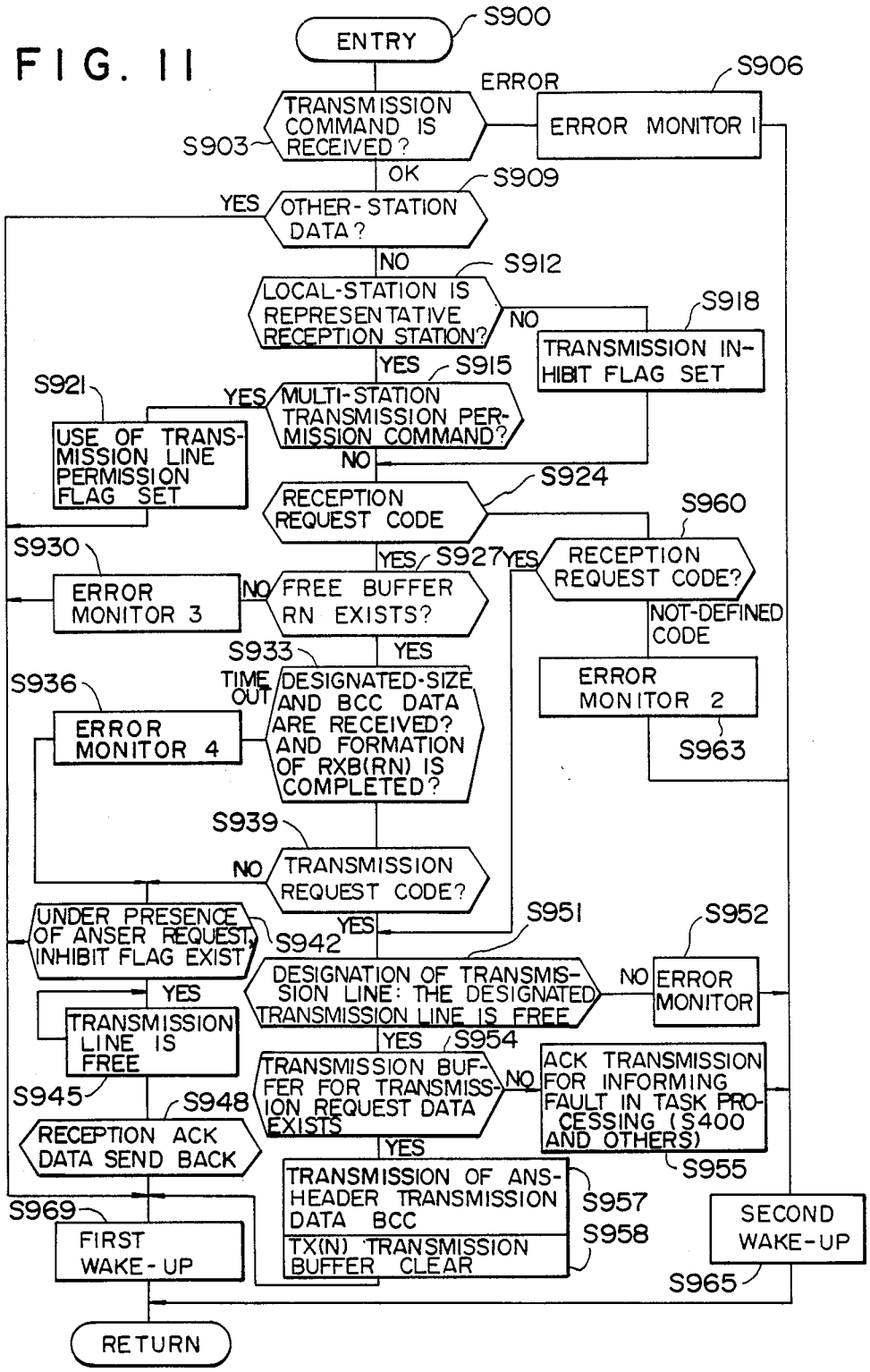
Figure 39:
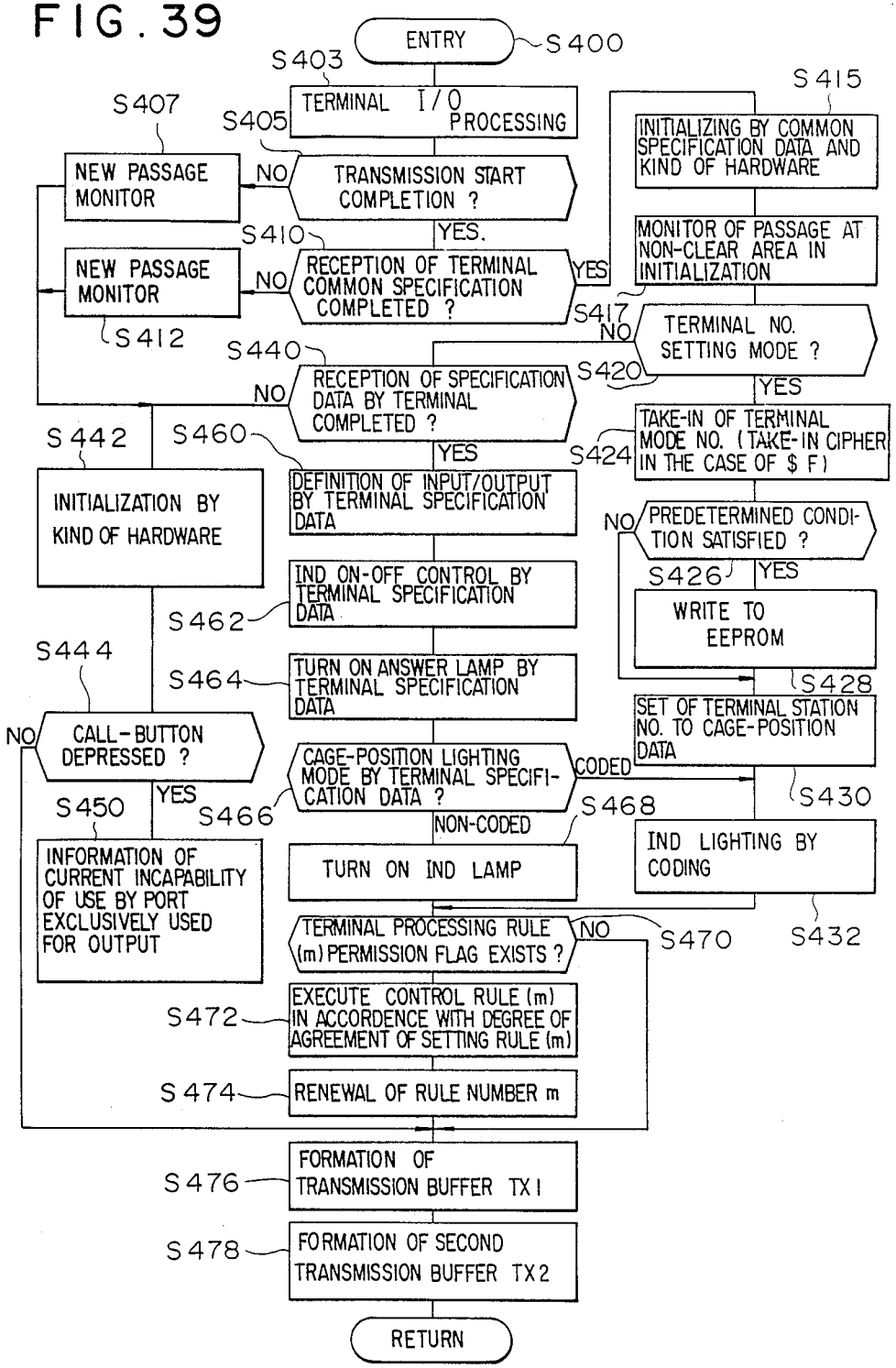

FIG. 3 is a diagram of hardware construction of a small-size input/output terminal. An example of wiring in the terminal in the first basement B1F is shown in FIG. 5A. An example of wiring in the terminal in the first floor 1F is shown in FIG. 5B. As shown in FIGS. 10, 29 and 39, terminal processing, such as input/ output control by means of a parallel interface (hereinafter abbreviated to "PI"), is repeated (the step N175 in FIG. 29) in a period of Ts (about 10 ms) by a CPU 405 depicted in FIG. 3. On the other hand, data exchange control is carried out on the basis of the judgment that the hardware discriminating signal is $F, the judgment being obtained by interrupt processing (as shown in FIG. 31) started by an interrupt signal generated when data reception is finished after wake-up pulses by means of SI (serial interface) 406. In short, data exchange is carried out as shown in FIG. 11.

To improve generality and reliability, the following techniques are given to the embodiment of FIG. 3.

(1) The terminal equipment of FIG. 3 has: input-only terminals T401 to T408 controlled by the PI 413 and the input circuit 418; output-only terminals T417 to T424 controlled by the PI 414 and the output circuit 419; and input/output switching terminals T409 to T416 controlled by the PIs 412 and 408 and the input and output circuits 417 and 416 to thereby utilize the number of input/output terminals effectively.

This is among important techniques in the case where almost of the general integrated circuit of the terminal equipment 4 including a power transistor Tr400 generating heat is prepared in the form of a custom LSI or hybrid IC, because the size and cost thereof are absolutely determined by the number of terminals rather than the size of internal logic.

According to the terminal specification data transmission system of the present invention, when the input-/output terminals T409 to T416 as shown in FIG. 5B are used as output terminals, both the output signals Q4 and Q5 of the PI become "0" to disable the input circuit 417 from operating its eight terminals and, on the contrary, to enable the output circuit 416 to operate its eight terminals to perform loading as shown in FIGS. 5A and 5B on the basis of signals obtained from the PI 412. Although the dot line of FIG. 5B shows an example of connection of port-type indicators 7 in the case of 8 floors, it is a matter of course that the invention is not limited to the specific embodiment. For example, in the case of 12 floors, the input/output terminals T409 to T412 may be used as input terminals by switching the terminal specification to the input side (the output Q4 of the PI 408 becoming "1") while the output terminals T417 to T420 and the input/output terminals T413 to T416 are used in the output side, to thereby perform driving control of every LED indicator which serves as a designation-floor-call answer lamp (continuous light) and also as a cage-position indication lamp (on-and-off light).

Consequently, in accordance with this embodiment, the terminal specification can be changed by the EEPROM 103 of the host controller as shown in FIG. 1 without the ROMs 407 and 607, thereby attaining an improvement in design, execution and maintenance.

Figure 25:
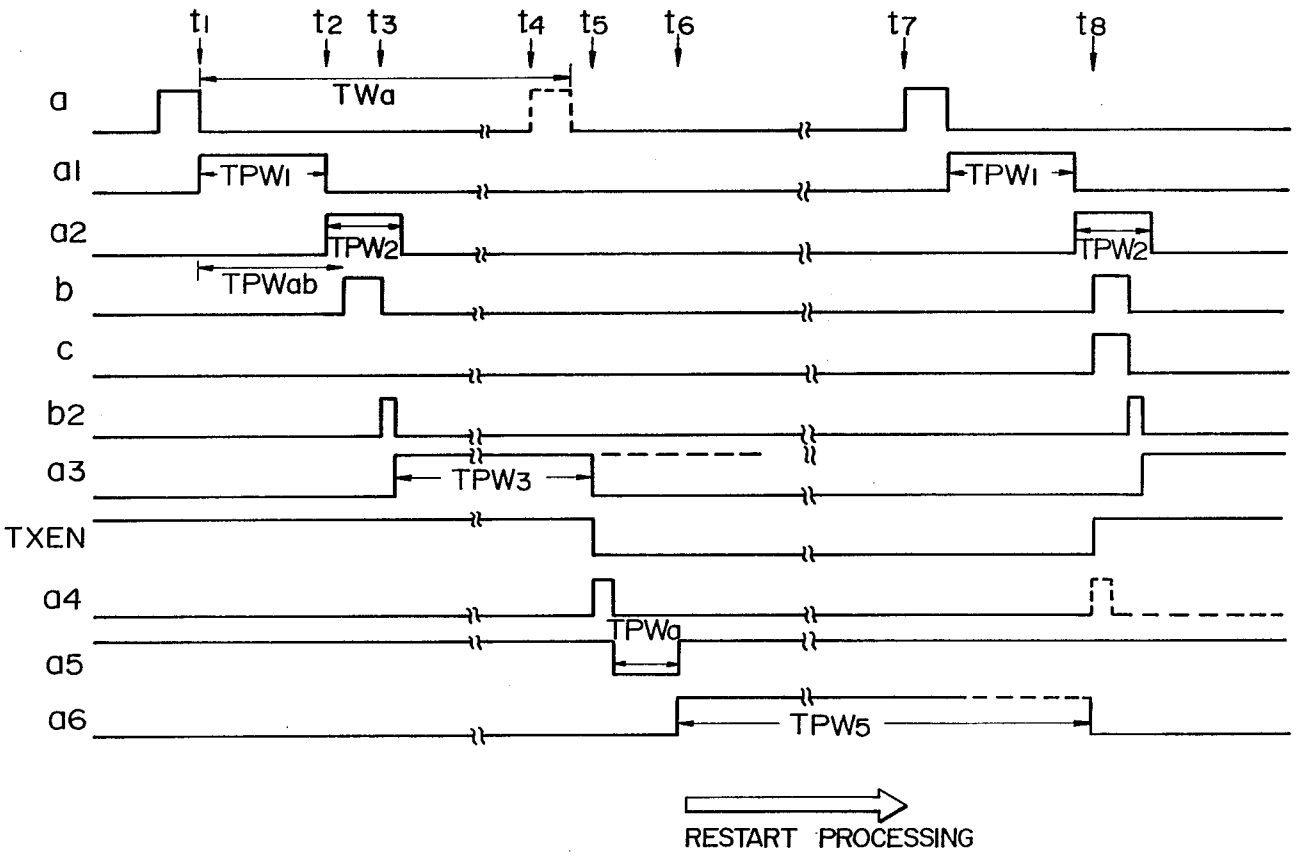

(2) To monitor the motion of the CPUs 405 and 605, there is provided an electric source circuit 415 having a function of detecting the missing of the pulse WDTP (which corresponds to the pulse a or b in FIG. 25) generated for every period TWA (as shown in FIG. 25) in the step S136 or in the step S142 in FIG. 10. When the electric source circuit 415 operates once, the electric source circuit 415 serves to reset the CPU 405 to make an attempt at re-starting and also serves to store this fact in the storage circuit 414 and suppress the output circuit 416 and the transmission circuit 402 to thereby prevent careless motion. Accordingly, execution of unreliable and safeless door opening/closing operation and suspicious information can be prevented so that the users do not have unexpected misunderstanding. In addition, the electric source circuit 415 serves to keep transmission control of the other-floor terminal equipment in a normal state.

Figure 8:
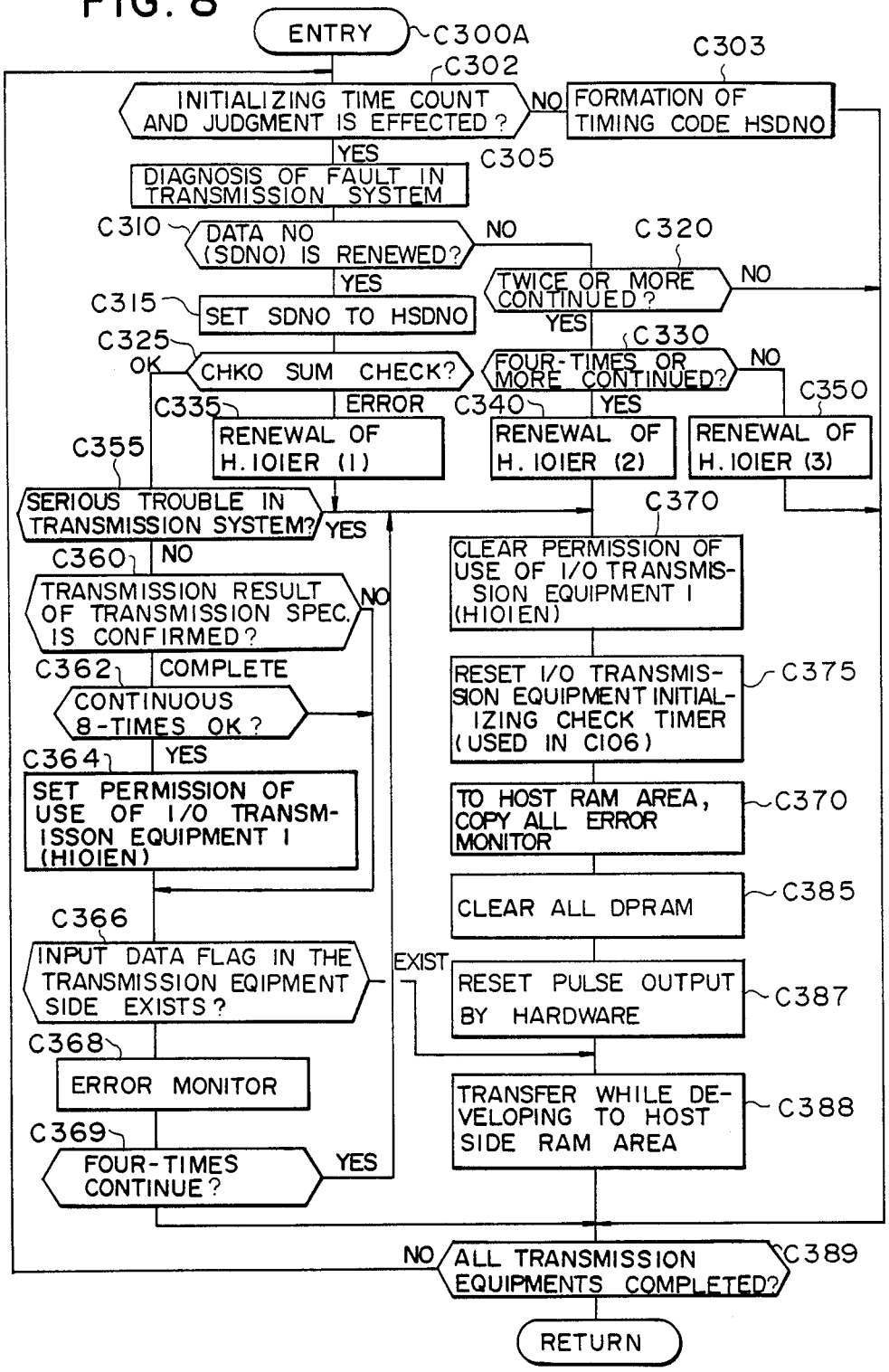

In general, the nearer device to the end of the feeder line of the power supply P22 more possibly rises temporally operation errors when an instantaneous power failure or a temporally voltage reduction occurs. In this embodiment, the host controller 1 diagnoses abnormality of terminal stations in the step C305 as shown in FIG. 8, so that the header of INIT is sent to a corresponding terminal station when the elevator is stopped and the door is open. Through the steps S139, S140, S142, S145, S148 and S151 in FIG. 10, a pulse WDTR for resetting the storage circuit 414 with timing t8 as shown in FIG. 25 is sent out from the terminal Q6 of the PI to release the aforementioned suppression to thereby return the abnormal state to a normal state.

Accordingly, not only operation errors of terminal stations caused by abnormality can be suppressed but also the system can recover itself.

(3) The terminal station number can be prepared on the basis of a cryptographic input by use of $I_0$ or $I_1$ of the PI in the step S424 in FIg. 39. Because the signal of the button input terminal (B1F) T401 in FIG. 1 is "1", the output of the AND gate 421 becomes "1". Accordingly, the terminal station number can be written in the EEPROM 420 in the step S428.

Before the terminal station number is prepared, a common specification (by the hardware index HKNO) must be received once through the transmission line 3 and then a terminal station number setting mode instruction must be received from the host controller (in the step S420).

Figures 24A, 24B:
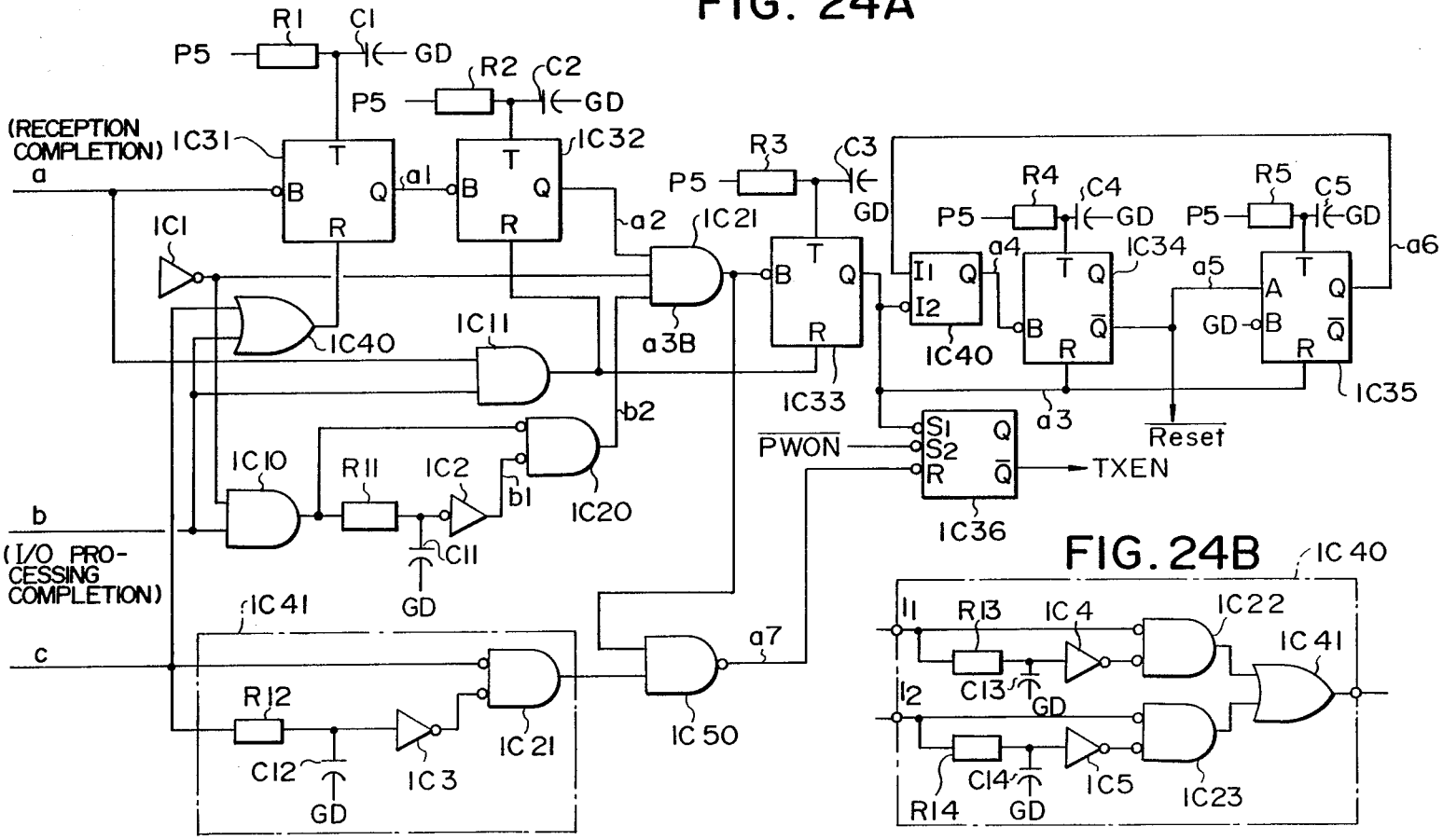
FIGS. 24A, 24B and 25 are diagrams illustrating examples of the construction of a transmission/reception circuit used in the input/output terminal equipment and a time chart illustrating the operation thereof.

In the third embodiment of the WDT circuit as shown in FIGS. 24A and 24B, the WDT operative memory must be cleared up on the basis of the judgment in the step S145 in FIG. 10 and the WDT clear pulse C output (in the step S148) to turn the transmission-enabled signal TXEN to "1".

Or a judgment is made in the step S426 as to whether an operation (for example, a cryptographic operation (the step S424) comprising the steps of: pushing the button for a predetermined period of from 5 to 10 seconds; repeating switching on and off three times; and pushing the button for 5 seconds) in a predetermined mode in which both of or either one of the input signals $I_0$ and $I_1$ is defined by common specification data is terminated or not.

FIG. 4 is a diagram of hardware construction of the middle-size input/output terminal equipment 6 used in the inside of the cage. The CPU 605 is provided with the same members as shown in FIG. 3, that is, a ROM 607, a RAM 609, and EEPROM 614, PIs 608, 611, 612, 613 and an SI 608. As this result, the microcomputer portion 600 can be formed so as to be equal both in software (data of the ROM 407) and in hardware to the microcomputer portion 400 in the terminal equipment as shown in FIG. 3. This is one of large practical effects obtained by use of the control system of the present invention in which terminal specification data can be transmitted from the host controller. In the case where a floor equipped with an eight-floor port type indicator 7*a*, the voice information system and the like as used in the first floor of FIG. 2, the absolute number of input-/output terminals will be in short supply if the size of the terminal equipment is small.

However, according to this embodiment, the elevator control system can be organized or reorganized so suitably that a middle-size terminal equipment can be employed in the aforementioned floor. If the middle-size terminal equipment is used, the specification can be changed easily by selecting any one of the input and output circuits by the output Q4 of the PI 608 through block selection by the input/output circuit PI 611 (in the case of "1", the input circuit is used).

Other techniques are as follows.

(1) A transmission-permission signal is given for a predetermined time in the same manner as the one-shot circuit 243 of FIG. 1.

(2) The input-only terminals correspond to 32 points of from I/O address No. 1 to No. 32. The output-only terminals correspond to 32 points of from I/O address No. 97 to No. 128. The remaining, middle 64 points can be selected for every eight points alternately between input and output. (When the signal K is "0" in an initial state, an output-group-permission signal is stored in the output circuit 616).

These input/output signals are commonly transmitted from the terminals T632 to T697. Accordingly, when the source voltage supplied to the output circuit 616 is reduced or when a noise is mixed into the output circuit 616, the storage of the output circuit 616 becomes unstable. If the output circuit fails to store the output-group-permission signal, a signal fetched by the corresponding pin becomes abnormal. To eliminate the defect more or less, irrationality (for example, the UP-DOWN buttons always show "1" or checker signals being always "1" or "0" change) is diagnosed as a part of processing based on intelligence data (transmitted from the host controller) in the steps S470 to S474 in FIG. 39. This is judged in the step S140 in FIG. 10 to make a retry for initialization.

(3) The 50 points of from output No. 78 to No. 128 are provided with alternating-current signal drivers for driving the load of lamps (for example, A.C. 24V, 5W).

If such middle-size terminal equipments are used, designation-floor-call registration and answer lamp lighting control of 64 floors can be made in the case where port-type indicators are merely set up in all of the floors. In the case where the number of floors is more than 64, a pair of middle-size input/ output terminal equipments can be set up in every floor. The reason is that the function separating method using middle-size terminal equipments is superior, in the point of view of extension, to the method of developing a large-size input/output terminal equipment. In addition, it is assumed that the method using middle-size terminal equipments is better in the point of view of recovery of development costs.

However, even if all of the 64 floors require port-type indicators, I/O transmission controllers (hereinafter referred to as "master stations") must be increased by seven so as to be provided at intervals of 8 or 9 floors for the purpose of allotting a portion of the I/O transmission bus to each through the connector CN2 as shown in FIG. 1 so that each has charge of 16 or 18 terminal stations.

Figure 12:
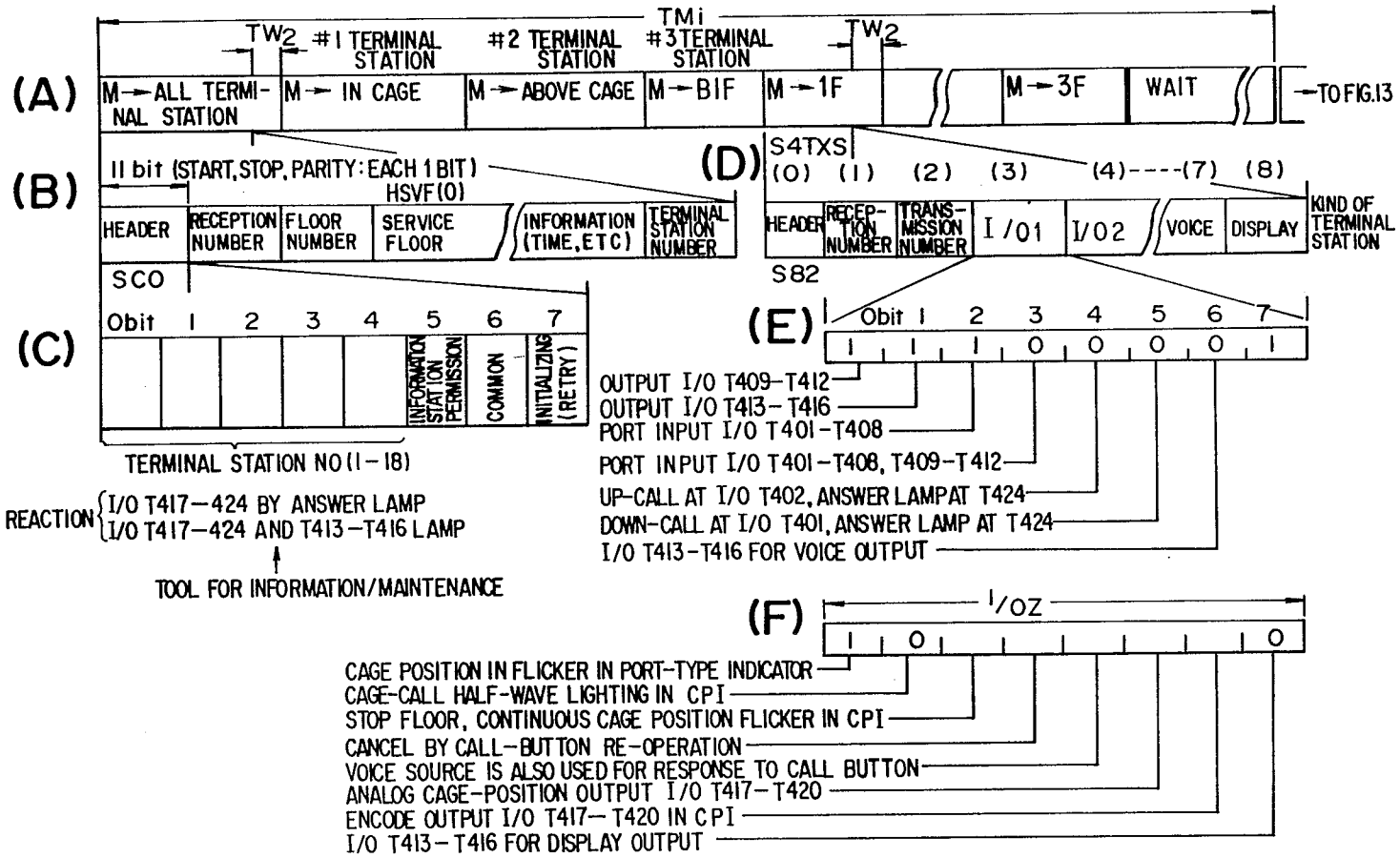
FIGS. 12 and 13 are time charts illustrating data delivery between the I/O transmission controller and the input/output terminal equipment.

In due consideration of applications, a part thereof is shown in FIGS. 12(*e*) and 12(*f*). In respect to the terminal specification for setting the I/O making method, it is necessary to provide devices other than these I/O devices 1 and 2. An example of the other device is shown in FIGS. 44A and 44B.

Figure 45:
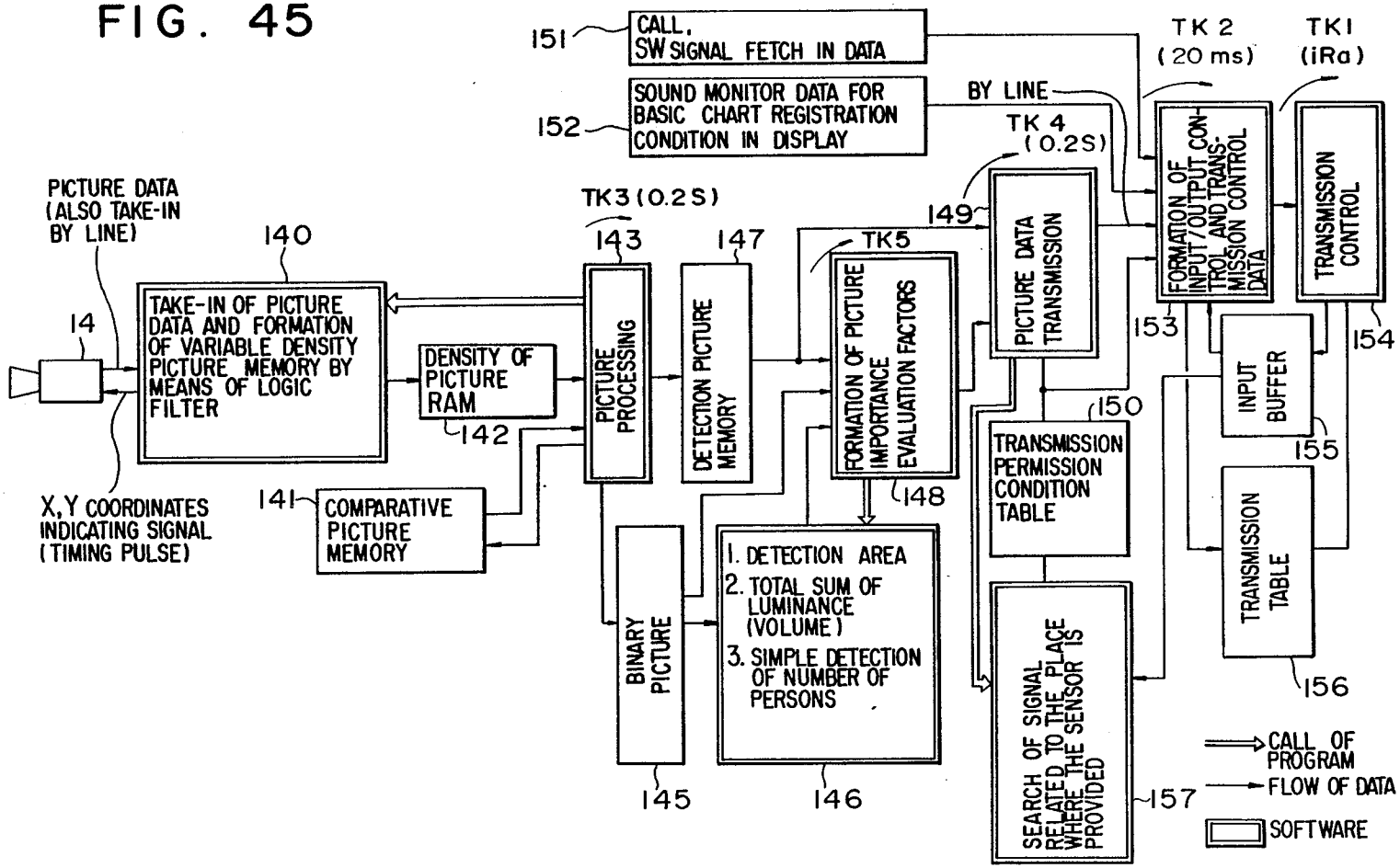
FIGS. 45 and 46 are block diagrams illustrating the processing of the indicator.
Figure 46:
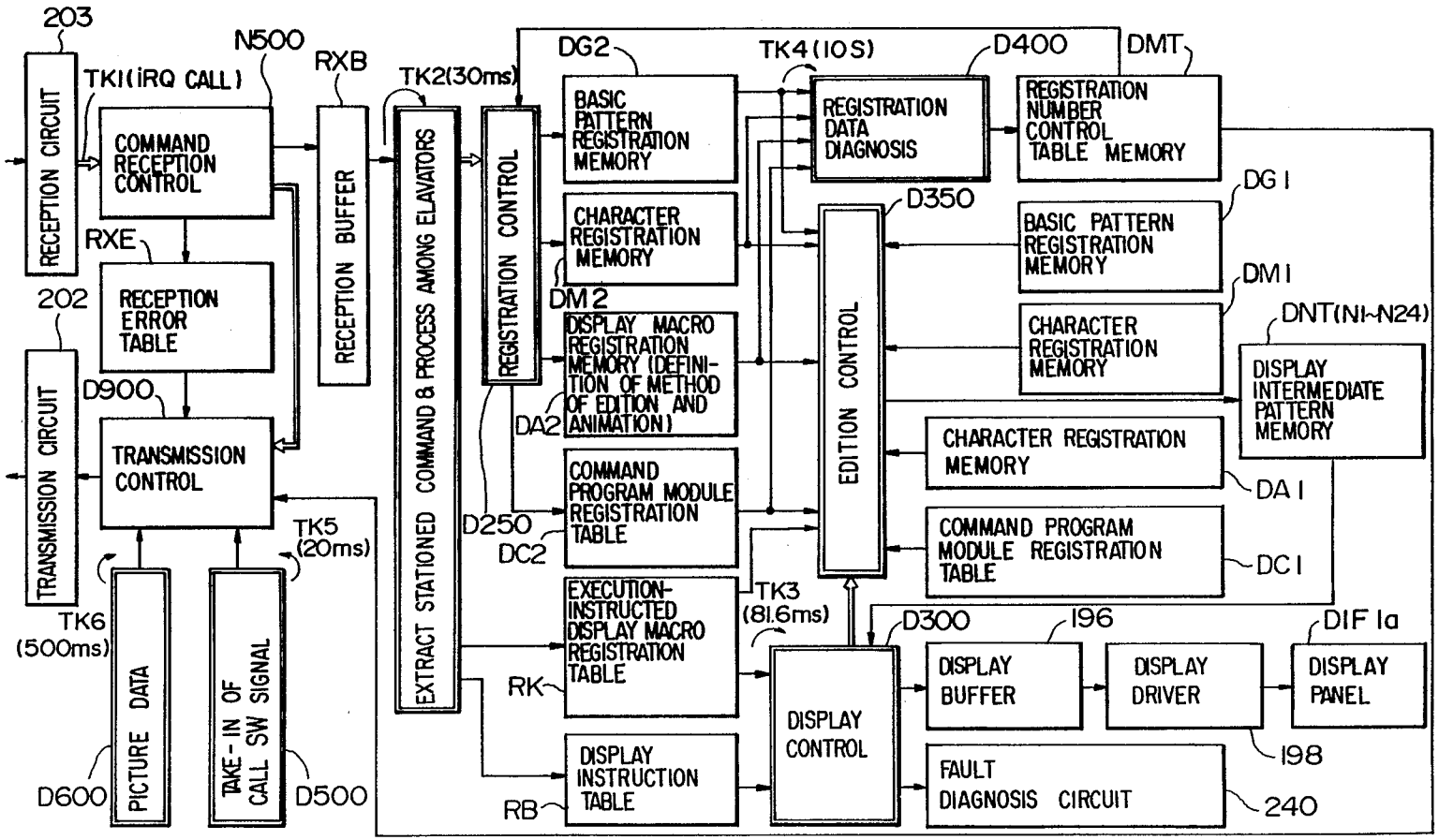

The microcomputer 200 as shown in FIGS. 44A and 44B is the same as the microcomputer 400 of FIG. 3 or as the microcomputer 600 of FIG. 4. By the steps N180 to N195 in FIG. 29, execution of information processing is controlled based on a program or data which is designed individually as shown in FIGS. 45 and 46 and which is stored in the externally provided EEPROM 194 through the transmission line 3.

FIGS. 5A and 5B are connection diagrams showing the cases where the input-out terminal equipment 4 is used in the landing place. FIG. 5A shows the case where the equipment 4 is used in the landing place on the first basement B1F. FIG. 5B shows the case where the equipment 4 is used in the landing place on the first floor 1F.

Matters being difficult to understand will be described hereunder.

(1) The information indicator D7*a* is of the type in which character or graphic patterns classified by code are displayed. For example, a code "0" is used for no display, a code S1 for displaying "FULL", a code S2 for displaying "AUTO", a code S3 for displaying "PAUSE", a code S4 for displaying "IN CHECKING. WAIT FOR ABOUT 10 MINUTES", a code S5 for displaying "BROKEN DOWN. WAIT FOR ABOUT 60 MINUTES", a code S6 for displaying "BROKEN DOWN" and a code S7 for displaying "EARTHQUAKE HAPPENED. THIS ELEVATOR CANNOT USED TILL CHECKING IS TERMINATED."

(2) In the case where the indicator is of the lamp type, the indicator is driven by a lamp driver O7*b* provided with a decoder. The lamp driver O7*b* may be, preferably, incorporated into the indicator 7*b* to attain reduction of the number of wirings connected to the terminal equipment 4*b* and standardization thereof. It is further preferable in the point of view of handling property that several terminals, particularly T421 and T422, of the output circuit 419 in FIG. 3 are used for lamp driving.

The transmission control can be improved in reliability by unification. For the unification of the step N190 and the like, the CRAM 183 and the like must be placed in the same address as that of the DPRAM 301 as shown in FIG. 1.

Referring to FIG. 4 again, a voice information service ACAMP 618 is incorporated in the terminal equipment and a WDT circuit is also incorporated in the same manner as in FIG. 1.

FIGS. 6A to 6C are a series of flow charts showing the total operation of the microcomputer 100 of the elevator controller 1. The flow is started by the restart of the CPU 101. After an initialization procedure C105, transmission initialization procedures C200A and C200 are carried out as shown in detail in FIG. 7.

Then a periodic calling operation is repeated in a period of TM2 (longer than the capacity of I/0 transmission of 33 ms) determined in the step C105, to carry out the flow of a task TK2 as shown in FIG. 6C by high-speed control. In the flow as shown in FIG. 8, the procedure (C300A) for diagnosing the trouble of the I/0 transmission equipment 1 and for judging the completion of starting thereof is carried out and then the procedure (C300B) for diagnosing the trouble of the network transmission controller 17 and for judging the completion of starting thereof is carried out.

Then the direct input procedure (C110) is carried out. At this point of time, the following software system construction can be attained so that abnormal terminal stations are detected if the abnormal terminal stations exist. The rank and position of the trouble can be judged by the control equipment trouble detection procedure (C120). The maximum-level trouble can be judged by the controlling state judgment procedure (C140). The situation can be generally judged by the operation mode selection procedure (C150) to thereby determine a corresponding operation mode code. An instruction to carry out a procedure corresponding to the situation can be issued by the enabling instruction procedure (C160). In this system, several modes, such as transmission system initializing mode, terminal No. setting mode, terminal diagnosing and information system checking mode and the like, are newly provided compared with the conventional operation method.

For example, in the case where a trouble occurs in the network transmission control system, the following procedures can be carried out. The call control procedure C520 is switched to single operation mode by cutting off the function of the portion generating the trouble. Or the information system control is suppressed. Or an operation enabling instruction is issued to carry out the controlling operation by the alarm control procedure C560 for alarming the abnormal portion temporally (for example, when the door is closed on standby, when the door controlling state is switched to the maintenance side or when the door is opened in the floor having a building manager's office) by graphic means through an indicator or the like provided in the cage or the like.

On the contrary, in the case where the input/ output terminal equipment 4*a* in the first basement B1F is abnormal, the terminal station is removed so that the service can be started. At the same time, the occurrence of abnormality, the floor having the abnormal station and the part number stored in the EEPROM 103 of FIG. 1 are transmitted, by the network transmission data input-/output procedure C800 through a network transmission device L17, to a maintenance terminal equipment connected to a maintenance center through a telephone circuit. As this result, these factors related to the trouble are displayed on a monitor in the control panel by the direct output procedure C180 and are transmitted to the center through the maintenance terminal equipment 104 and the telephone circuit NTT so that pertinent and quick response can be made.

In the following, the call assignment control procedure for controlling two elevators is described with reference to FIG. 6A. As described above, the microcomputer is constructed so that the restart procedure C100 is carried out immediately after the electric source is turned on. After the DPRAM 301 and the like are initialized by the initialization procedure (C105), a transmission control specification is stored in the DPRAM (C245 to C260 in FIG. 7). Then, for example, the elevator call-assignment procedure is carried out (C115) based on the input signals of the hall buttons 5*a*1, 5*a*2, 5*b*1, 5*b*2 as shown in FIG. 41. Further, data of great significance are analyzed from picture data obtained from every floor to thereby carry out image processing (C120) for crime prevention, the number of persons waiting for the elevator, the judgment as to whether the persons will use the elevator, and the like. Then the procedure of from the step C106 to the step C120 is repeated.

In the following, the group control elevator call control procedure (C520 in FIG. 6C), that is to say, the control procedure for determining the direction of movement and for detecting re-open request, is described in detail with reference to FIG. 6B.

In the case where the management and control system is normal, service work for setting call-floors (in general, divided by directions) to be used for the elevators is once cleared up (C521). Then, cage-call registration resetting control and service buffer generation are carried out (C522). Then, hall-call registration is carried out (C523). If the controlling operation in the group controller 10M or 10S is normal (C524), the service work generation (OR-set) procedure (C525) based on assigned hall-call and the procedure (C526) based on an instruction to return elevators diversifiedly are carried out. Further, the procedure (C530) for detecting operation mode based on the service work and the procedure (C531) for detecting the stopping of the elevator and the opening of the door based on the work are carried out. This a series of procedures is carried out.

On the other hand, in the case where the management and control system is down but the network transmission line is normal (judged in the step C527), the assigned hall-call procedure C525 and the diversification return procedure C526 are replaced by the procedure (C528) for hall-call common resetting and for service buffer generation is carried out. Thus, a series of procedures is terminated.

Further, in the case where the network transmission line L17 as to both the control system L17*a* and the information system L17*b* is down, the assigned hall-call procedure C525 and the diversification return procedure C526 are replaced by the procedure (C529) for service buffer generation by backup mode is carried out. Thus, a series of procedures is terminated.

The main procedures for controlling elevators can be executed by the high-speed periodic task TK2 as shown in FIG. 6C. It is now assumed that control data are fetched by the I/O transmission lines 3*a* and 3*b*. The I/O transmission controller 2 judges reception error on data in the reception work areas S1RX to S18RX (FIG. 15(*a*)) of the DPRAM 301 as shown in FIG. 1. Then normal data are transferred to an area LX (FIG. 14) for storing reception data classified by terminal stations (the step M145 in FIG. 9). Further, data formed by converting the aforementioned data into a data specification so that the data can be easily processed by the host controller (so that floor data correspond to kit or offset) are generated (M400 in FIG. 29) in the input data area ZX (FIG. 14) by development and edition in accordance with the input data development speck RXSP as shown in FIG. 14. The host controller 1 generates a control input table (not shown) by development and duplication on the basis of the data ZX. (This procedure is executed in the step C388 of FIG. 8 called in the step C300A of FIG. 6(*c*)).

Figure 47:
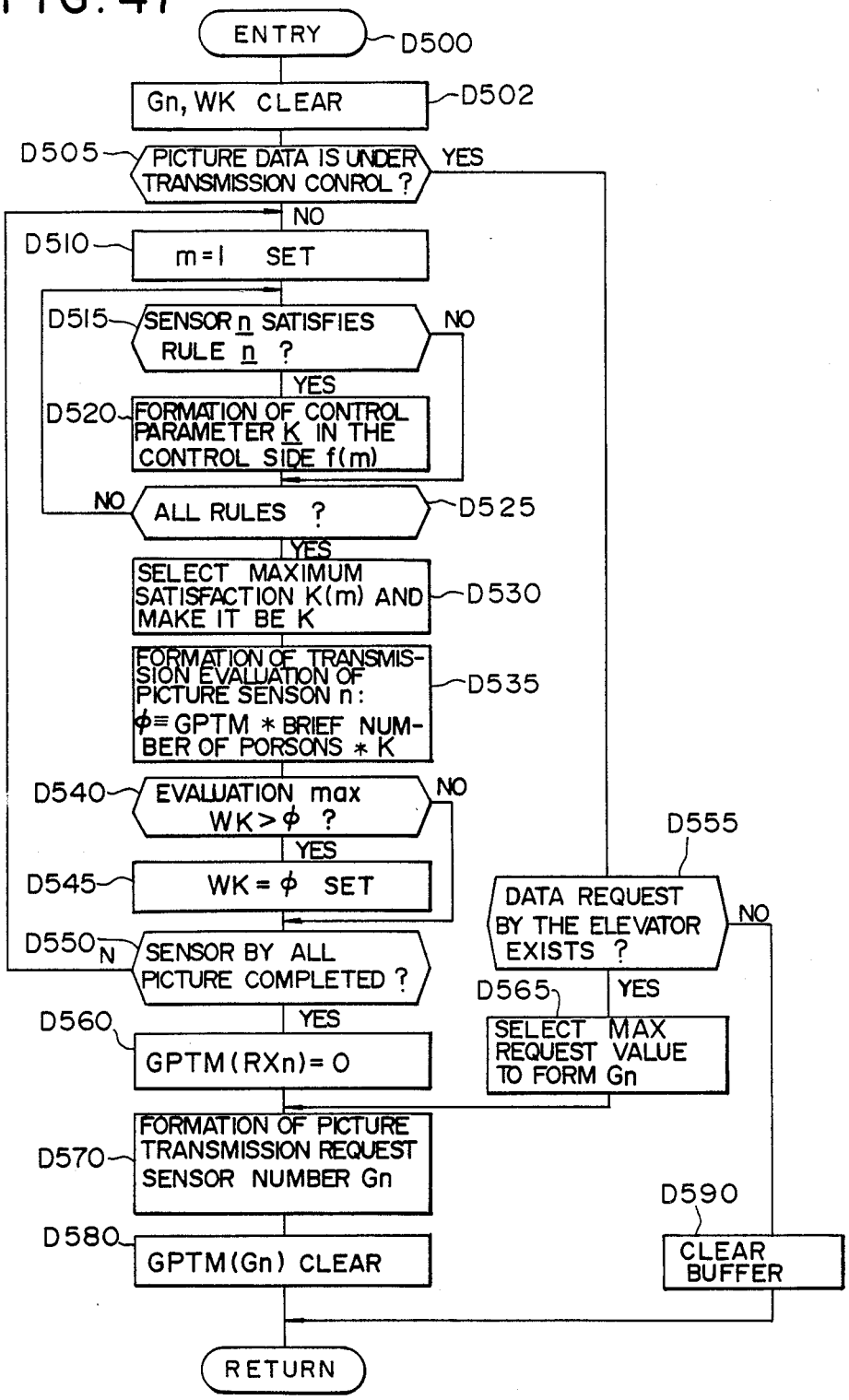
FIG. 47 is a flow chart of picture transmission of an elevator control system.

Then, in the step C300B, a hall-call signal fetched from the network transmission line L17 through an interface of another elevator and an assigned hall-call signal from the group-control controller 10M or 10S are developed and edited in the same manner as data in the area ZNRX of the DPRAM 301 included in the network transmission controller 17, so that preparation for the elevator control procedure of from the step C120 to the step C170 is made. The picture data transmission request instruction as shown in the step D500 is for determining/designating the priority in transmission of picture data detected by the information terminal equipment 19*a* as shown in FIG. 2 (or as shown in detail in FIGS. 44A and 44B). The detail thereof is shown in FIG. 47. When a higher-rank picture control system is in operation (D505), the highest priority is given to this system (D555 to D565). When the system is out of operation, the intelligence procedure for determining the degree of transmission request is carried out (D515 to D525). Some values are selected from the maximum values of transmission request (D530 to D560) so that transmission request commands are given to the respective terminals (D570). Then a time interval timer GPTM is cleared up (D580).

FIG. 7 is a flow chart showing the detailed operation in initialization of transmission control in the host controller. In particular, the flow chart is related to I/O transmission control by way of example.

The procedure starts from C200. To detect abnormality of the DPRAM 301 and the circuits relevant thereto, test data (mode 1) are set in the whole area. For example, addresses S01 to SFF are set in order of the address and a data "01" is set in the final address CHKD (Refer to FIG. 15(*a*)) (C205) while writing error is diagnosed.

Then, the content of the lower address is copied to the upper address while bits are rotated to the right one by one in the master station 2 side.

The result is checked (C210).

When there is no coincidence because of abnormality or when there is no response because of abnormality of the master station 2, an error code IOCER1 is set based on the judgment of time-out (about 1 second) in the steps C220 and C240 so that suppression of high-speed running is requested to the aforementioned software system. On the contrary, when the predetermined condition is satisfied, retry is decided (C700B in FIG. 6C).

The same checking procedure as described above is carried out while data are changed. For example, the same procedure is carried out on data SFF to S01 and then S02 is set in CHKD (C215).

If the result is normal, "1" is set in the bit-0 of STATUS (FIG. 15(*a*)).

Then, in the step C245, a transmission control specification NWST, such as a basic specification SP, as shown in FIG. 15(*b*) is generated by reference to a similar table provided in the inside of the EEPROM 103 in FIG. 1.

Then, a terminal specification data capable of being received in common to all the terminal stations is generated to be stored in the table SCTXS (C250). Terminal specification tables S1TXS to S18TXS for classifying data by the terminal stations are generated by reference to the content of the EEPROM 103 in FIG. 1 (C255). The sum of data is calculated to be stored in SUM1 and then "1" is set in the bit-2 of STATUS (C260).

By the aforementioned procedure, the I/O transmission control system (2, 3, 4, 6, 13, 19) as shown in FIG. 2 is enabled to carry out initial transmission. The completion of initialization from the master station is judged by updating of SDNO (FIG. 15(*a*)) so that "1" is set in the bit-4 of STATUS (C285). If initialization is not finished in a predetermined time (about 0.3 second), a decision that the initialization is abnormal is made so that an error flag 10CER2 is set (C280).

FIG. 8 is a flow chart of the operation of the host controller, showing an example of I/O control transmission data input procedure C300A.

In the steps C310 to C364, a judgment is made as to whether normal transmission is executed or not. On the basis of the judgment, HIO1EN to HI04EN are set and "1" is set in the bit-6 of STATUS.

Table names headed by "H" show tables in the RAM 106 in FIG. 1.

As shown in FIG. 8, in the step C320, repetition up to two times is regarded as normal. The reason is that the procedure is required when the period TM of the master station n2 is longer than the period TM2 of the host controller 1. Of course, the number of repetition in the step C330 is not limited to 4.

Then, if the operation is continued normally, termination of the procedure over all the transmission equipments in the I/O transmission system is checked in the step C389 via the steps C366 and C388.

In the case where the input data generation flag in the transmission equipment side is not found in the step C366, the retry procedure from the step C368 to the step C387 is executed for self-recovery.

FIG. 9 is a flow chart showing an example of the data transmission/reception procedure in the master station 2.

After initialization is finished as shown in FIG. 29, a judgment from transmission basic specification DATA of the DPRAM 301 is made as to whether the station is a main control station or not (M103).

Then, in the steps M106 to M121, a common data of n=21 or a common specification data of n=1 is transmitted.

In the steps M122 to M178, data classified by the terminal stations are transmitted. In the steps M127 to M133, the transmission data size of the data is selected. The aforementioned procedure is repeated with the period of TM.

Figure 34:
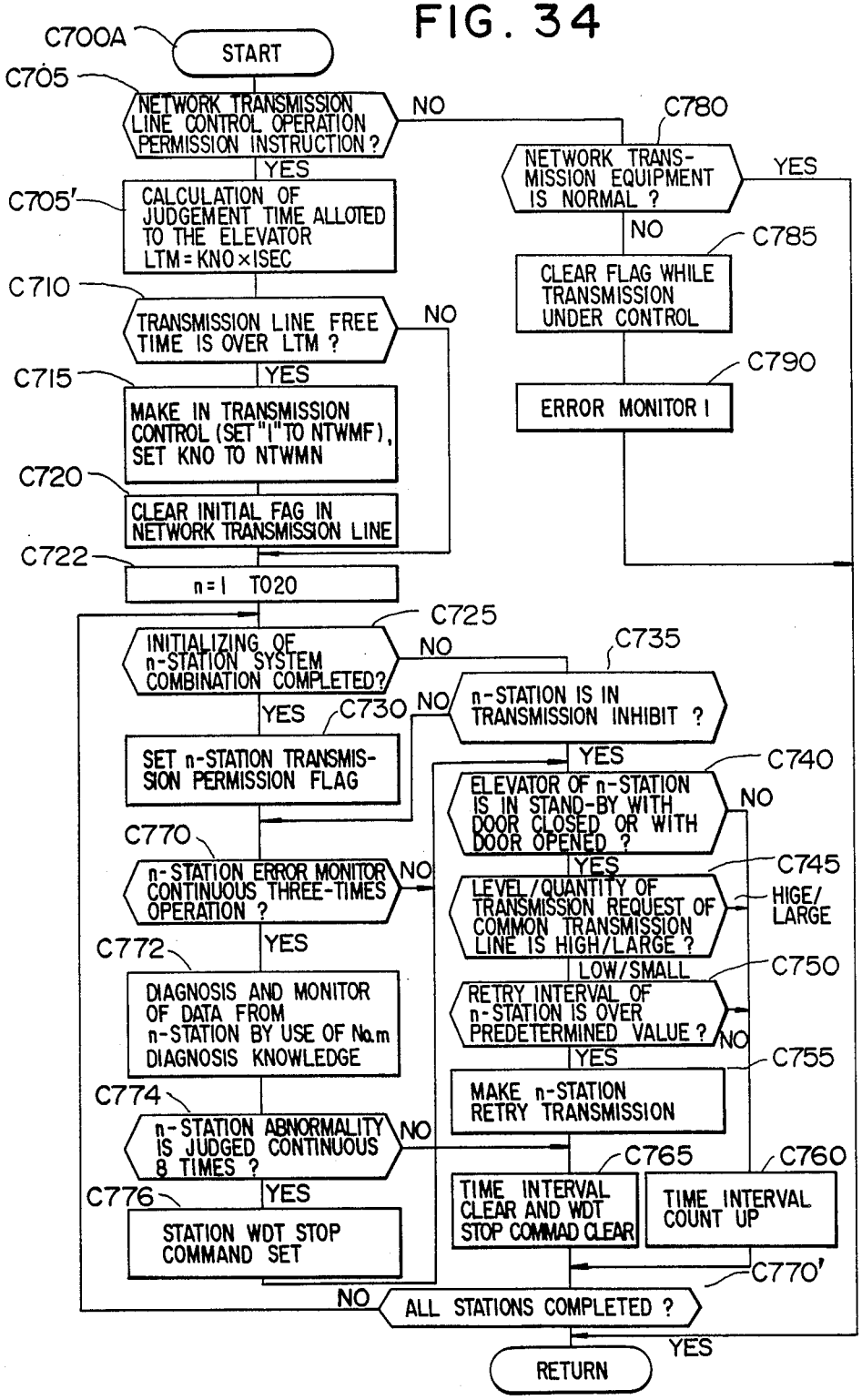

In the case of the two-elevator system as shown in FIG. 41, the I/O transmission controller 200*a*4 and the equipments M17Hl to M17H3 and S17Hl to S17H3 connected to the group-control controllers 10M and 10S are generally not given the instructions of the main control station from the host controller. Accordingly, the second wake-up (M166) is carried out so that a standby state for waiting the transmission/reception processing (FIG. 31) is produced by interruption generated by the transmission command from the main control station. At this time, use of bus is diagnosed in the steps M169, M163 and M172 and in the step S921 of FIG. 11 called by FIG. 31, so that data for performing the same bus control C700B as shown in FIG. 34 are given to the host controller through the area ERT.

FIG. 10 is a flow chart of the operation procedure of the I/O master station called from FIG. 29.

In the steps S103 to S127, the assortment procedure of the I/O master station is carried out based on a terminal hardware discrimination signal. The processing/selection to be made by a transmission master station selected in the steps S400B, S400A (as shown in detail in FIG. 39) and S400C is executed.

Figure 38:
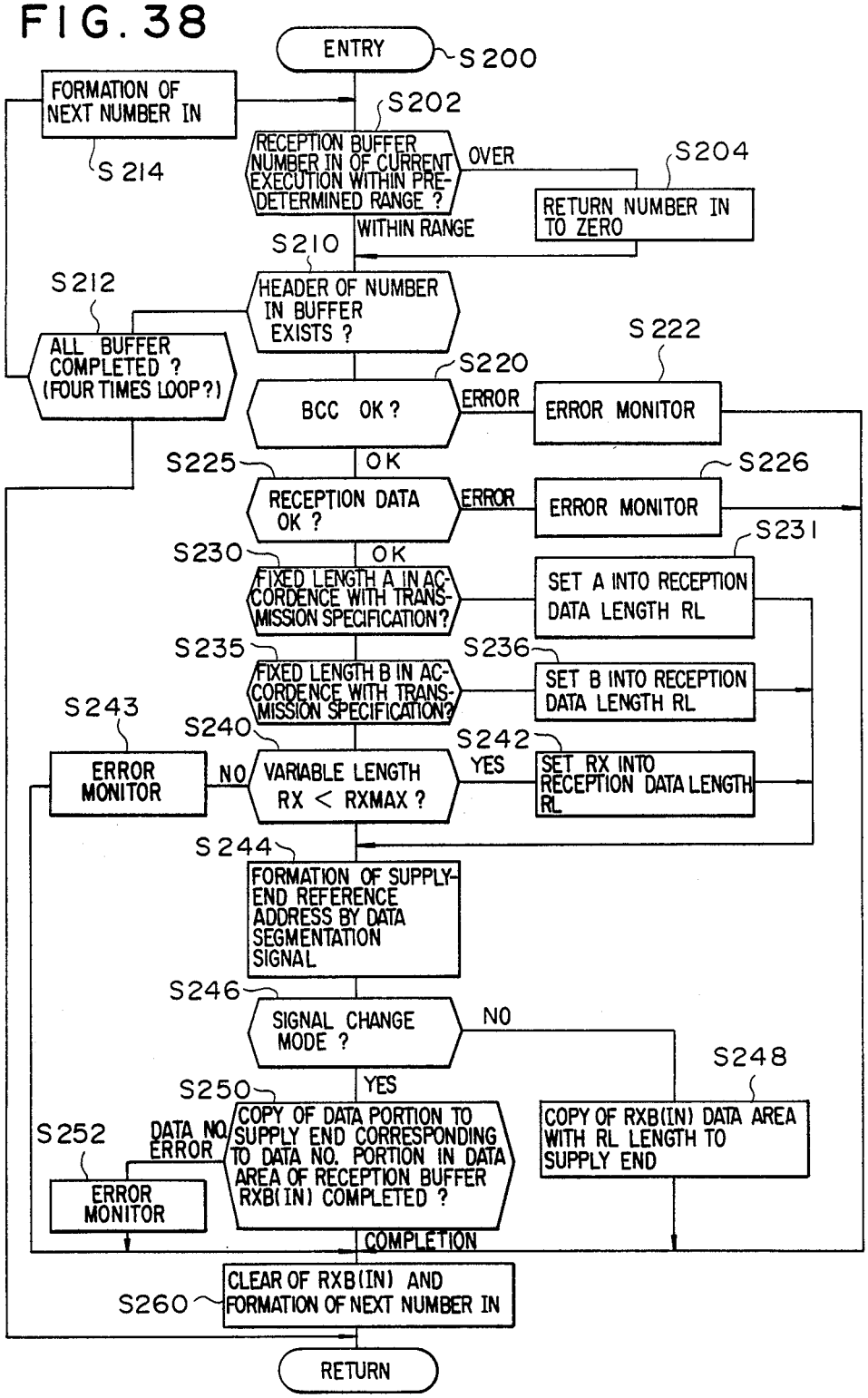

Then, the reception procedure as shown in FIG. 38 is carried out in the step S200. In the steps S133 to S151, the diagnosis of abnormality in its own station and the WDT control pulse output operation are carried out.

The method of diagnosis of hardware abnormality in the third WDT circuit as shown in FIG. 24 is as follows. The presence of abnormality is checked by the time difference TWab between pulses a and b respectively generated periodically in the steps S136 and S142 as shown in FIG. 25. If abnormality arises, the CPU 207 is reset to restart the operation. Thereafter, the operation is returned to a normal state by generating (S148) a pulse c only once (S145) in the step S148 when a retry signal is received (S133) from the host controller. As another method, the number of occurrences of abnormality may be checked in the step S145 so that the operation can be returned to a normal state by generating a pulse c (S148) corresponding to the once occurrence of abnormality after a time predetermined by hardware has passed.

The abnormality diagnostic procedure is described more in detail with reference to FIGS. 24 and 25.

After the procedure up to the step S154 is finished normally, the low-periodic procedure for every terminal equipment designated by the host controller 1 is carried out in the steps S157 to S172. This procedure is carried out in accordance with a program which is constructed so specifically that the processing time required for one period is shortened and the processing step is updated successively corresponding to the starting number.

FIG. 11 is a flow chart showing the I/O transmission line interrupt processing started by the interrupt processing program of FIG. 29 and started when data is received from the master station after the first wake-up pulse (for keeping "1" over one-byte transmission time, for example, 176 μs) is received.

In the case where data is $00 and the start bit of the next data is not received as "0" because of a factor such as a noise or half breaking of transmission line, the wake-up operation in the first wake-up setting procedure (S969) may be released erroneously. It is often difficult to return the state to normal after an abnormality occurs once. Therefore, the second wake-up setting procedure S965 (about 350 μs or more) is provided. When an error arises (S903), the second wake-up procedure is executed. Further, transmission wait time $TW_2$ (FIG. 13) is provided to enable interruption by releasing the second wake-up operation before a transmission block command is transmitted when transmission is started from the main control station and the transmission control station.

When, for example, terminal data is transmitted after data for its own station is received, a judgment is made as to whether the command received is a transmission command (n=22) exclusively used for the firstfloor station (S903, S909, S912, S195 and S924). Then, the reception buffer RXB (if necessary, a plurality of buffers are prepared against the time lag of the steps S400A and S400C) is searched for space (S927). Then, reception of data following the command is repeated (S933). When data shortage or a vertical parity error occurs in this condition, the error monitoring procedure 4 S936 is carried out while the main processing is interrupted. Accordingly, the occurrence of abnormality can be identified by time-out in the host-side transmission procedure (M136 in FIG. 9) or the transmission completion judging procedure M139.

When normal reception is finished, data of the transmission buffer are transmitted (in the steps S951 to S957) in accordance with the data length and the transmission specification (protocol) which have been received through initializing transmission in advance for every transmission command (S939) inclusive of transmission request.

FIG. 12 is a timing chart showing the initializing transmission/reception between the I/O transmission controller (master station) 2 and the terminal stations.

In FIG. 12, the I/O master station 2 carries out transmission to all the terminal stations during the predetermined period of TMi in the order as shown in the diagram (a). The diagram (b) shows an example of structure of initializing data transmitted to all the terminal stations. The diagram (c) shows an example of structure in block of text data transmitted as shown in (b).

In FIG. 12, the diagram (d) shows the structure of terminal station assortment data transmitted from the I/O master station to every terminal station. The diagrams (e) and (f) show the cases where hardware specification data are respectively transmitted to two terminal stations different in the kind of hardware.

FIG. 13 is a timing chart of transmission/ reception between the I/O master station 2 and every terminal station after initialization of all the terminal stations is finished.

In FIG. 13, the I/O master station 2 performs data exchange with all terminal stations during the predetermined period of TM in the order as shown in the diagram (a). The diagrams (b), (c) and (d) show examples of structure of data in the respective transmission/-reception periods.

FIG. 14 shows an example of the inside structure of the DPRAMs used for data exchange between the host controller 1 and the master station 2. Practical examples of the basic specification SP, the control specification MP and the like are shown in FIG. 15.

In this embodiment, the memory-using area of the DPRAM is defined in table management specification MP on the consideration that the same mask ROM is used in common to the I/O master station 2 and the terminal stations or the maintenance transmission equipment 10H.

In the case of a group control elevator system, the same mask ROM is used in the network transmission line L17 between the host controller 1 in the elevator and the group control microcomputer (1G, 1S in FIG. 19) for the purpose of data transmission/ reception. Accordingly, memory areas MWT (non-rewritable from the terminal side) and NGR used for transmission/reception of data are provided only in the group controller side as shown in the diagrams (a) and (b) of FIG. 28.

These tables are used in edition and development II (M400) of transmission/reception data as shown in FIG.

29. The transmission table NGT used in the host side is developed to a transmission station (asorted by elevators) table NTX to thereby facilitate the transmission processing. On the contrary, the table NRX for storing data received from every station is edited to generate a control input table NGR.

The transmission control specification table NWST in the network transmission controllers 17a1 to 17a3 and M17C1 as shown in FIG. 19 is shown in detail in FIGS. 40A to 40D.

Protocol for defining factors such as the number of retries at the time of transmission of an error for every transmission block is given to the table NWST-BN as shown in FIG. 40A from the host controller corresponding to the transmission mode number represented by NWST-AK in FIG. 40B.

The reception station assortment for determining combination of reception stations for every transmission block is obtained from the protocol table NWST-KN as shown in FIG. 40C by the host controller. (A mask ROM may be used).

The transmission block requires the control work NWCT as shown in FIG. 40D(*d*) for the purpose of carrying out transmission by the number of stations stored in the maximum station number MAXK in order with the broken station being skipped.

A method of transmitting the table NWST and the like to a user command board 10U and the like from the transmission equipment 17*a* as a transmission control station at the time of initializing transmission (in this second embodiment, the protocol of first initializing transmission of Bn=1 must be provided in the form of a mask ROM) can be used so that the user command board 10U serves as one device though the position and purpose thereof change.

In general, the quantity of data in the data transmission signal of the network transmission line L17 or in the information terminal equipment 19*a* is larger than the quantity of I/O control data. In addition, in most cases, variations in signal transmission time can be neglected if any.

On such circumstances, the transmission mode NWST-AK is constructed so that transmission of the changed signal can be designated as shown in FIG. 40B.

In the steps N400 and U400 in FIG. 29, in the steps S476 and S478 in FIG. 39 and in the steps M130 and M133 in FIG. 9, signals changed in the transmission table NTX are edited and stored in the transmission buffer NTXB so that the data of the reception buffer NRXB are developed into the reception table NRX.

The compare table NTXC serves as a table for detecting the change of the transmission table NTX. The compare table NTXC is updated on the basis of the transmission buffer or checker reply data whenever transmission is finished. The specifications I and II for generating the transmission buffer are shown in FIGS. 40C and 40D, respectively.

Figure 16:
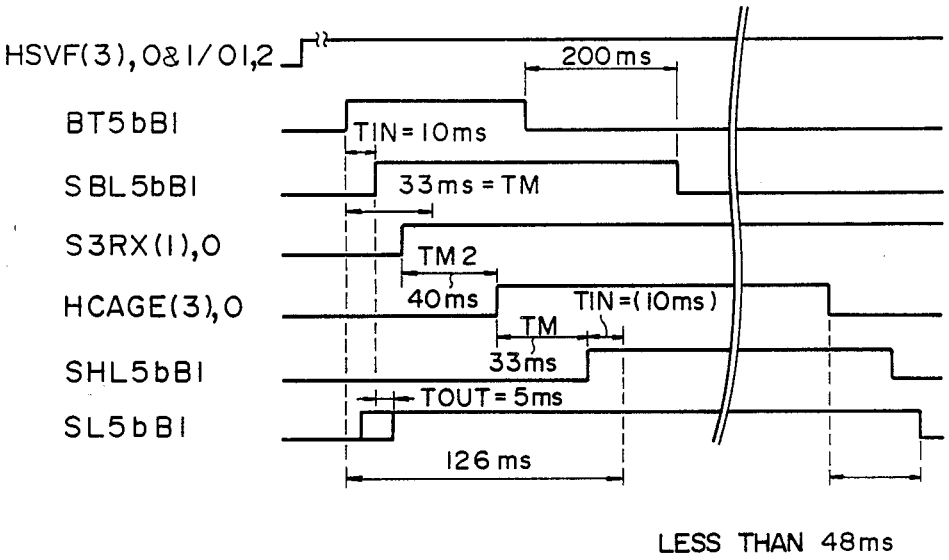
FIG. 16 is a time chart illustrating the local lighting processing of call registration in a hall-side input/output terminal equipment.

FIG. 16 is a timing chart showing the aforementioned call-registered local lighting operation in the hall terminal equipment. In the following, the operation is described.

It is now assumed that hall-call is registered (BT5b41) on the first basement. A signal is inputted into the input circuit 418 as shown in FIG. 3, so that the time required for processing hardware in the inside of the terminal equipment 4 is 10 ms (SBL5bB1). Then, the signal is transmitted (S3RX(1), 0) to the master station 2 in the period of 33 ms (=TM) in the step S933 and then inputted into the host controller 1 in the processing period of the host controller 1 of 40 ms (=TM2) so that the signal is processed by the host controller 1.

Thereafter, an output signal is transmitted to the terminal equipment 4 in the reverse course (SHL5bB1), so that a reply output signal from the host controller is delivered to the hall button (SL5bB1).

As described above, the large time lag of 130 ms is produced between the calling and the answering.

To solve this problem, in this embodiment, a signal is generated in the inside of the terminal equipment 4 to be delivered to SL5bB1 during the period between the generation of the signal of BT5bB1 and the generation of the signal of SHL5bB1, by which the users little feel the time lag in lighting the answer lamp.

In the following, the generation of the control input table is described with reference to FIGS. 17A to 17D and 18A to 18C.

Figure 17D:
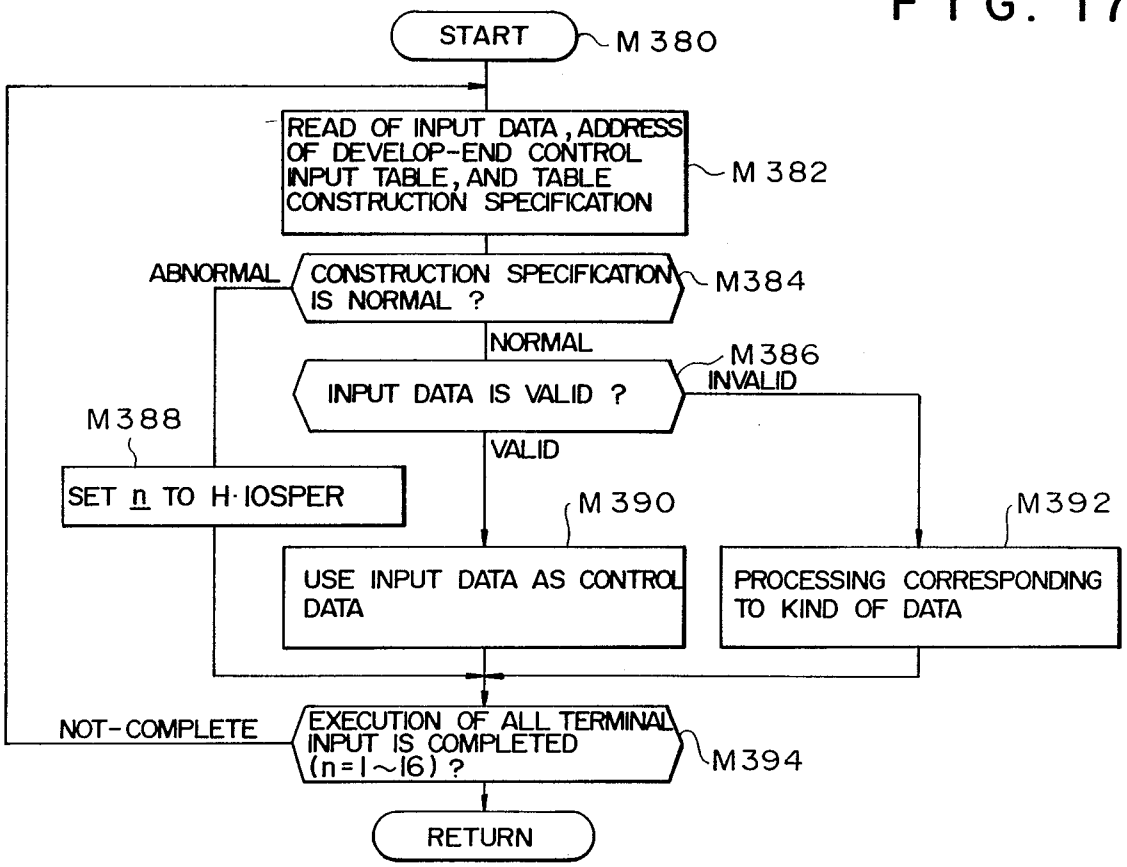

FIG. 17A shows a development specification table 103*a*. The 512 specifications IO1SP(0) to IO1SP(511) stored in the EEPROM 103 in FIG. 1 are used in the steps M382 to M392 in the flow chart as shown in FIG. 17D. The number, 511, of the specifications is used for judgment of termination in the step M394.

Figure 18A:
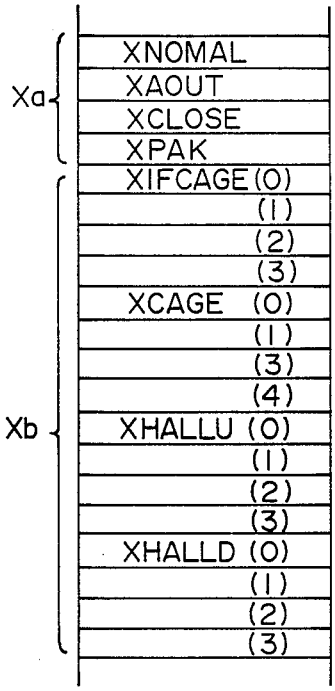

The specifications IO1SP(n) are classified into two types as shown in FIGS. 17B and 17C. Specifications of the type as shown in FIG. 17B are used for $X_b$ type input data as shown in FIG. 18A. Specifications of the type as shown in FIG. 17C are used for $X_a$ type input data.

Figure 18B:
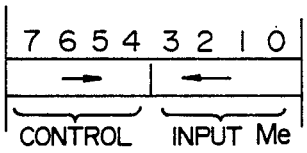
Figure 18C:
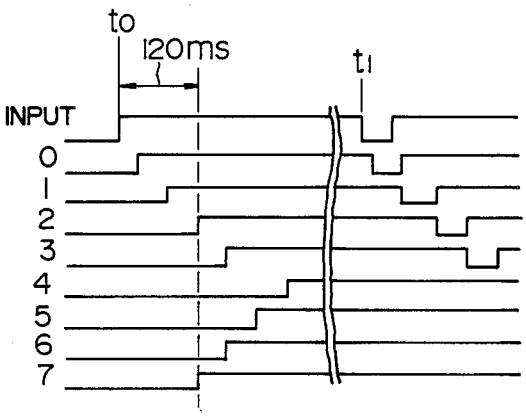

One input data $X_a$ is composed of bits as shown in FIG. 18B. The timing chart related to the bits of the input data is shown in FIG. 18C (in the case of TM2=40 m).

Figure 37:
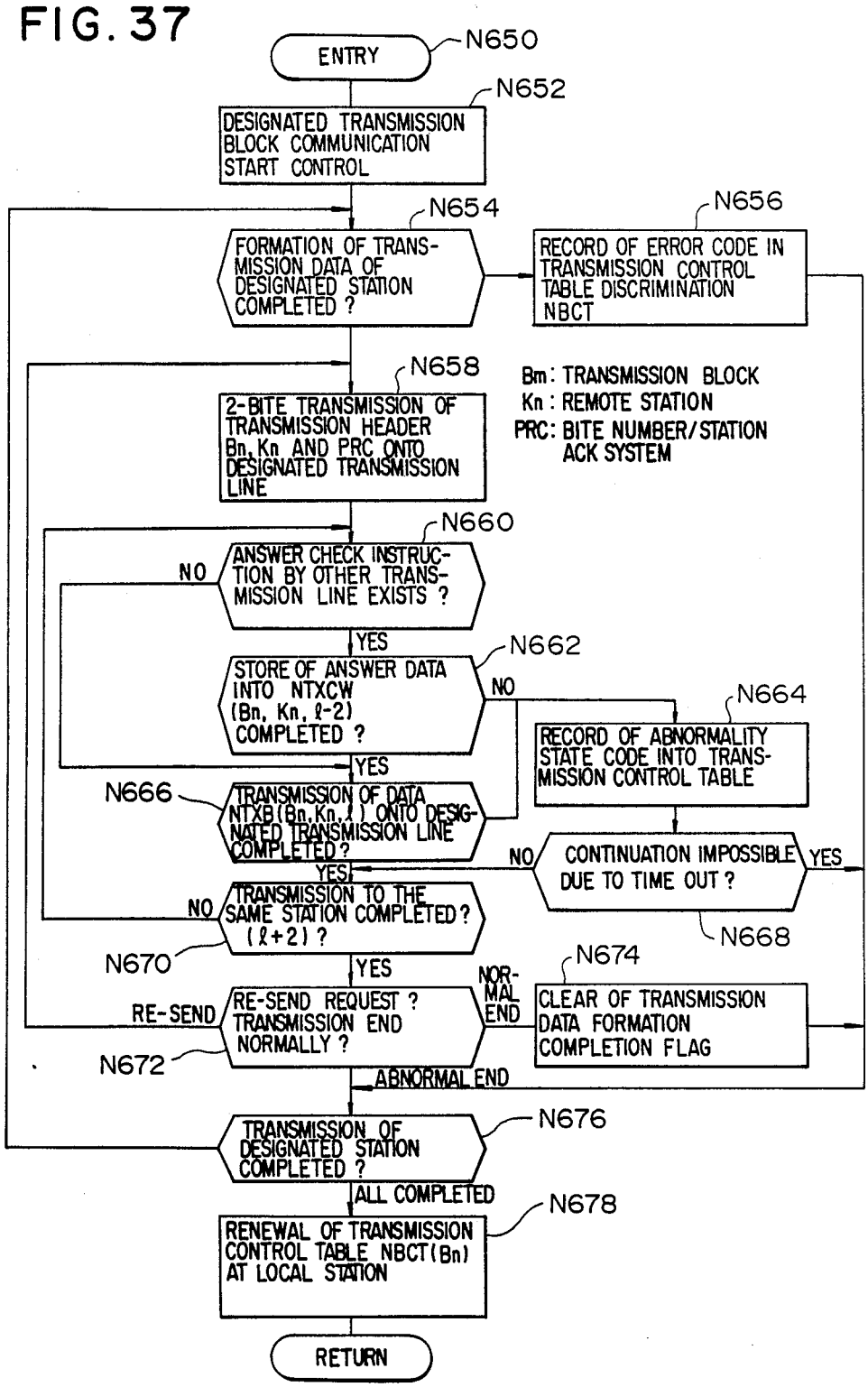

By the aforementioned method, the temporary signal change caused by chattering or noise can be stored to be judged by one byte per one point. FIG. 17B shows the case where the number of filters is 3 as an example. In any case, when a large number of signals are changed, the circulation transmission data TDNL are stored in the remaining area and then at least one circulation transmission data TDNL is set in the last transmission block so that a pair of data TDNL and NOTNL can be stacked on the transmission buffer. The transmission serial number GTNO and block check code formed of horizontal parity check code for a pair of buffers are stored in TBCC and then a flag for representing completion of generation of transmission buffers is raised so that a judgment can be made in the step N654 in FIG. 37 showing the flow chart of transmission processing.

Figure 28A:
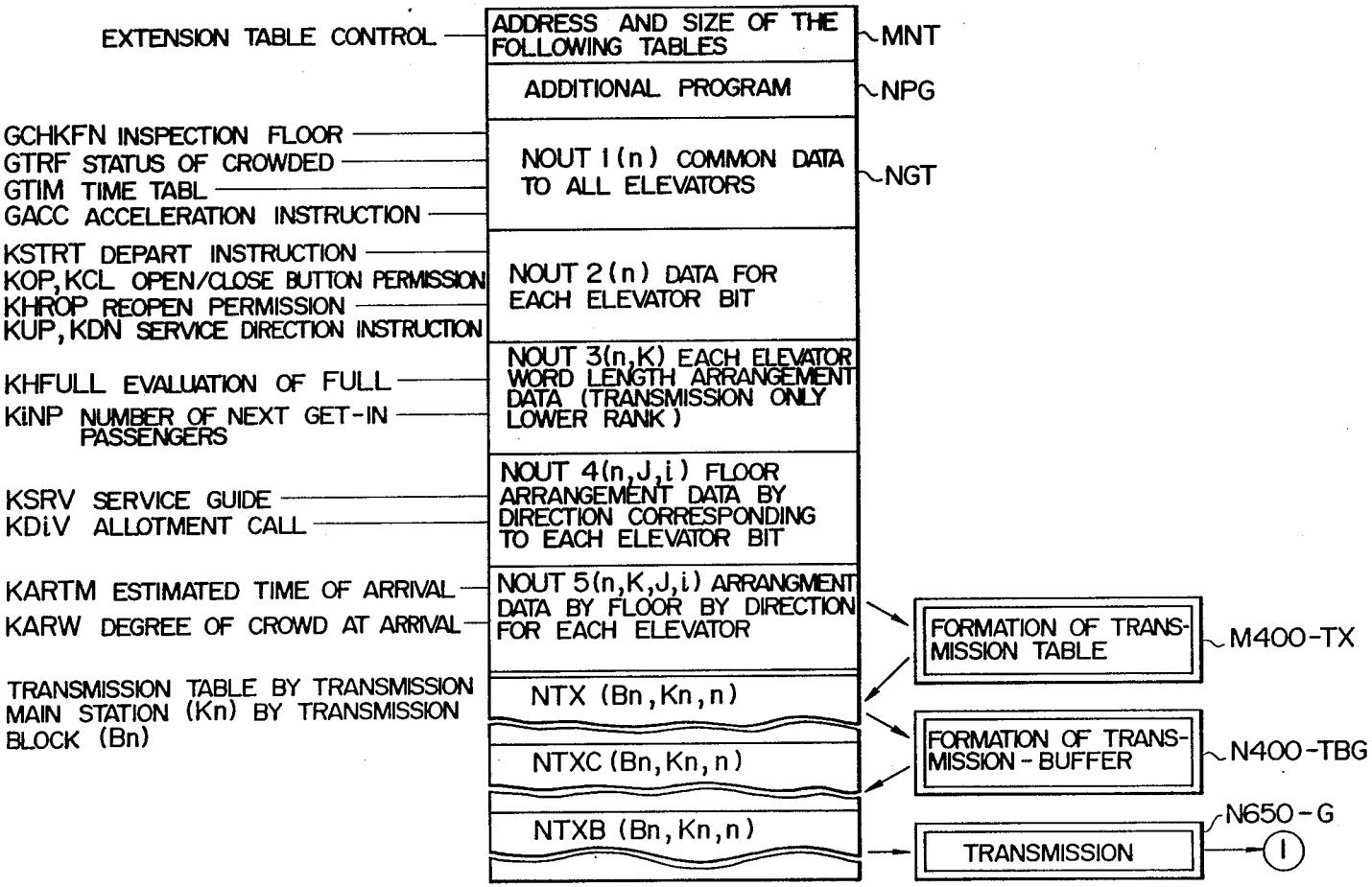
FIGS. 28A–D are diagrams illustrating in detail an example using a memory in an extended DPRAM used for network-transmission in the group-control controller.
Figure 28:
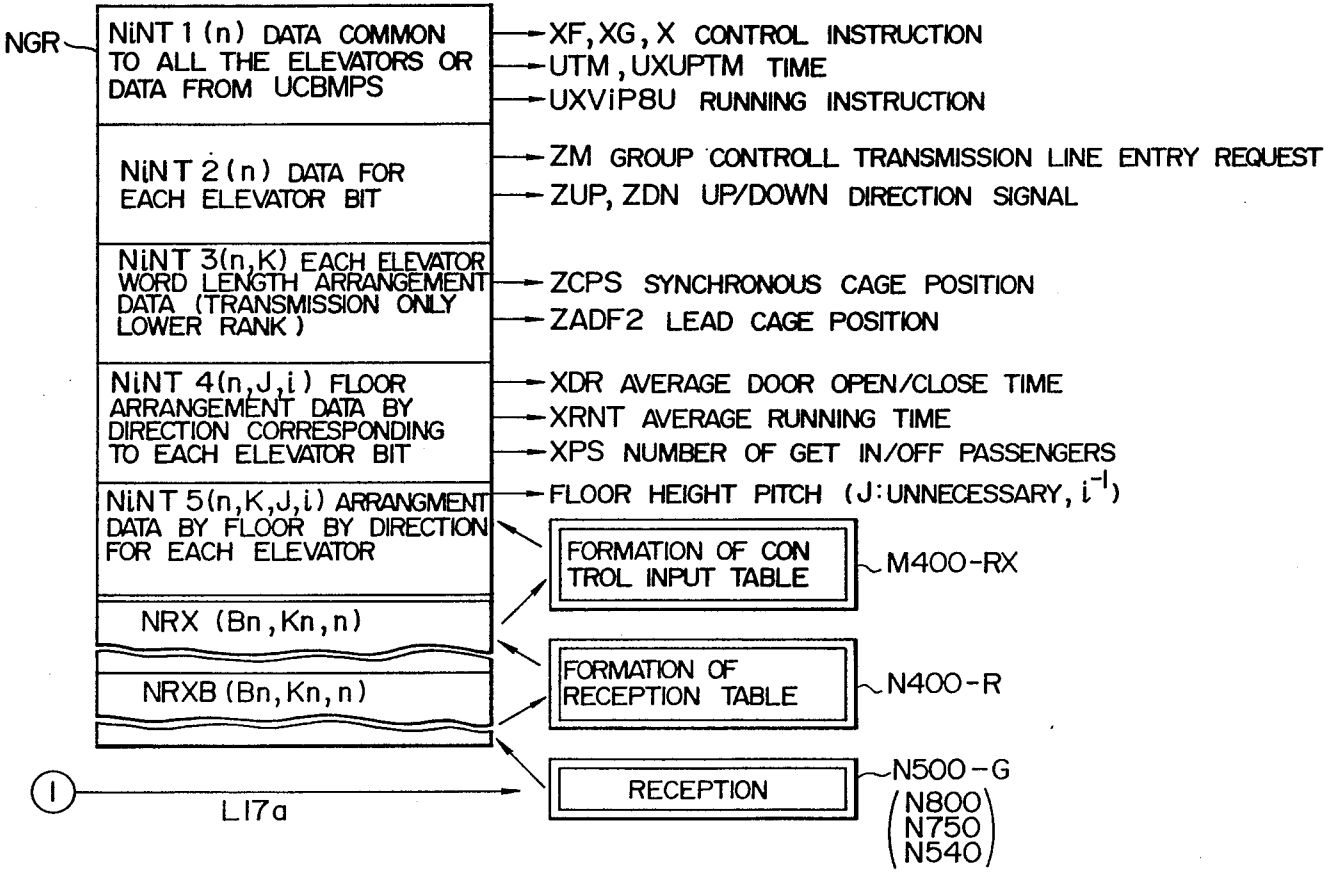
Figure 28C:
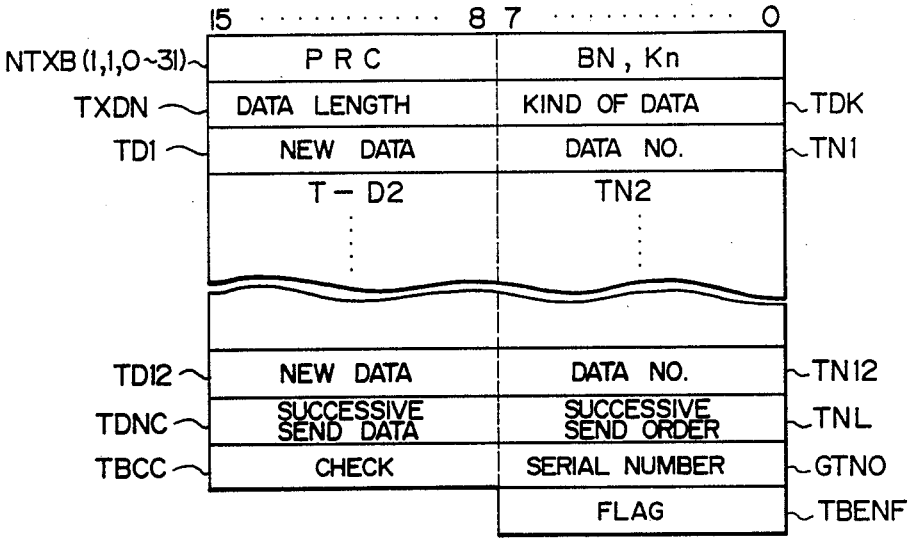
Figure 28D:
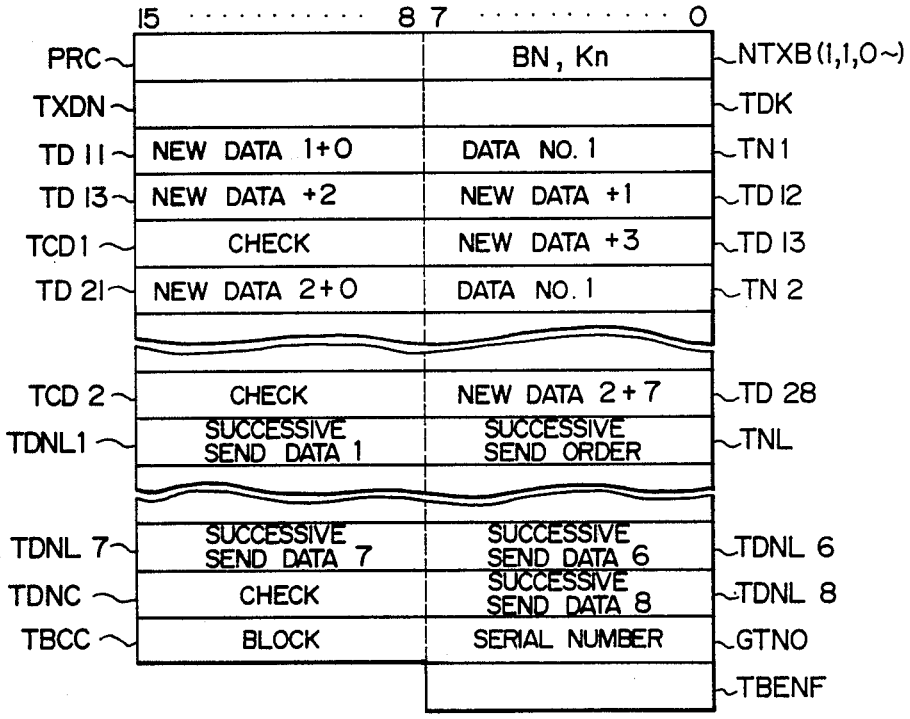

The changed data transmission 1 as shown in FIG. 28(*c*) is constructed to judge the change of data for every byte, whereas the changed data transmission 2 as shown in FIG. 28(*d*) is constructed to judge the change of data for every 4 bytes or for every 8 bytes. Accordingly, the method of FIG. 28(*d*) is suitable for picture data transmission and initializing transmission and, on the other hand, the method of FIG. 28(*c*) more simple (speedy) is suitable for general network transmission.

The flow chart as shown in FIG. 17D is a flow chart of input table generating procedure (M380) for developing data of the data tables S1RX to S18RX which are generated based on data received from every terminal station by the master station 2, into the control input table 106*a* of FIG. 18A forming a part of RAM 106 as shown in FIG. 1 in the steps M382 to M394.

FIG. 19 shows the construction of a system as another embodiment according to the present invention.

Figure 20:
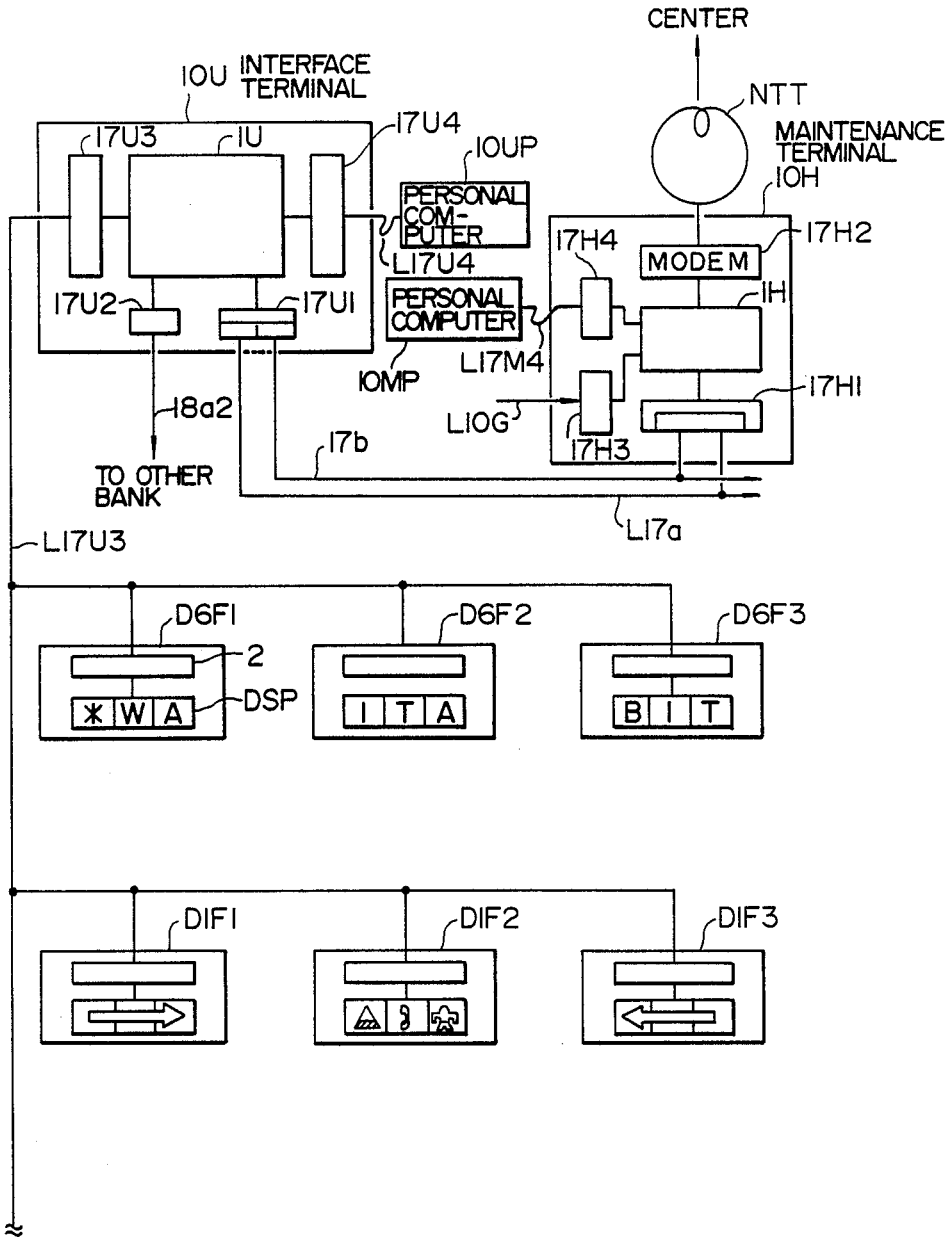
FIG. 20 is a diagram illustrating an extended example of the group-control elevator system shown in FIG. 19.

In short, FIG. 19 shows the case where the invention is applied to an elevator group control system using three elevators and having service floors of from the first basement B1F to the 8th floor 8F (for illustration, service floors 1F to 4F are shown but other floors are not shown). In the drawing, the group control microcomputer (host controller) 1G incorporated in the operation-system group controller 10M is connected to the group control I/O transmission controllers M17H1 to M17H3 and further connected, through buses (common data transmission lines) 3*b*1 to 3*b*3 to the input/output terminal equipments (hereinafter simply referred to as "terminals") 4*c*1 to 4*c*3, 4*d*1 to 4*d*3 each of which serves as an interface for two-floors' equipments. Further, the network transmission controller M17C1 using two transmission/reception circuits corresponding to one transmission controller is connected to the group control microcomputer 1G. The network transmission controllers 17*a*1 to 17*a*3 are incorporated in the network transmission controller S17C1 and the respective elevator controllers 10*a*1 to 10*a*3 in the intelligence-system (standby-system) group controller 10S. The two transmission/reception circuits a and b of these transmission equipments are connected, by two transmission lines L17*a* and L17*b*, to the transmission circuits a and b of the transmission equipments 17U and 17H1 incorporated in the maintenance terminal equipment 10H as shown in FIG. 20, the supervisory panel, the remote supervisory system terminal and the multifunctional interface terminal equipment 10U (hereinafter abbreviated to "U.C.B.") used for inputting information or used in the registration control system and the like.

The group-control controllers 10S and 10M of two systems are connected to the maintenance terminal equipment 10H by the transmission controllers M17C2, S17C2 and 17H3 through the bus line L10G, so that the group-control controlling data communication between the two systems is carried out as related to the group control by the group control controllers 10M and 10S, the examination of the situation of knowledge data learned and acquired and the examination of the operation of elevators.

Further, the group-control controller 10S has the same construction as that of the group-control controller 10M. The group control microcomputer 1S, the network transmission controller S17C1, the uncontrolled data transmission controller S17C2 and the group control I/O transmission controllers S17H1 to S17H3 are connected, through bus lines L17H1 to L17H3, to buses 3*b*1 to 3*b*3, so that these equipments serve as backup equipments for backing up the group-control controller 10M. The backup operation thereof can be automatically switched on the basis of the result of self-diagnosis in the microcomputer 1G and the result of diagnosis of trouble in hardware circuits. On the other hand, the respective elevator controllers 10*a*1 to 10*a*3 are composed of: microcomputers 1*a*1 to 1*a*3 provided corresponding to the number of elevators; network transmission controllers 17*a*1 to 17*a*3 connected thereto and using two transmission/reception circuits corresponding one transmission controller; and elevator I/O transmission controllers 2*a*1 to 2*a*3. The elevator I/O transmission controllers 2*a*1 to 2*a*3 are connected, through the buses 3*b*1 to 3*b*3, to the terminals 4*c*1 to 4*c*3, 4*d*1 to 4*d*3 provided in the respective floors for every elevator. Further, the elevator I/O transmission controllers 2*a*1 to 2*a*3 are connected, through the buses 3*b*1 to 3*b*3, to the terminals provided in the intra-cage operation panels.

The control data transmission between the No. 1 elevator controller 10*a*1 and the group-control controller 10M in the elevator group control system using three elevators is described with reference to the timing chart of FIG. 21.

Figure 21:
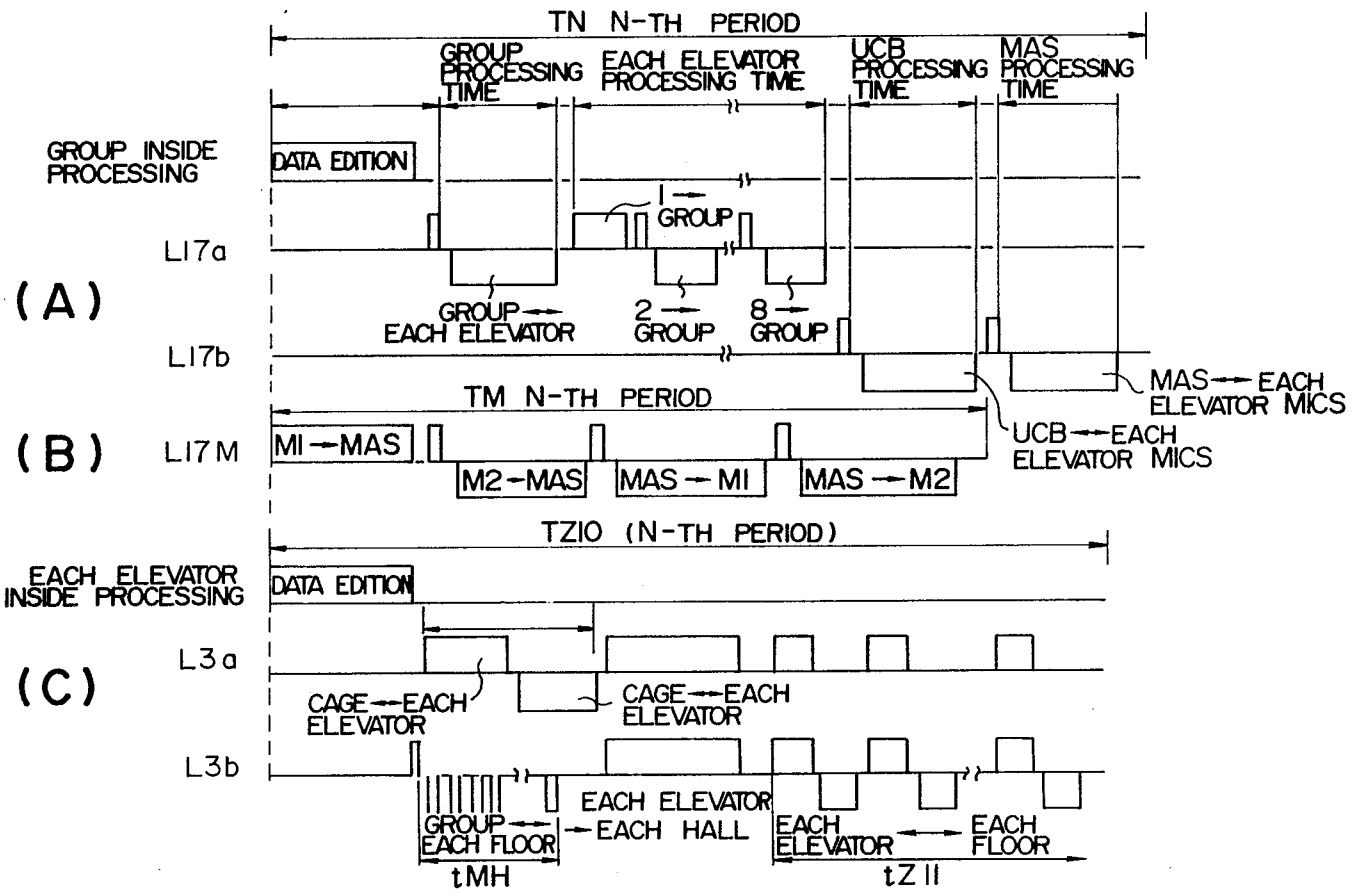
FIG. 21 is a time chart illustrating the operation of the group-control elevator system shown in FIG. 19.

The elevator I/O transmission controller 2*a*1 in FIG. 19 performs data transmission/reception with the terminals 4*c*1, 4*d*1 and the intra-cage terminal through the buses 3*a*1 to 3*b*1 as described above with reference to FIG. 13, periodically by the polling selection method as shown in FIG. 13 and successively as shown by L3*a* and L3*b* in the timing chart of FIG. 21(*c*).

While the data transmission is carried out, lighting control signals for lighting hall lamps 8*a*1, 8*b*1, 8*c*1 and 8*d*1 (as shown in FIG. 19) connected from the elevator I/O transmission controller 2*a*1 to the terminals 4*c*1 and 4*d*1 through the bus 3*b*1 and signals for controlling chimes (not shown) and the like are sent out in the hall side. On the contrary, in the terminal side, input signals of hall operation panels (hereinafter called "hall buttons") 5*a*1, 5*b*1, 5*c*1, 5*d*1 connected to the terminals 4*c*1 and 4*d*1 are sent out to the elevator control microcomputer through the DPRAM of the elevator I/O transmission controller 2*a*1 in the reverse course.

At the same time, the group control I/O transmission controller M17G1 of the group-control controller 10M receives, in the form of tapping, the input signals of the hall buttons 5*a*1, 5*b*1, 5*c*1, 5*d*1 sent from the terminals 4*c*1 and 4*d*1 onto the bus 3*b*1. The signals are inputted into the host controller 1G so that the procedure of registering hall buttons is carried out. As this result, the host controller 1G transmits reversely the output signals (answer lamp lighting signals) of the hall buttons 5*a*1, 5*b*1, 5*c*1 to the group control I/O transmission controller M17H1. Furthermore, the host controller 1G transmits information of service floor assignment from the network controller M17C1 to the network transmission controllers 17*a*1 to 17*a*3 through the bus L17*a* corresponding to the three elevators.

As shown by L3*a* in the timing chart of FIG. 21(*c*), while signals are transmitted from every terminal, the signals are not sent to the bus 3*a*1 between the elevator I/O transmission controller 2*a*1 and the intra-cage terminal so that the bus 3*a*1 is in a vacant state. On the other hand, data transmitted from the elevator is also delivered to the transmission line in the cage so that the intra-cage indicator is permitted to indicate the same information as in the hall or information of stop floors through the hall-call button.

Then, because the elevator I/O transmission controller 2*a*1 performs data transmission/reception with the intra-cage terminal through the bus 3*a*1 in the same manner as in the hall side, the bus 3*b*1 is in a vacant state during the time zone tZC reversely. While the bus 3*b*1 is in the vacant state, call-input signals given through the DPRAM of the transmission controller M17H1 prior to the host controller 1G or 1S of the group-control controller 10M or 10S and formal reply instruction output signals against the hall buttons 5*a*1, 5*b*1, 5*c*1, 5*d*1 (for example, answer lamp on-and-off lighting signals and information instruction codes such as "SERVICE IMPOSSIBLE") are sent from the transmission controller 17H1 to the terminals 4*c*1 and 4*d*1 through the bus 3*b*1. Accordingly, the bus 3*b*1 can be used efficiently by the factor of time tMH. Accordingly, the time per period, required for polling selection of the terminals 4c1 and 4d1 and the intra-case terminal in the elevator I/O transmission controller 2a1, can be shortened. As this result, the answer lamp lighting control against the operation of the hall button can be carried out so rapidly that the user does not feel the lag in response time.

Further, in this embodiment, one terminal 4c, 4d is provided for every two floors. Compared with the case where one terminal is provided for every floor, the time perperiod required for polling selection of the intra-cage terminal and the hall terminal in the elevator I/O transmission controller 2a1 can be shortened by half the time tZH. Further, in the case where the method of arranging one terminal for every 3 or 6 floors is applied to an elevator having a service area of high floors, the effect brought by the method is that data communication between the elevator I/O transmission controller and the terminal can be carried out rapidly with prevention of the increase of time.

In the construction of the buses as described above, the bus L17a is used for data transmission/ reception between the transmission/reception circuits a of the network transmission equipments respectively incorporated in the group-control controllers 10M, 10S and the elevator controllers 10a1 to 10a3. On the other hand, the bus L17b is used for transmission/ reception of information data (such as maintenance and management data and display data) between the other transmission/-reception circuits b of the network transmission equipments respectively incorporated in the maintenance terminal equipment 10H, UCB10U, the group-control controllers 10M, 10S and the elevator controllers 10a1 to 10a3.

As shown by L17a (control data transmission) and L17b (information data transmission) in the flow chart of FIG. 21(*a*), the bus for elevator operation control data and the bus for information data are separated from each other, so that the elevator operation control is little affected even if abnormality occurs in the maintenance terminal equipment 10H or UCB10U or even if mistaken information data are transmitted onto the bus.

Further, when a trouble such as breaking of wiring occurs in the bus L17a provided for transmission/ reception of elevator operation control data, the elevator operation control can be continued by transmitting elevator operation control data onto the information bus L17b. In this case, the right for transmitting data is not transferred to UCB10U and the maintenance terminal equipment 10H while the terminal equipment is made only to monitor (receive) data.

Further, in the construction of this system, elevator service floor assignment control is carried out in accordance with the answer lamp lighting control of the hall button (5a1 or the like) and the occurrence of hall-call. In the case where elevator operation control data cannot be delivered to the elevator controller (10a1 or the like) because an abnormality occurs both in the group-control controller 10M and in the group-control controller 10S having the function of backing up the equipment 10M, the abnormality is detected by the microcomputer (1a1 or the like) included in the elevator controller (10a1 or the like) to thereby carry out the answer lamp lighting control of the hall button (5a1 or the like).

At the same time, the microcomputer (1a1 or the like) transmits input information of the hall button (5a1 or the like) onto the bus L17a through the network transmission controller (17a1 or the like) to thereby transmit the information to other elevators. Accordingly, lowering of elevator operation service can be minimized against the occurrence of abnormality of the group-control controllers 10M and 10S.

As described above, according to the construction of this system, the following effects can be attained.

(1) The input/output control of the hall button (5a1 or the like) can be made speedily;

(2) The system can be applied to an elevator having a service area of high floors by arranging one terminal (4c1 or the like) for every 2 or 6 floors;

(3) The backup function can be improved against the occurrence of abnormality of the controllers and the like related to the operation of the elevator; and the like.

FIG. 22 shows indicators provided in the landing place on the 6th floor in a building having three elevators. In FIG. 22, D6F1, D6F2 and D6F3 represent indicators arranged in a portion above the landing place of No. 1 elevator, No. 2 elevator and No. 3 elevator, 6FU1 and 6FU2 represent upward buttons, 6FD1 and 6FD2 represent downward buttons, Dt11 to Dt15 represent the timing for explaining the change of the display condition of the indicators D6F1 to D6F3.

In the following, the operation in this example is described.

The display timing Dtll shows the condition that there is no person waiting for the elevator on the 6th floor or in other words shows the condition that there is no hall-call.

In this example, calendar information such as time and data as shown by D11a, commercial information or current service information (for example, display of discrimination between service floor and not-service floor) is displayed on the indicator of the elevator farthest from the 6th floor by display control means such as display selection, display switching and fluidal display. In the case where a method of displaying such common information on the same indicator for a long time as possible is selected, it is necessary to select the indicator based on the prediction of arrival of every elevator and the position of the cage. In the indicator of another elevator, the position of the cage is displayed as shown by D11b and D11c . In FIG. 22, D11b shows the fact that the No. 2 elevator is in the vicinity of the 5th floor. By scrolling the portion SD vertically, running of the elevator can be indicated. The speed of the elevator can be expressed by the speed of scrolling. The portion SD is scrolled up when the elevator is moving upward. The portion SD is scrolled down when the elevator is moving downward. Accordingly, the direction of running of the elevator can be expressed. In FIG. 22, D11c shows the fact that the No. 3 elevator is stopping on the 2nd floor. By changing the width of the portion DD corresponding to the opening and closing operation of the door of the elevator, the opening and closing of the door on the 2nd floor or the getting on and off of users can be expressed.

The display timing Dt12 shows the case where the degree of satisfaction in general estimation and information estimation for attaining a plurality of service targets of the assigned elevator is low when upward hall-call occurs on the 6th floor. In this case, the message "WAIT A BIT" is displayed on all the indicators D6F1 to D6F3. As shown clearly in FIG. 22, the message can be read by looking the three indicators totally at a glance or can be read by looking the three indicators separately. Therefore, it is necessary to transmit the display starting instructions to the three indicators at once from the user command board (10U). Therefore, messages, display picture elements and display control methods as well as a transmission specification (protocol) in the indicator are registered in advance. In particular, the method as shown in FIG. 22 is characterized in that display is started while display offset values are shifted by 3 characters (48 or 72 dots) corresponding to the elevator number.

The display timing Dt13 is at the point of time when arrival prediction time is shortened to a some degree. The arrow display of D13*d* and D13*e* shows the the fact that the No. 2 elevator is designated. Attention is stimulated by blinking display as well as the sound of chimes. The display D13*f* shows registration corresponding to cage-call. The cage-call registration is discriminated from hall-call registration by changing the display. While the display timing is shifted from Dt12 to Dt13, synchronization between the indicators in the same floor and in the same side is particularly important. This synchronization cannot be controlled by a general transmission procedure. Accordingly, the transmission procedure must be constructed so that a plurality of stations can receive a signal at once and can execute their own corresponding display instructions. The display D13*b* of D6F2 shows the fact that there are people getting on and off on the 5th floor. The display D13*a* shows waiting time by painting the inside of the triangle in the direction of service of the elevator. In this case, the prospective arrival time is stagnated because there are people getting on and off on the 5th floor. While the prospective arrival time is stagnated, wavy display is carried out. It is presumed that the prospective arrival time or arrival floor difference or arrival stroke difference just reaches a predetermined value and the waiting time is not shortened rapidly because of the opening and closing of the door. Accordingly, the wavy display in the bottom side of the triangle is continued. If the service direction is downward, the triangle is displayed reversely. The display D13*c* shows crowdedness by painting the doll. When the doll is painted up to its head, it expresses "Full".

The display timing Dt14 shows the fact that lowering hall-call 6FD1 or 6FD2 is registered during service information of raising hall-call. The indicators D6F1 and D6F3 serve notice on DN waiting persons that a service schedule (elevator and time) cannot be displayed (probably, the persons must wait for a long time). As a display method, fluidal display of the message "WAIT A BIT" on G6F1 and D6F3 may be used in the same manner as in the display timing Dt12. As another display method, animation display, for example, using a slowing walking turtle, may be used if necessary. These display methods can be freely selected by users through the user command board (10U) or a personal computer connected thereto and can be freely switched corresponding to the service information condition or the level of skillness. It is now assumed that the No. 2 elevator in FIG. 22 stops at the 5th floor, stops at the 4th floor and then comes to the 6th floor. In this case, D14*b* shows the condition that the No. 2 elevator is to reach the 4th floor, so that the portion SD is scrolled down. D14*a* shows the fact that the prospective arrival time is shortened by some degree. D14*c* shows the fact that crowdedness is reduced because of the getting off of some persons.

In the display timing Dt15, D6F1 shows the fact that information for lowering hall-call was given to the No. 1 elevator lowering hall-call. D15*a* is a display in the bottom side of the triangle because the prospective arrival time is not less than a predetermined value. On the other hand, D6F2 shows the condition that the No. 2 elevator is to reach the 6th floor. D15*b* flickeringly emphasizes the fact that the elevator will come soon. Because the elevator comes from the 4th floor, the portion SD of D15*c* is scrolled up. D15*d* shows the fact that crowdedness is increased because of the getting on of persons at the 4th floor. Accordingly, the group management and control equipment 1G makes a decision that all the waiting persons on the 6th floor cannot get on the No. 2 elevator, so that the group management and control equipment 1G designates the No. 3 elevator additionally. To display the fact in the landing place, the display of D6F3 is started.

The message display in the display timing Dt12 and the arrow display in the display timing Dt13 are carried out only when the corresponding elevator is out of service operation. A method of displaying two elevators in the side of the hall button operated can be also selected through the user command board (10U).

In the following, the operation of the second embodiment is described with reference to FIG. 23. This embodiment is provided on assumption that the elevator control system is used in a building (exclusively possessed by one business organization) which satisfies the condition that users are more or less skillful.

Also in this case, indicators provided in the landing place on the 6th floor in the building having three elevators are shown. The display timing Dt21 to Dt25 shows the change of the display conditions of the indicators D6F1 to D6F3.

The display timing Dt21 shows the condition that there is no hall-call. Time and blink D21*a* placed between hour and minute and having a period of 1 second or $\frac{2}{3}$ seconds or $\frac{1}{2}$ seconds are displayed on the indicator of an elevator suitable for the occurrence of hall-call at this floor. Nothing is displayed on the indicators of other elevators to thereby attain energy saving and extension of lifetime of the indicators. In particular, this mode can be used as a night/holidy service information mode or as a display mode for a classic building. The storage of selection condition and information mode and the control of executive command can be made through the user command board (10U). Further, this mode can be used effectively as a display mode of indicators provided in elevators in the case where the number of elevators or the number of service floors is small. Furthermore, this mode can be used effectively as a display mode of indicators set up on floors in the vicinity of the end of the service area of elevators in which high call return or low call return is repeated. Even if the building is a prefectural office building or a hotel building in which skillfulness of users is not so high, the display mode can be selected through the user command board individually for every floor corresponding to the demand of users. When it is estimated that down-call occurs frequently at the 6th floor judging from the knowledge of traffic density in the past, information of time, commercial and the like is displayed on an elevator fit for down-call service. When it is estimated that down-call and up-call occur half by half, an elevator capable of serving for both directions and minimum in total estimation is selected.

The display timing Dt22 shows the condition that hall-call occurs. The elevator staring floor number display by the indicator is a service elevator. In this case, the No. 2 elevator is designated, by which users can understand that the No. 2 elevator is a service elevator. The display D22*b* of the indicator D6F2 shows the fact that the No. 2 elevator is running in the vicinity of the 6th floor. The display D22*a* shows the fact that the designated elevator will move up once and take a U-turn. Accordingly, waiting persons can wait without anxiety though the door of the elevator is not opened. The display D22*c* shows waiting time. If the No. 2 elevator serving for down-call is excluded, the No. 3 elevator satisfies the optimum condition (for example, the condition that the No. 3 elevator will come soonest) so that time is displayed as shown by D22*d*.

In the display timing Dt23, the indicator D6F2 shows the fact that there are persons getting on and off on the 8th floor. The display D23*a* indicates the direction of operation of the elevator by means of paining the inside of the U-shaped figure gradually. Because, in this case, it is assumed that the elevator will take a U-turn at the 8th floor, the inside of the figure is painted up to the middle thereof. The display D23*b* shows the fact that prospective arrival time is shortened compared with D22*c*.

In the display timing Dt24, the indicator D6F2 shows the fact that the elevator will reach the 6th floor soon. In the display D24*a*, the inside of the figure is entirely painted because the elevator is just to come to the 6th floor. The display 24*a* is flickering to emphasize the arrival of the elevator. In the display D24*b*, the display of prospective arrival time is erased because of useless. In the case where there are some persons getting off the case (judging from the cage-call or the weight of the cage), the display D24*b* serves notice on the waiting persons in the landing place that some persons will get off the cage by means of animation using dolls. Although this embodiment has shown the case where the display of waiting time is erased, erasing the display of waiting time is not always required. For example, both the figure of waiting time and the figure of doll may be displayed with green and red, respectively. Or an arbitrary portion of the figure of waiting time may be erased to black so that the figure of doll can be inserted into the erased portion. Such display control can be executed by display macro definition statement. Let the basic figure expressing floor or cage be displayed with green. Let the figure expressing persons getting off be displayed with red. Further, by controlling a main operation panel and a sub operation panel separately, the number and position of persons getting off can be expressed. In short, when there is a person getting off from left (judging by ITV sensor or the like), the figure of doll is displayed in the left side of the figure of cage and then animation display of moving the figure of dool to right is repeated three times (in the case of crowded cage) or is carried out once slowly for 2 or 5 seconds. When there are possibly persons getting off from both sides, dolls are displayed at both sides for 1 or 2 seconds and then moved to right or to both sides (before or after chiming).

The display timing Dt25 shows an example of display after the service of the No. 1 elevator to the 6th floor is newly determined by pushing a down hall-call button 6FD1 or 6FD2. In this case, the indicator D6F1 of the No. 1 elevator informs the hall that the No. 1 elevator serves for down hall-call. The display D25*a* shows the fact that the No. 1 elevator will come to the 6th floor directly without U-turn operation. Accordingly, a straight arrow or a downward triangle for representing the direction of service is displayed instead of the curved arrow for representing a U-turn. The indicator D6F3 of the No. 3 elevator shows the fact that persons can get on the elevator reaching the 6th floor (there are no persons getting off). In the display D25*b*, the inside of the figure is entirely painted as the elevator takes a U-turn.

As described above, it is necessary to decrease the transmission volume of display executive-control command but increase the transmission speed thereof. It is, therefore, necessary to transmit basic graphic figures and the like at an initial stage or store them in a CTAM or EEPROM in advance. If abnormality of the display control command is caused by instantaneous power failure or noise, these stored data are not secured. Accordingly, those stored data are diagnosed as follows. The order of ACK is given periodically by the host (user command board 10U) so that indicator error codes, registered NOFLAG-group tables and abnormal NOFLAG-group data are returned. On the basis of the codes, tables and data, initialization of abnormal stations is executed (16-byte data, 256-byte text, 8-KB transmission) using free time of operation of the elevators and free time when changed signals are little.

FIGS. 24A and 24B show another example of watchdog timer (WDT) circuit similar to the WDT circuit 240 of FIG. 1 or the WDT circuit of FIG. 4 composed of an electric source control circuit 415 and a memory 414. The WDT circuit of FIGS. 24A and 24B is used effectively in terminal equipments having a door opening/closing control function particularly in need of safety, such as the cage terminal equipments 6 and 13 and hall terminal equipments 4*a*. The WDT circuit not only detects abnormality of terminal equipments to request retry of microcomputer, but prevents overall elevator system down caused by function down of the overall common transmission line caused by unnecessary transmission with respect to the transmission line. In addition, the WDT circuit suppresses the output as shown in FIG. 4 by hardware to attain safety of the system. In the following, the operation of the WDT circuit is described with reference to the time chart of FIG. 25 in conjunction with the terminal-side processing flow chart of FIG. 10.

As the period of transmission/reception between the transmission controller 2 and external equipments is set in advance, the CPU (200, 400, 600) judges the period of TWa by Step 154 to perform reception processing S200 and input-output processing (S400A to S400C) whereafter the CPU sent out a WDT pulse signal a (Step S136 in FIG. 10) under the condition that a retry signal (S133) from the host controller is absent.

Then the pulse signal a changes from "1" to "0" at the time t1. The change of the pulse signal is detected by a multi-vibrator IC30, so that signal "1" is sent out as the output signal al of the multi-vibrator during the period of pulse width TPW1 determined by a resistor R1 and a capacitor C1. Then the pulse signal a1 changes from "1" to "0" at the time t2. The change of the pulse signal is detected by a multi-vibrator IC30, so that a pulse signal is sent out as the output signal a2 of the multi-vibrator during the period of pulse width TPW2 determined by a resistor R2 and a capacitor C2.

On the other hand, a pulse b is sent out (in the steps S142 and S151) after a judgment is made in the step S139 as to whether the transmission specification (protocol) of its own station is normal (the judgment requiring TWab).

The periods TPW1 and TPW2 are set so that the pulse signal b can be sent out while the multi-vibrator IC31 generates the signal "1" during the period of TPW2 from the time t2.

A pulse signal b2 with a pulse width determined by logic circuits IC10 and IC20 and a resistor R11 and a capacitor C11 based on the pulse b is sent out at the time t3.

An AND gate IC21 ANDs the signals a2 and b2 and a NOT signal a obtained by passing the pulse signal a through a NOT gate IC1, so that the AND gate IC21 generates a pulse signal a3 similar to the pulse signal a2. The falling edge of the signal a3 is detected by a multi-vibrator IC32 so that a pulse signal a3 with a time width of TPW3 is generated. When the time width TPW3 is established to be sufficiently longer than the processing period TWa (processed in the step S154), the pulse signal a3 does not fall to "0".

While the signal a3 is "1", the multi-vibrator IC34 is in a reset state (R). Accordingly, the signal a5 takes "1".

Because "1" is given to $\overline{\text{RESET}}$ of the CPU 200, 400 or 600 from the signal a5, the CPU makes a judgment that the operation is normal.- Accordingly, the processing is continued.

When a pulse a after the next time t4 from the CPU (200, 400, 600) and a pulse signal b are sent out within the period TPW3, the signal a3 takes "1" continuously. The time width TPW3 is determined by a resistor R3 and a capacitor C3 so that the time required for continuing "1" generated in the previous period can be secured.

As described above, according to this circuit, the CPU is not reset as long as the pulse signals a and b are generated normally in a predetermined period. Accordingly, the operation can be continued. Because the signal of "0" is stored as a transmission-permission signal in a memory IC36 when the power supply is turned on, the transmission-permission signal TXEN takes "0" so that a transmission-disabled and reception-enabled state is continued.

On the other hand, in the case where the pulse a is not generated after the time t4 because of the occurrence of abnormality in the processing by microcomputer, the signal a3 changes to "0" at the time t5 with the passage of time of TPW3 because the pulse (the same as the signal b2) of the signal a3B is not regenerated as described above. By the change of the signal, the transmission-permission signal of the memory circuit IC 36 is cut. At the same time, a negative pulse signal a5 with a pulse width TPW4 is generated from the one-shot multi-vibrator IC34 through the falling detection circuit IC33 to reset the CPU. The generation of the signal a5 is released at the time t6.

If the abnormality of the microcomputer is temporary caused by voltage reduction or noise, the CPU completes restart processing while the signal a6 of "1" is generated from the IC35 during the period TPW5 determined by the resistor R5 and the capacitor C5. As this result, generation of pulses a and b can be restarted.

The transmission-permission signal TXEN cut by the operation of the WDT circuit at the time of powering-on changes from a transmission-disabled state to a transmission-enabled state at the time t8 as follows. When the pulse c is sent out (step S148) from the CPU in synchronization with the pulse b, a reset signal is generated from the AND circuit IC50 on the basis of the signals obtained by the rising detection circuit 41 (R12, C12, IC3, IC21). As this result, the memory circuit IC36 is reset so that transmission is enabled at the time t8.

As described above, according to this circuit construction, abnormality in operation of the program caused by failure of resetting of reception IRQ or noise can be detected through two periodic signals. Further, when such an abnormality occurs, the CPU is rest rapidly and, at the same time, transmission is cut by hardware to prevent the influence on other terminals connected to the common transmission line to thereby improve the system in reliability and ability of self-recovery.

Further, a function for repeating restarting between the point of time that a predetermined time is passed after the occurrence of abnormality and the point of time that the abnormality is corrected, is carried out by the multi-vibrator IC35 and the falling detection circuit IC40 to thereby give self-recovery power against function down (function failure) caused by temporary voltage reduction at some terminal. Accordingly, lowering of service for users can be limited to a temporal range or to a minimum terminal area.

Figure 26:
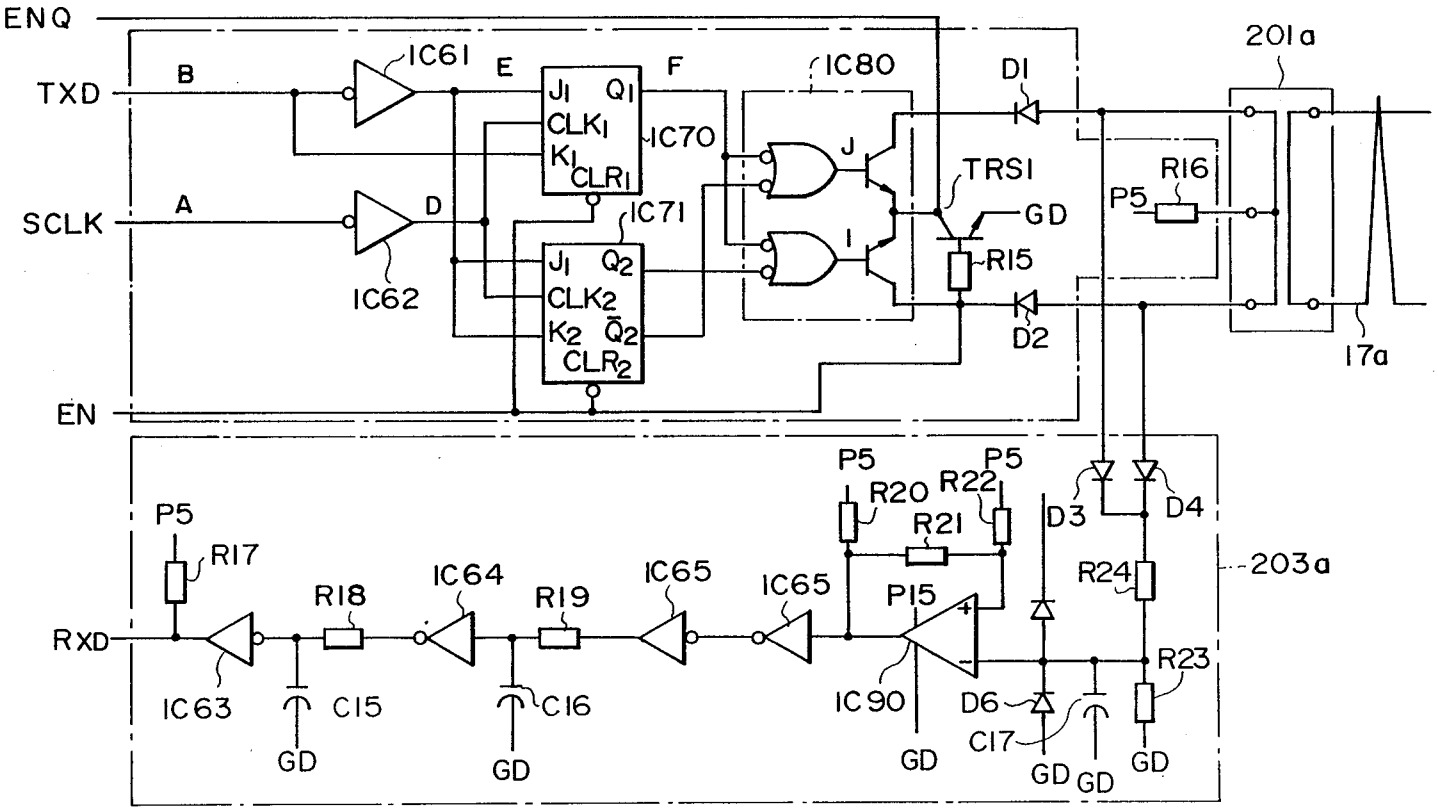
FIGS. 26 and 27 are diagrams illustrating an example of the construction of an abnormality detection circuit used in the input/output terminal equipment and a time chart illustrating the operation thereof.

FIG. 26 shows a specific embodiment showing the construction of a circuit having the transmission circuit 202*a* and the reception circuit 203*a* as shown in FIG. 1. The operation of this circuit is described with reference to the timing chart of FIG. 27. The timing chart shows the case where a one-byte data in conjunction with even parity is transmitted during the period between the time t1 and the time t4.

In the following, the operation of the circuit up to the step of obtaining a transmission signal $\overline{\text{TXD}}$ (waveform B in FIG. 27) from a pulse transformer 201*a* is described with reference to the timing chart. The data TXD (E) is latched at the falling edge of a synchronization clock signal $\overline{\text{SCLK}}$ (D) by a d-type flip-flop circuit (d-type bistable circuit) composed of an inverter IC61 and a JK fli-flop circuit (JL bistable circuit) IC70, so that the transmission signal $\overline{\text{TXD}}$ (B) is sent to $Q_1$ (F) At the same time, the transmission signal $\overline{\text{TXD}}$ (B) is inverted at every falling edge of the synchronization clock signal $\overline{\text{SCLK}}$ (D) by a t-type flip-flop circuit (t-type bistable circuit) composed of the inverter IC61 and another JK flip-flop circuit (JK bistable circuit) IC71, during the period (for example, $T_{23}$) where the input signal TXD (E) is kept in an H-level state. As this result, the state of the output $Q_2$ (G) and the state of the output $\overline{Q_2}$ (H) are inverted alternately. Then, the thus latched output signals $Q_1$ (F), $Q_2$ (G) and $\overline{Q_2}$ (H) are NANDed by an IC80 to obtain signals (I) and (J). The signals (I) and (J) are fed respectively to the bases of pulse transformer 201*a* driving transistors which are incorporated in the IC80.

Figure 27:
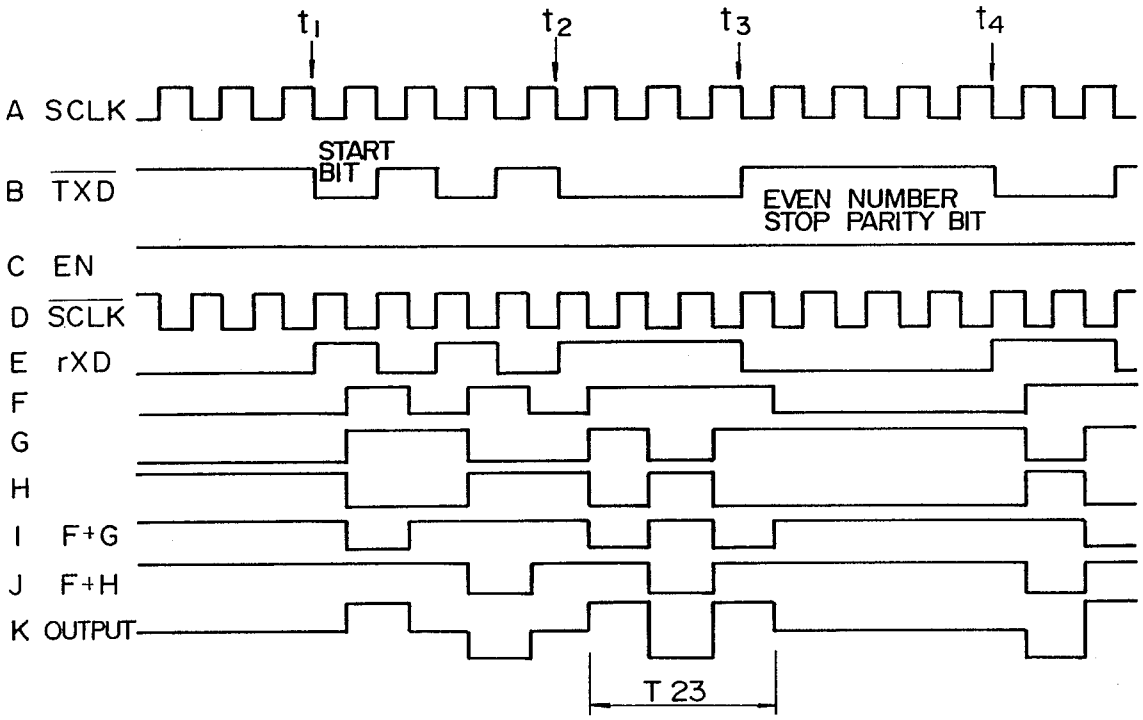

According to the aforementioned construction, the signal fed from the pulse transformer 201*a* to the transmission line 17*a* is bipolar-modulated as shown by the signal (K) of FIG. 27, by which a current alternately inverted for every one-bit data is passed through the pulse transformer 201*a* even in the case where the L-level state of the transmission signal $\overline{\text{TXD}}$ (B) is continued by three bits during the period $T_{23}$ as shown in the timing chart. As this result, overlapping of directcurrent component to the pulse transformer 201*a* can be prevented. Accordingly, because saturation of the pulse transformer can be prevented by bipolar-modulation of the transmission signal in accordance with the aforementioned method, a small-size and low-cost pulse transformer can be used herein.

In the following, the reception circuit 203*a* is described with reference to FIG. 26.

The signal on the transmission line 17*a* is induced onto the secondary side of the pulse transformer 201*a*. The thus induced signal is full-wave-rectified by diodes D3 and D4 so as to be fed to a comparator IC90. Then the output signal of the comparator is passed through a delay circuit composed of resistors (R19, R18) and capacitors (C15, C17) for removing an unnecessary component to thereby obtain a reception signal RXD.

By constructing the transmission/reception circuit as shown in FIG. 26, failure of the transmission line 17*a* can be diagnosed even in the transmitter station side. In short, when the data of transmission signal K as shown in FIG. 27 is transmitted, the same data is received by the reception circuit at the same time. By reading and collating this signal immediately, troubles, such as short-circuit failure of the transmission line 17*a*, collision of the transmission signal with the signal from another station and the like, can be detected. Of course, all of other stations connected to the transmission line 17*a* by bus have transmission/ reception circuits constructed in the same manner as described above. Accordingly, the same signal can be received by each station simultaneously with the transmission thereof, so that the aforementioned trouble or failure can be detected.

The problem herein is that, when the power transistor of the signal transmission IC (IC80) in some station other than the operating station is operated carelessly by abnormality of the transmitter portion single or inclusive of the microcomputer portion, the impedance of the transmission line 17*a* becomes so low that the transmission signal cannot be transmitted in the normal level and, accordingly, data cannot be received by the receiving station. To solve this problem, there is provided a transistor TRS1 capable of being conductive only when a signal EN produced on the basis of the transmission-permission signal TXEN and the like is in an H-level state. Accordingly, double backup by hardware can be attained to prevent the aforementioned trouble or failure. Further, a signal $\overline{\text{ENQ}}$ for diagnosing the conductive failure of the transistor TRS1 is inputted into the transmission microcomputer. Accordingly, failure diagnosis for reporting the presence or absence of abnormality to the host controller can be made.

FIG. 28 shows network transmission extension DPRAMs exclusively used in the group management and control equipments 10M and 10S.

Table structures of five types as shown in the output tables NOUT1 to NOUT5 are mainly employed in the group control microcomputer 1G. Data on the tables are assorted for every elevator and for every transmission block, thus to prepare transmission tables NTX (Bn, Kn, n). In the case where data are different in transmission specification and transmission period, the data are separated. For example, the elevator-protocol data (service floor, the floor pitch, the rated elevator speed, presence or absence of a special passenger capacity specification, the kind of information display, the information display set-up floor and the like) and the on-line control data (a hall-call, a designation-hall-call, a cage position, a guiding cage position based on foresight of the condition of the elevator about 0.1 seconds from now or about 1 second from now about the elevator progressing from the prior floor, the guiding service command and the like) are transmitted while those data are discriminated from each other.

In the past, there has been no idea of transmitting elevator specification. If a large number of user command boards 10U as elevator individual control terminal equipments are set up in various places such as a building manager's office, a machine room, a hall, a front desk and the like, and, at the same, software (which means elevator specification, here), EEPROM 194 as shown in FIG. 44 and the like are designed or produced for every place in order to attain an improvement in economics and reliability due to the effect of mass-production, there arises the possibility of bringing about a serious trouble by mistakes such as a specification error (discord) and the like.

FIG. 29 shows a transmission control program N100 which is started by restarting CPUs 207, 405 and 605 used in all the transmission control microcomputers and which exists in mask ROMs 209, 407 and 607 used for storing an entirely standardized program.

Figure 30:
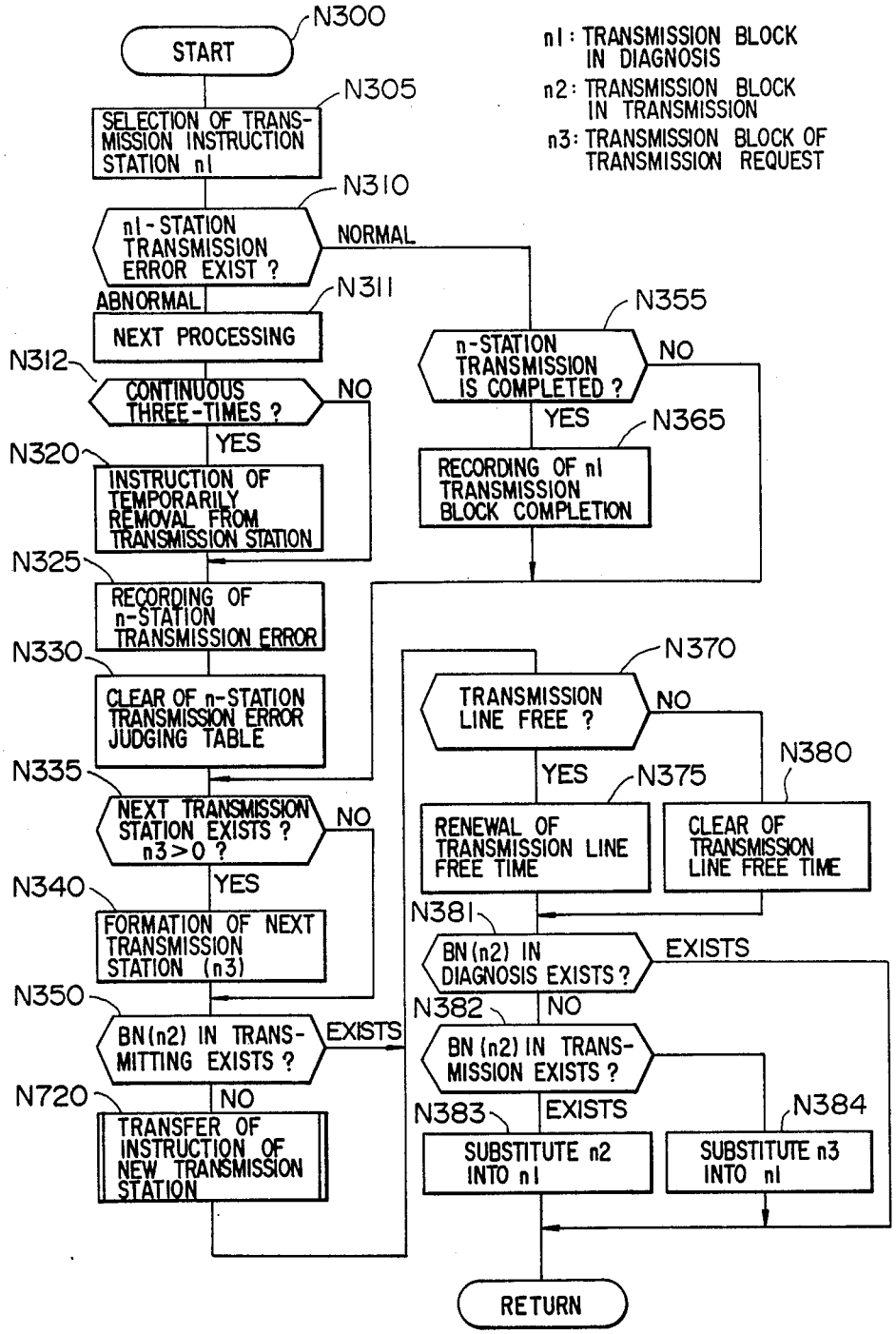

The elevator transmission controllers 17*a*1 to 17*a*3 connected to the network transmission line L17*a* are set as transmission control stations (step N300), so that transmission is continued efficiently as shown in FIG. 21(*a*) by the network transmission line control processing I (step N300) as shown in detail in FIG. 30 and, at the same time, a measure counter to the occurrence of abnormality is taken.

In FIG. 30, the progress of each transmission block is judged. When the transmission of a block n1 which was in progress in the past is terminated normally (N305, N310, N355), data such as the transmission-terminated station number RNK, the completion flag RF1 to be delivered to the completion station K, the maximum transmission time TM1 (each station) and TM2 (total block) obtained in the past and used for margin check in the future and the like are stored in corresponding one of columns NWCT1 to NWCT15 in a transmission control table as shown in FIG. 40D (step N465).

Further, a judgment is made as to whether the next transmission block n3 is decided or not (N355). A transmission block having maximum priority (TXPR) is selected from transmission blocks having a transmission interval TM1 larger than the transmission period specification value TXNTM and is decided as n3 (N340).

Figure 33:
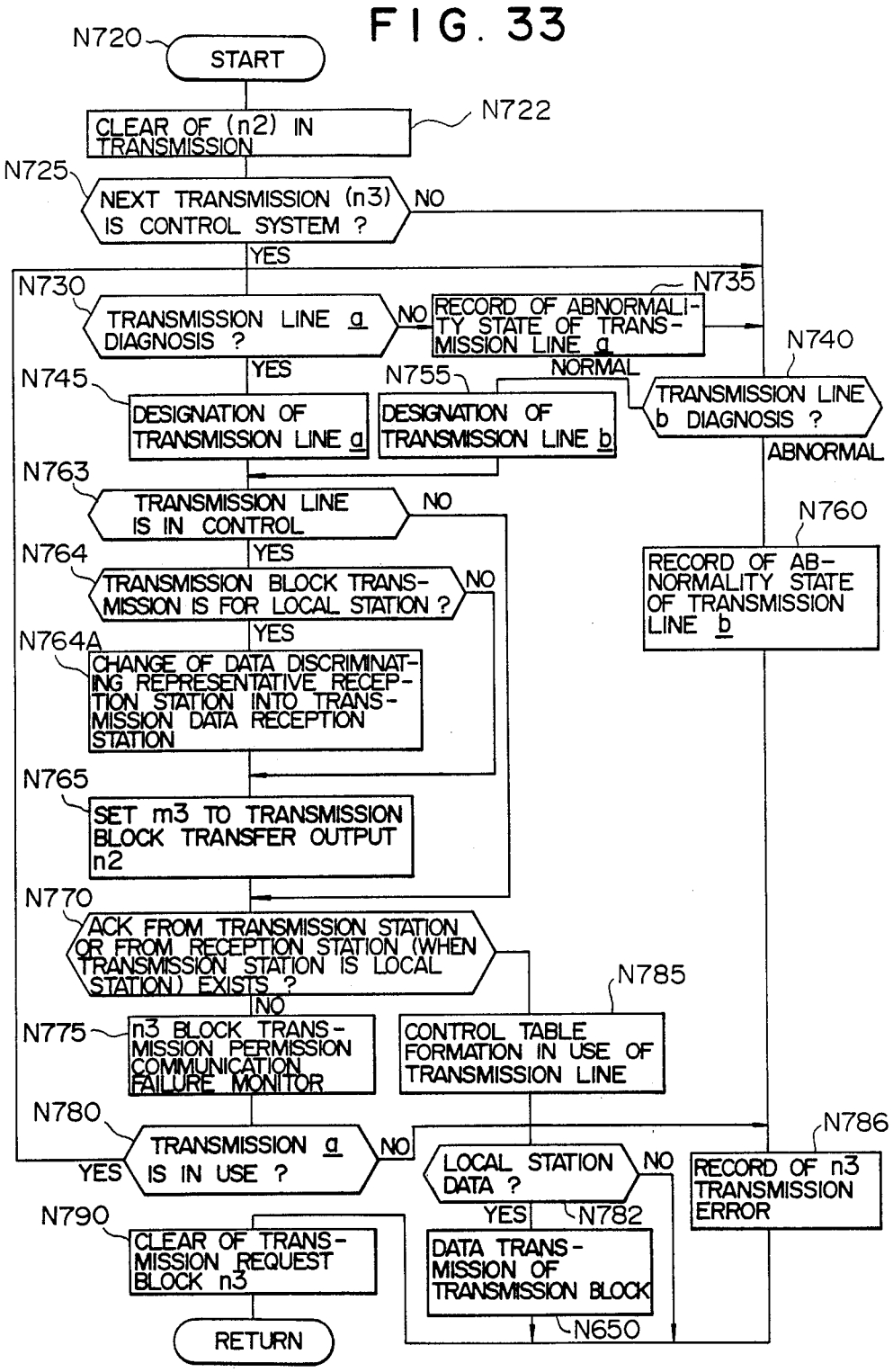

When there is no designation of the transmitting block number n2 (N350), for example, in the case where transmission control starts newly, transmission block command transfer processing as shown in detail in FIG. 33 is carried out to generate a transmitting block number n2 (N785).

To judge during transmission line free time that transmission is interrupted by occurrence of some trouble after transmission of a transmission block starts once through the transmission line L17 (steps N745 to N785), a time updating procedure in the steps N370 to N380 and a time-over judgment procedure using abnormality reference time ERTM or time margin MTiM in the transmission specification NWST in the step N310 are executed. If the same transmission block is judged to be abnormal three times continuously, temporary exclusion of the transmission block is designated to solve transmission lag after that (N312 and N320). Further, the situation herein is recorded in error columns ERC1, ERC2 and the like of the table NWCT (N325).

In the following, a method of generating a transmission controlling flag is described with reference to FIG. 34.

This program is executed periodically as part of the elevator control program as shown in FIG. 6C. A judgment is made in the step C705 as to whether the elevator (controller) is suitable as a control station or not. A judgment is made in the step C710 as to whether the transmission line free time is over a predetermined value LTM (variable according to the elevator) or not. The absence of any transmission control station is detected, so that one's own station declares oneself control station (C715) and makes an instruction to carry out initializing transmission (C720). Further, the procedure from the step C725 to the step C776 is repeated for every transmission block, so that the diagnosis of abnormality and judgment of retry period (C740, C745) and the retry timing (C750) are carried out. To make retry, the exclusion designation set in the step N320 in FIG. 30 is canceled (C755).

Further, in step C705, when normal passenger service is impossible because of failure or maintenance operation, designation of control station cannot be made because the transmission control-enable command is "0", but the designation of control station decided once is left as it is. However, if abnormality of the transmission equipment 17*a* is detected (C780), the designation of control station is cleared up (C785).

FIG. 31 shows a program common to all the stations, the program being started by interruption processing of the transmission control CPUs 207, 405 and 605 and being provided in the form of a mask ROM.

First, a reception factor is judged (N510). When the reception factor is reception interruption, network transmission is judged in the steps N514 and N516 on the basis of the fact that the hardware number HKNO in Table 2 is one of the range of from $0 to $2 and the transmission station assortment KiND is one of the range of from 6 to 8. Then transmission processing (N650) attendant on reception of the transmission block is carried out in the steps N528 to N538. This transmission processing is executed and completed simultaneously and in parallel to the transmission processing of the transmission block in the step N720 in FIG. 40. In this case, the transmission mode RPC6 as shown in FIG. 40 is used as the transmission specification. Other specifications are all provided in the form of a program.

Figure 35:
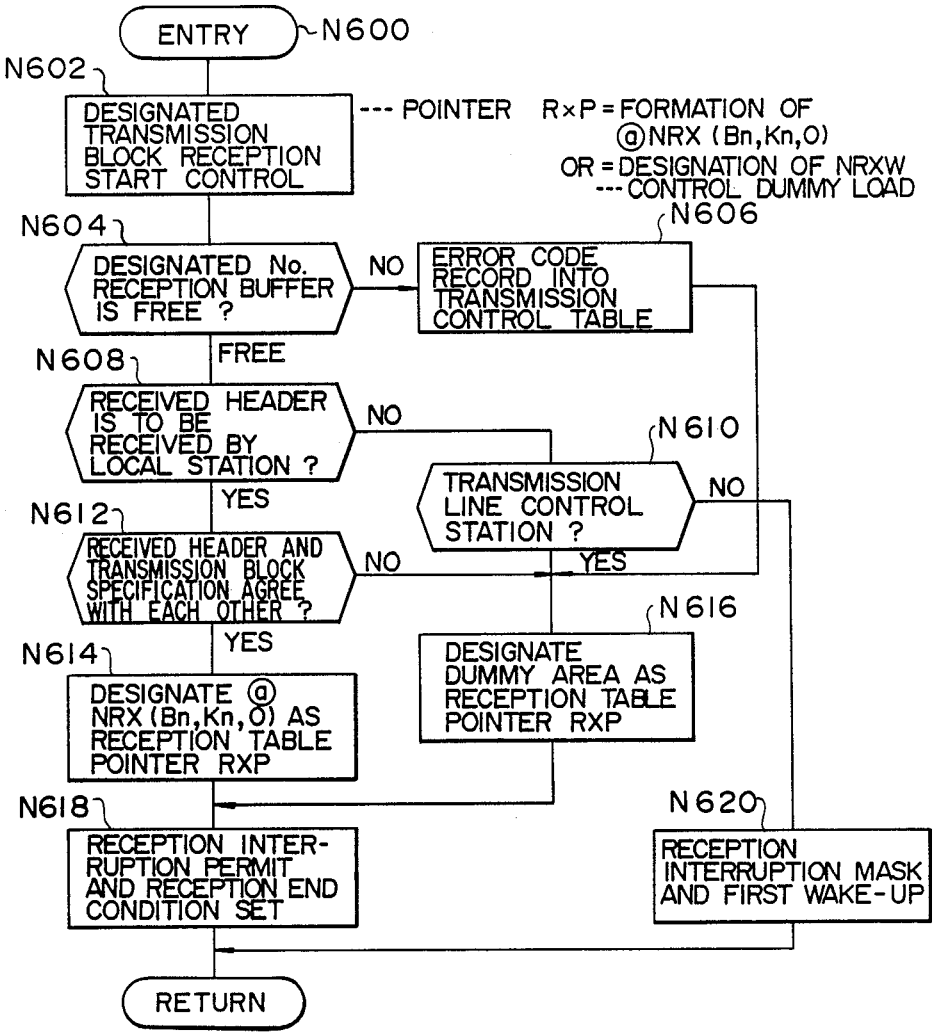

The detailed processing flow chart of the step N650 is shown in FIG. 37. As shown in FIG. 37, transmission of data with the data length of the transmission number MAXT and the reception number MAXR is executed successively for every station based on the maximum station number MAXK defined in the transmission specification NWST-BN (steps N652 to N676). Transmission header is issued for every transmission-designation station from the transmission block reception station and then is detected in the step N538 of the interrupt processing (FIG. 31) of the designation station, so that reception starting processing N600 is started. Data transmission and data reception progress simultaneously and in parallel corresponding to the transmission processing in the steps N660 to N672 in FIG. 37, the reception starting processing in FIG. 35, the reception continuing processing (having a merit that the processing of FIG. 29 can be continued in the intervals of the reception iRQ processing) and the reception completion processing N630 as shown in the detailed flow chart of FIG. 36.

Figure 32:
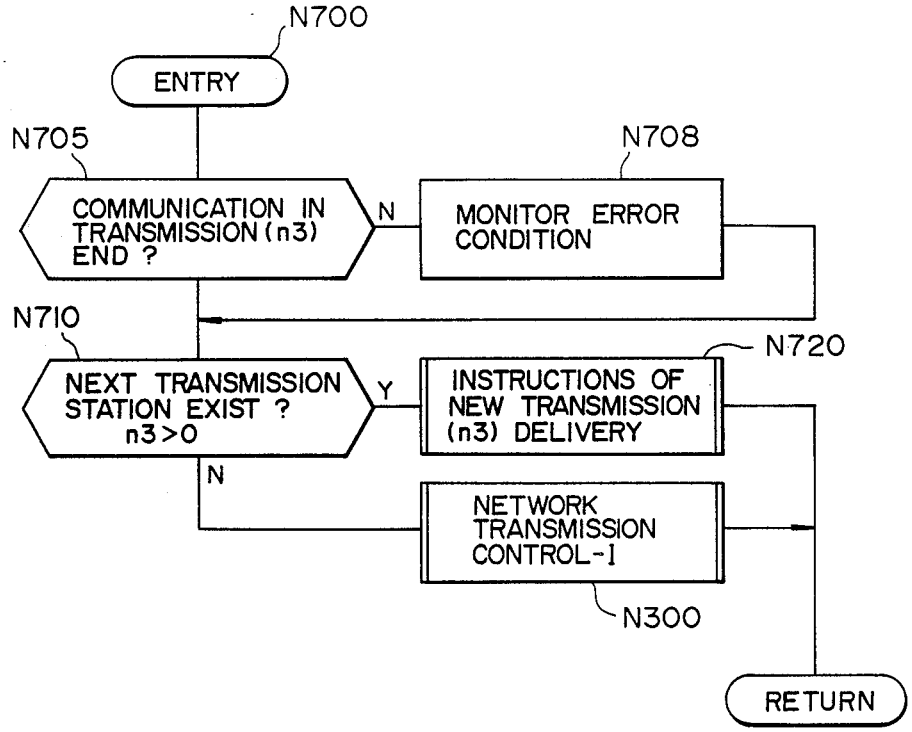

When a series of transmission block processing is completed, the transmission processing N650 is terminated. Then, a judgment as to the fact that the target station is not a transmission controlling station is made in the step N544, so that the transmission block-terminated command is transmitted. On the other hand, the transmission control station carries out the transmission control-II processing in the step N700, so that the transmission block number transfer processing for starting the next transmission block is carried out in the steps N763 to N785 as shown in FIG. 33 through the steps N705 to N710 of FIG. 32.

Figure 36:
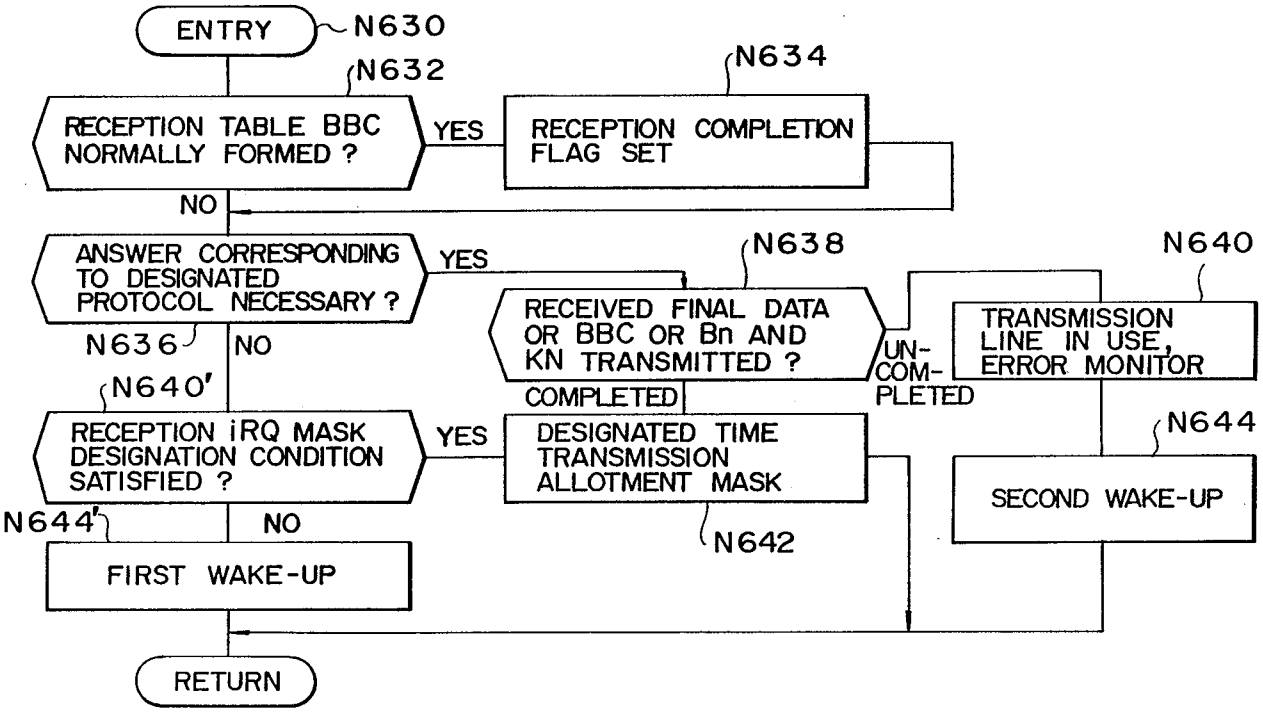

FIG. 38 is a detailed flow chart of the reception buffer development processing which is started from FIG. 10. Searching (S202, S204, S210, S212, S214) of the reception buffer in which the reception completion flag generated in the step N634 in FIG. 36 is set is carried out, so that a data of designated size is copied from the reception buffer to the reception table (S248). In the case of a signal-change mode, the data is further developed into the input table in the step S250 while a fault in data number designation, a data error in the changed signal block by reference to a checker data, and the like are checked.

In the following, the present invention, as to the case where it is applied to an elevator control system having two elevators arranged in parallel (hereinafter referred to as "duplex elevator control system"), is described with reference to FIG. 41.

Each of elevator control microcomputer portions 1*a*1 and 1*a*2 installed in No. 1 and No. 2 elevator control panels is composed of a section having an elevator controlling function, and a section having a two-elevator management controlling function for controlling two elevators relationally by control means such as hall-call-designation control, dispersive standby control, management operation control, pattern operation control and the like. The elevator controlling functions of the respective elevator controllers are the same both in hardware and in software, whereas the management controlling functions thereof are provided dispersively.

In the duplex elevator control system, communication ports 200*a*1, 200*a*2, 200*b*1, 200*b*2 of the elevator control panels 10*a*1, 10*a*2 are constructed so that a plurality of transmission/reception circuits are provided corresponding to one signal transmission host controller in accordance with the present invention. These ports are connected to the control microcomputer portions 1*a*1 and 1*a*2, respectively. Two bus lines 3*c*1 and 3*e*1 are connected to the communication port 200*a*1 of the No. 1 elevator I/O transmission controller 200*a*1. The bus line 3*c*1 serves to connect between the communcation port 200*a*1 and a cage terminal (not shown) provided in the elevator cage. The bus line 3*e*1 serves to connect between the communication port 200*a*1 and the communication port 200*b*2 of the No. 2 elevator controller 10*a*2. Further, a middle uneven-number floor I/O bus line 3*c*1 and a high uneven-number floor I/O bus line 3*d*1 which are used in a high-rise building can be connected to the communication port 200*a*1. In this case, an extension communication board 2*b* is provided so that a middle even-number floor I/O bus line 2*c*2 and a high even-number floor I/O bus line 3*d*2*a* can be connected to the communication port 200*a*3.

Further, two bus lines L17 and 3*a*5 are connected to the communication port 200*a*2. The bus line L17 serves to connect between the communication port 200*a*2 and the communication port 200*b* of the No. 2 elevator controller 10*a*2. The bus line 3*a*5 serves to connect between the communication port 200*a*2 and terminals 5*a*2, 5*b*2 provided in the No. 2 elevator hall. The communication ports 200*b*1 and 200*b*2 of the No. 2 elevator are connected through the bus lines in the same manner as those of the No. 1 elevator.

Figure 42:
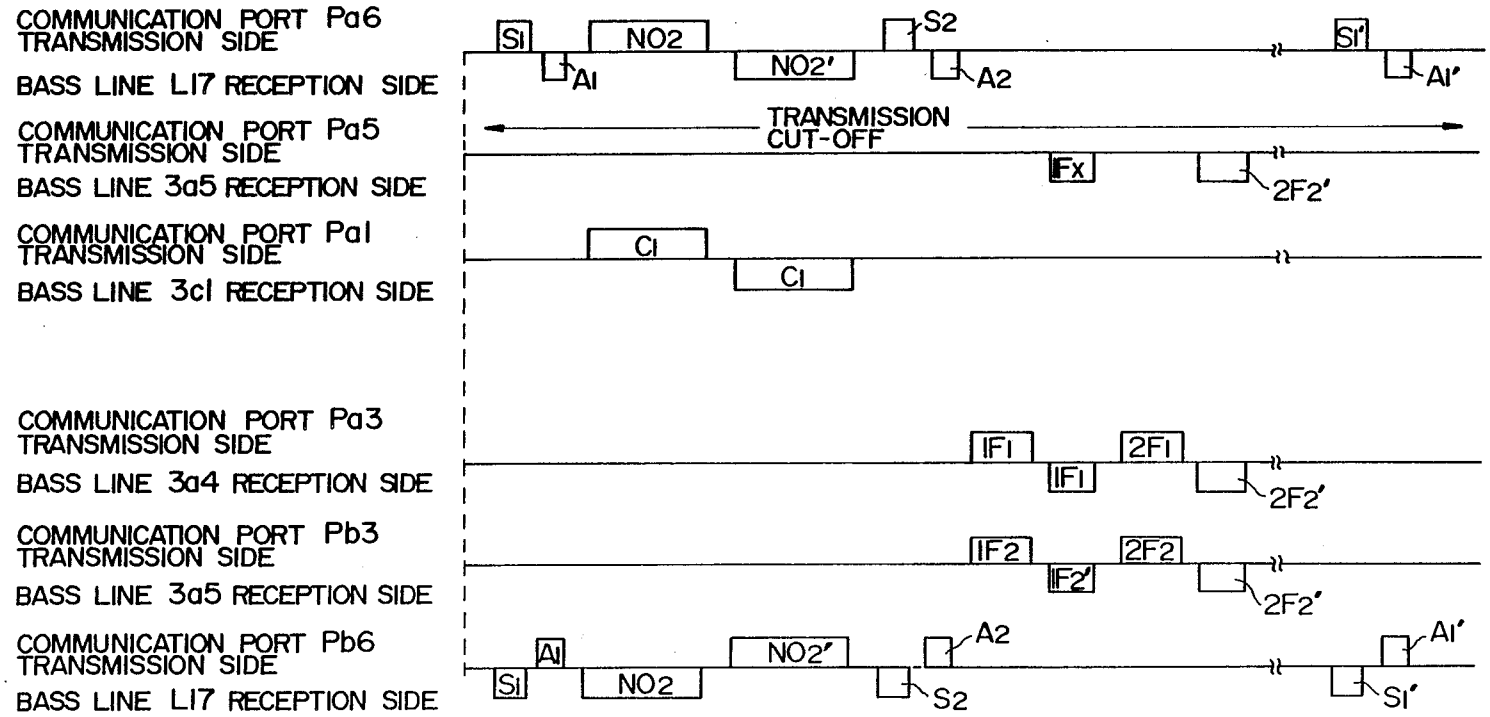

In the duplex elevator control system constructed as described above, the data transmission processing is carried out in the timing as shown in FIG. 42. As described above, the No. 1 and No. 2 elevator controllers have the same management controlling function. For explanation, it is now assumed that the No. 1 elevator controller is in charge of the management controlling function. In this construction, the communication port 200*a*2 of the No. 1 elevator is established to be a control station when communication between the elevator controllers is carried out through the bus line L17. On the other hand, when communication with one of the terminals provided in the cages and halls is carried out, the communication port 200*a*1 of the No. 1 elevator or the communication port 200*b*1 of the No. 2 elevator is established to be a control station. These signal transmission host controllers serving as control stations perform data exchange with each terminal by a polling selection method through a corresponding bus line.

A communication starting synchronization signal (S1 in FIG. 42) is sent out at a pin P*a*6 of the No. 1 elevator communication port 200*a*2 as an interelevator communication control station and, at the same time, polling selection sequence with a cage terminal (not shown) is executed through the bus line 3*c*1 from a pin P*a*1 of the communication port 200*a*1.

In this case, the transmission port is cut so that no signal is sent onto the bus line 3*a*4. At the same time, the No. 2 elevator control microcomputer 1*a*2 which has received the synchronization signal S1 for starting communication with a cage terminal (not shown) executes polling selection sequence with the cage terminal in the same manner as the No. 1 elevator control microcomputer. In this case, the transmission port is cut similarly so that no signal is sent onto the bus line 3*a*5. During this period, a pin P*a*6 of the No. 1 elevator communication port 200*a*2 sends out a communication starting synchronization signal S1 and then sends instructions related to the running control for the No. 2 elevator, so that signals, such as an elevator operation direction signal, a elevator position signal and the like, and lastly a cage communication-terminated signal are returned from a pin P*b*6 of the No. 2 elevator communication port 200*b*2 to the pin P*a*6 of the No. 1 elevator communication port 200*a*2. When the pin P*a*1 of the communication port 200*a*1 and the pin P*a*6 of the communication port 200*a*2 respectively detect the termination of the aforementioned predetermined communication, the No. 1 elevator control microcomputer portion 1*a*1 having the duplex elevator operation management controlling function advances to the next sequence. In the next period, a communication starting synchronization signal S2 is sent to each terminal provided in the hall from the port P*a*6 of the No. 1 elevator communication port 200*a*2 in the same manner as described above, so that the communication ports 200*a*1 and 200*a*2 are established to be control stations for controlling the respective elevators to thereby execute polling selecting sequence for exchange of respective hall terminal data. In this case, the pin P*a*5 of the No. 1 elevator port 200*a*2 receives, in the form of a kind of tapping, the push-button input signal sent to the port P*b*3 of the communication port 200*b*1 from the No. 2 elevator hall terminals (5*a*2, 5*b*2 and the like). As described above, the bus line 3*a*5 connected to the No. 2 elevator hall is provided so as to be also connected to the No. 1 elevator, by which the No. 1 elevator controller 1*a*1 having the duplex elevator management controlling function can obtain the No. 2 elevator hall push-button input information directly. However, in the case where the bus line 3*a*5 is not connected to the No. 1 elevator communication port 200*a*2, the hall push-button information is inputted into the No. 2 elevator communication port 200*b*1 and then the information read by the operation control microcomputer portion 1*a*2 is sent to the communication port b2 so that the communication port 200*b*2 having received the information sends the signal to the No. 1 elevator communication port 200*a*2 through the bus line L17. Lastly, the information is received by the No. 1 elevator control microcomputer 1*a*1.

Accordingly, by using the system of the invention in the duplex elevator control system, the No. 1 elevator operation-control microcomputer portion having the management controlling function can obtain the No. 2 elevator hall push-button information in a short time, so that duplex elevator operation management controlling can be made rapidly and securely to improve elevator service.

According to the present invention, a plurality of transmission/reception ports are provided corresponding to one communication control microcomputer, so that a duplex elevator system can be simplified in construction without increase of the size and without increase of the cost. However, in the case where the aforementioned construction is not employed, each elevator requires four communication ports and four communication-control microcomputers. Consequently, in accordance with the present invention, bus lines can be used effectively without increase of the number of communication-control microcomputers.

Further, by constructing the duplex elevator system as described above, even in the case where the power supply for the No. 2 elevator is cut off or a controller failure occurs, the signal generated by pushing the No. 2 elevator hall button can be fetched by the No. 1 elevator control microcomputer portion because the No. 2 elevator hall terminal is connected to the No. 1 elevator communication port through the bus line 3*d*2.

Accordingly, there arises an advantage in that a measure counter the failure or power cut-off of the No. 2 elevator controller is provided without lowering elevator service.

Figure 43:
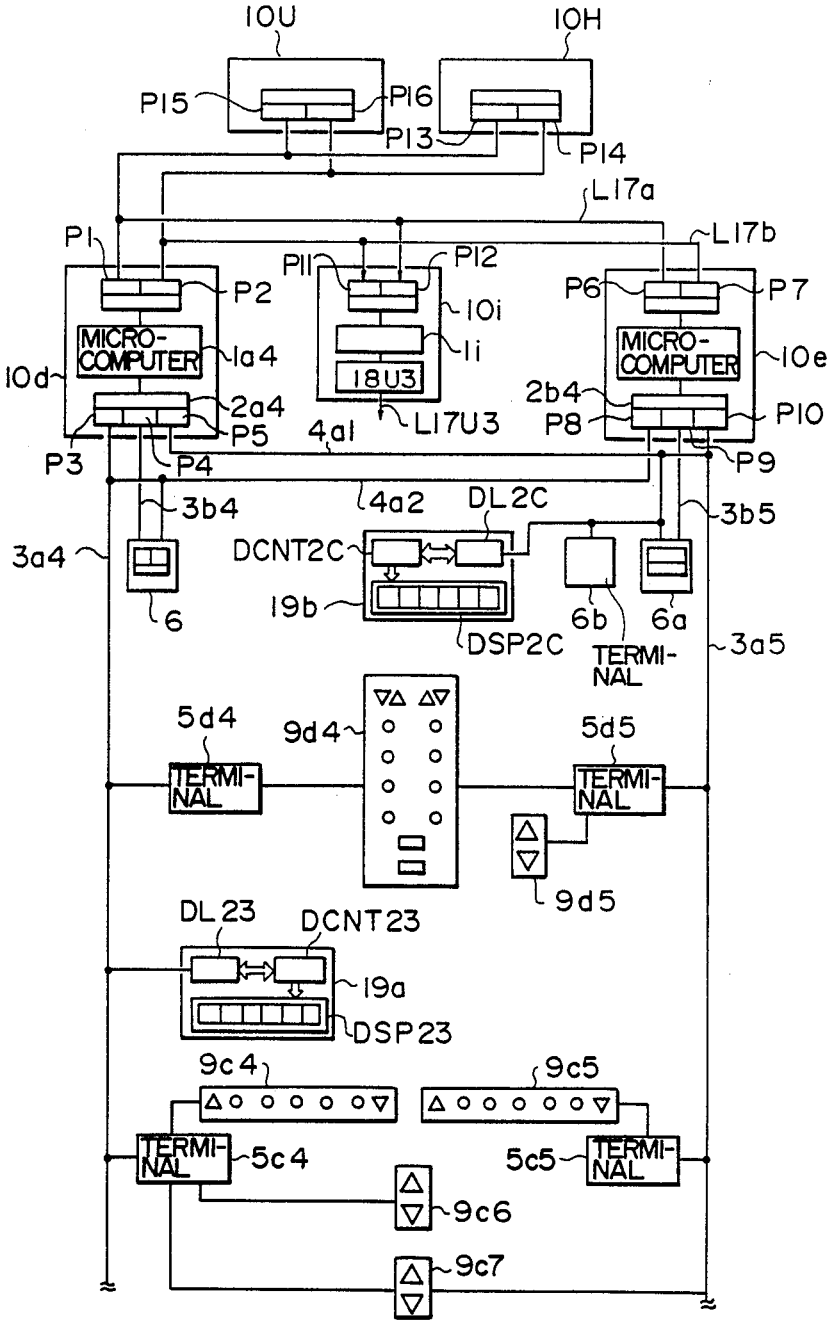
FIG. 43 is a diagram illustrating another example of the construction of the duplex elevator system.

FIG. 43 shows another embodiment of the duplex elevator system. Different points between this embodiment and the aforementioned embodiment as shown in FIG. 41 are as follows.

(1) In this embodiment, the elevator I/O transmission controllers 2*a*4 and 2*b*4 incorporated into the elevator controllers 10*d* and 10*e* are constructed so that three transmission/reception circuits are provided corresponding to one transmission controller. With respect to the method of use of the transmission/ reception circuits, the transmission/reception circuits P3 and P10 carry out data exchange, through buses 3*a*4 and 3*a*5, with terminals 5*c*4, 5*c*5, 5*d*4 and 5*d*5 mainly installed in the halls to thereby perform input-output control of hall buttons 9*c*6, 9*c*7, 9*d*5, etc., mounted to the terminals. Furthermore, the transmission/ reception circuits carry out exchange of information data with a display indicator DSP23 of an information terminal 19*a* installed in the 1st floor.

Then, the transmission/reception circuits P4 and P9 carry out exchange of control data with in-cage terminals 6, 6*a* and 6*b* through buses 3*b*4 and 3*b*5. Further, the transmission/reception circuit P10 carries out exchange of information data with an in-cage information terminal 19b. As described above, the data exchange with the in-cage terminals is separated into two types, that is, control-system and information-system, for the double purpose of preventing interference of control system with information system in spite of occurrence of mistaken data and improving reliability on data exchange with the cage by using information-system buses at the time of failure of control-system buses.

Through the buses 4a1 and 4a2, the transmission/-reception circuits P5 and P10 serve to tap data on the buses 3a4 and 3a5 connected to the partner elevator hall. Further, the transmission/reception circuits P5 and P10 are used for service for hall terminals in an elevator out of operation.

As described above, one transmission controller has three transmission/reception circuits, by which a backup function can be provided to prevent entire system down, even if hardware trouble (such as breakdown of bus line) occurs partly.

(2) In the case where one hall button 9b4 is provided for two elevators as shown in an example of the 2nd floor, the hall button 9d4 is connected to the two elevator terminals 5d4 and 5d5 installed on the 2nd floor so that the hall button 9d4 can be controlled while one elevator is out of operation.

(3) In the case where maintenance terminal equipments 10H, UCB10H are connected to specific rooms, such as a machine room, a building manager's room and the like, and further an information display terminal equipment 10i is connected thereto, the buses are used so as to be separated into the control system L17a and the information system L17b in the same manner as in the group control system of FIG. 19 to thereby attain an improvement in reliability. In particular, in the drawing, the information display terminal equipment 10i is constructed so that both a transmission-enable circuit P11 and a reception-enable circuit P10 are provided for one transmission controller. Accordingly, data cannot be transmitted through the control bus L17a from the information display terminal equipment 10i.

Although the aforementioned embodiment has shown the case where a bus-type transmission line is used as a transmission line, it is to be understood that the invention is not limited to the specific embodiment but the invention is applicable to the case where loop-type transmission line may be used as long as somewhat complication of wiring can be ignored.

When an abnormality occurs in one elevator controller during the elevator group management control, the elevator controller stops transmission. Accordingly, the cage operated by the elevator controller stops at the nearest floor and, at the same time, input-output terminal equipments connected to the transmission line carry out information prepared for the occurrence of abnormality or stop information. On the other hand, when the group management and control equipment recognizes that no signal comes from the elevator controller, the group management and control equipment changes the control assignment from the elevator controller to another lower-rank elevator controller so that confusion of control can be prevented as the whole.

Consequently, the elevator control system composed of a small number of standardized input-output terminal equipments (4, 6, 19, 13) connected through common serial data transmission lines and transmission controllers (2, 17) is superior in self-recovery power in case of occurrence of abnormality. Furthermore, even if a failure or trouble occurs, the range of function down can be localized. Hence, an elevator control system excellent in reliability and safety as well as excellent in economics and maintenance can be constructed.

We claim:

1. An elevator control system comprising an elevator controller for controlling the running of a cage and a plurality of input/output terminal equipments for controlling devices provided at a landing place on each floor and/or in said cage, each of said elevator controller and said plurality of input/output terminal equipments including a transmission controller provided with a transmission circuit and a reception circuit so that said elevator controller and said plurality of input/output terminal equipments are connected to each other through transmission lines, wherein each of said elevator controller and said plurality of input/output terminal equipments is provided with an abnormality detection means for detecting an abnormality and a transmission stopping means for inhibiting transmission through said transmission circuit of its own transmission controller upon detection of occurrence of an abnormality by said abnormality detection means.

2. An elevator control system according to claim 1, in which said elevator controller and said plurality of input/output terminal equipments serially transmit data to each other through bus-type transmission lines.

3. An elevator control system according to claim 1, in which said elevator controller and said plurality of input/output terminal equipments are connected to each other through bus-type transmission lines constituted by a bus-type transmission line for connecting each input/output terminal equipment provided in said cage to said elevator controller and another bus-type transmission line for connecting each input/ output terminal equipment provided on each landing place to said elevator controller.

4. An elevator control system according to claim 1, in which each of said plurality of input/output terminal equipments includes a device for performing at least one of display guide and voice guide related to said cage, door operation of said cage, call-registration of said cage, and guide and display of services, and each of said plurality of input/output terminal equipments makes said device inoperative upon detection of an abnormality.

5. An elevator control system according to claim 1, in which each of said plurality of input/output terminal equipments includes a device for performing at least one of display guide and voice guide related to said cage, door operation of said cage, call-registration of said cage, and guide and display of services, and in which upon detection of an abnormality, each of said plurality of input/output terminal equipments causes said device to perform control in a mode different from that when said cage is running normally.

6. An elevator control system according to claim 1, in which when one of said plurality of input/output terminal equipments stops transmission because of occurrence of an abnormality, said elevator controller makes a confirmation in stoppage of said cage as to whether said one input/output terminal equipment has recovered a normal state or not, and said elevator controller recognizes that a necessary condition has been satisfied upon reception of an answer from said one input/output terminal equipment so that said elevator controller restarts transmission to said one input/output terminal equipment.

7. An elevator control system according to claim 1, in which when one of said plurality of input/output terminal equipments stops transmission because of occurrence of an abnormality, said elevator controller makes a confirmation upon termination of communication with the other input/output terminal equipments as to whether said one input/output terminal equipment has recovered a normal state or not after termination.

8. An elevator control system according to claim 1, in which said abnormality detection means has a function for judging the rationality of received data.

9. An elevator control system according to claim 1, in which said abnormality detection means is arranged so as to recognize that an abnormality exists when an upward signal and a downward signal are included at the same time in transmitted data or when a floor number signal indicates the number of floors which exceeds the maximum number of floors previously transmitted as a common elevator specification.

10. An elevator control system according to claim 1, in which respective micro-computers of said elevator controller and said transmission controller are connected through a dual-port RAM storing a transmission specification to be used by said transmission controller.

11. An elevator control system according to claim 1, in which when two cages are controlled, said elevator controller for each of said two cages is provided with two transmission controllers which are connected to each other.

12. An elevator control system according to claim 1, in which when two cages are controlled, said transmission controller of said elevator controller for each of said two cages is provided with three transmission/reception circuits each of which is connected to the same input/output terminal equipment in each of said cages.

13. An elevator control system according to claim 1, in which said elevator controller is connected to at least one of an elevator group controller, a maintenance information controller for watching abnormality in elevator and for performing information transmission with a distant place, a user command board for performing control specification setting and entry of information guide, and an information controller.

14. An elevator control system comprising an elevator controller for controlling the running of a cage and a plurality of input/output terminal equipments for controlling devices provided at a landing place on each floor and/or in said cage, each of said elevator controller and said plurality of input/output terminal equipments including a transmission controller provided with a transmission circuit and a reception circuit so that said elevator controller and said plurality of input/output terminal equipments are connected to each other through transmission lines, wherein each of said elevator controller and said plurality of input/output terminal equipments is provided with an abnormality detection means for detecting an abnormality and a transmission stopping means for inhibiting transmission through said transmission circuit of its own transmission controller upon detection of occurrence of an abnormality by said abnormality detection means, and wherein said transmission controller is arranged so that after occurrence of an abnormality, said transmission controller does not restart transmission before predetermined conditions are satisfied.

15. An elevator control system comprising an elevator controller for controlling the running of a cage and a plurality of input/output terminal equipments provided at a landing place on each floor and/or in said cage, said elevator controller and said input/ output terminal equipments being connected through transmission controllers and transmission lines, each of said elevator controller and said input/output terminal equipments having a microcomputer, wherein when the transmission controller of one of said input/ output terminal equipments is abnormal, transmission from said transmission controller of said one input/ output terminal equipment is stopped so that only data necessary for said cage and said input/output terminal equipments exist on said transmission lines.

* * * * *